US005915680A

United States Patent [19]

Umemura et al.

[11] Patent Number: 5,915,680

[45] Date of Patent: Jun. 29, 1999

[54] FOLDABLE CONTAINER ASSEMBLY

[75] Inventors: Izuru Umemura, Tokyo; Tadayoshi Hashizume, Saitamaken; Manabu Irisawa, Chibaken, all of Japan; Ted Smart, Melrose Park, Ill.; Kelly Joe Hollon, Milan, Ill.; Randall G. Nagai, Des Plaines, Ill.; Donald Ballin, Highland Park, Ill.

[73] Assignee: B & C Incorporated, Tokyo, Japan

[21] Appl. No.: 08/887,996

[22] Filed: Jul. 3, 1997

Related U.S. Application Data

[63] Continuation-in-part of application No. 08/822,073, Mar. 20, 1997.

[51] Int. Cl.[6] ..... A61G 17/013

[52] U.S. Cl. ..... 27/4; 27/35; 220/6

[58] Field of Search ..... 27/4, 7, 14, 16, 27/35; 220/408, 410, 438, 440, 441, 443, 442, 463, 6, 8, 4.28, 4.29

[56] References Cited

U.S. PATENT DOCUMENTS

| | | |
|---|---|---|
| 1,348,579 | 8/1920 | Post et al. . |
| 1,507,957 | 9/1924 | Edwards . |
| 1,606,011 | 11/1926 | Williamson . |
| 4,773,134 | 9/1988 | Kay . |
| 4,800,631 | 1/1989 | Pellman . |
| 4,967,455 | 11/1990 | Elder . |
| 5,035,032 | 7/1991 | Nutting . |
| 5,111,559 | 5/1992 | Mohr et al. . |
| 5,353,484 | 10/1994 | Woedl et al. . |
| 5,454,141 | 10/1995 | Ozban et al. . |
| 5,485,661 | 1/1996 | McClure . |

FOREIGN PATENT DOCUMENTS

WO 9409741 5/1994 WIPO .

*Primary Examiner*—Kien T. Nguyen
*Attorney, Agent, or Firm*—Fitch, Even, Tabin & Flannery

[57] ABSTRACT

A foldable container assembly of fiberboard material is provided which can support and contain a corpse therein solely with the container fiberboard material without the use of wood frame members and the attendant weight and expense associated therewith. Preferably, the container assembly is provided partially preassembled in the transport container including an outer body portion of the main container body which can be bent or collapsed from its operative orientation to a smaller transport orientation to fit in the compact transport container. Similarly, a large lid section of a two part lid can be partially preassembled and folded to a smaller transport form for shipping. The main container body also includes a fluid containment portion formed from a fluid containment panel of corrugated fiberboard material which is folded to form the fluid containment portion and placed in the container body to minimize leakage of fluids from the container and to assist in supporting loads placed thereon. The fluid containment portion includes sealing gussets so that when the fluid containment panel is folded into its operative state for being placed into the container body, there will be no seams along the bottom of the upstanding walls of the folded fluid containment panel.

10 Claims, 69 Drawing Sheets

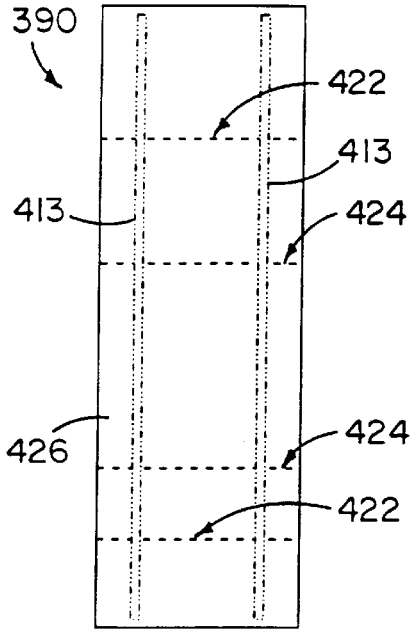
FIG. 54
FIG. 56
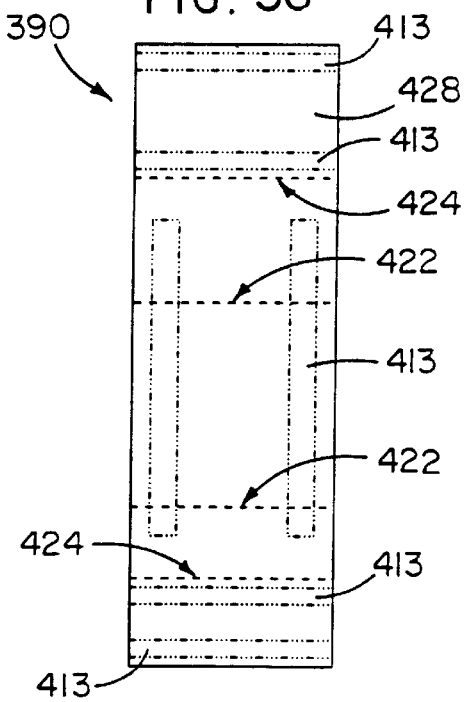
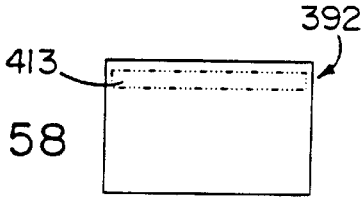
FIG. 58
FIG. 55
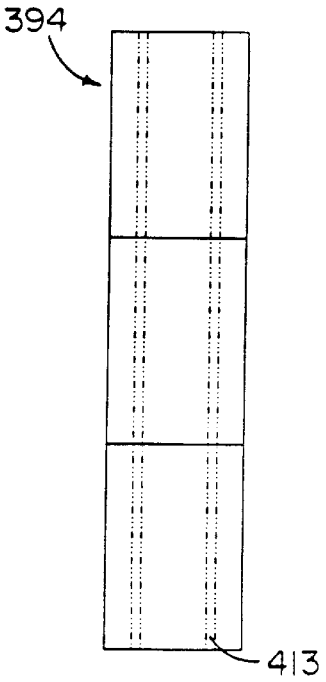
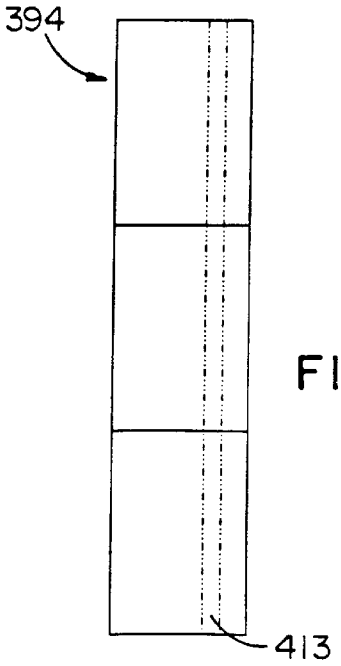
FIG. 57

FIG. 76
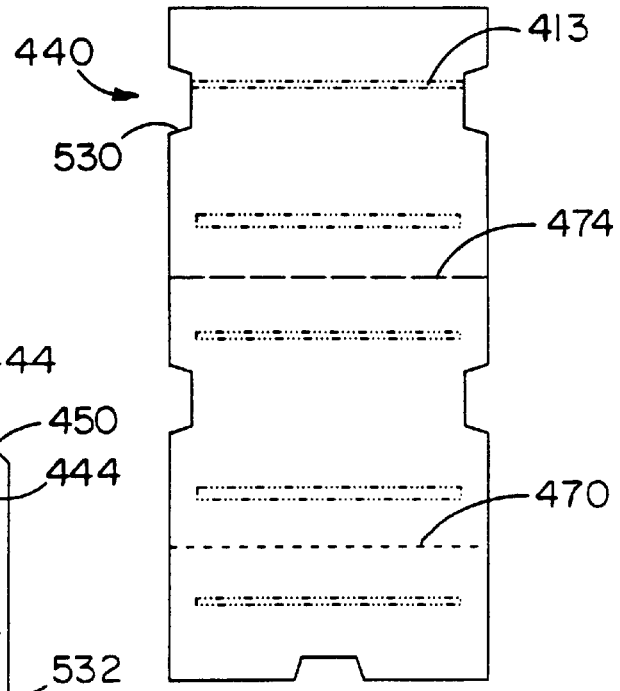
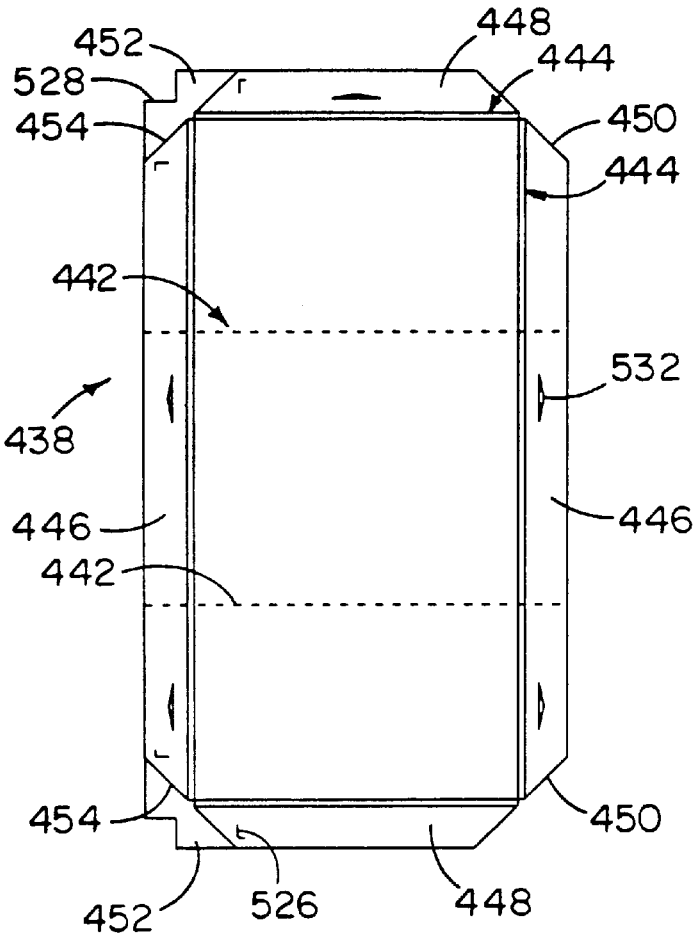
FIG. 75
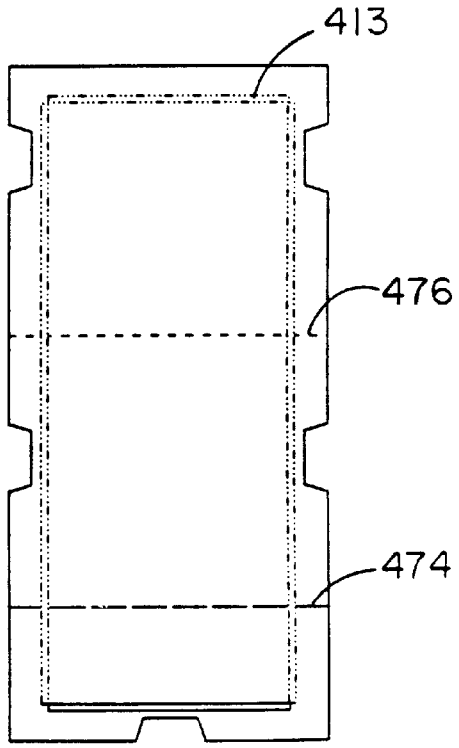
FIG. 77

FIG. 79
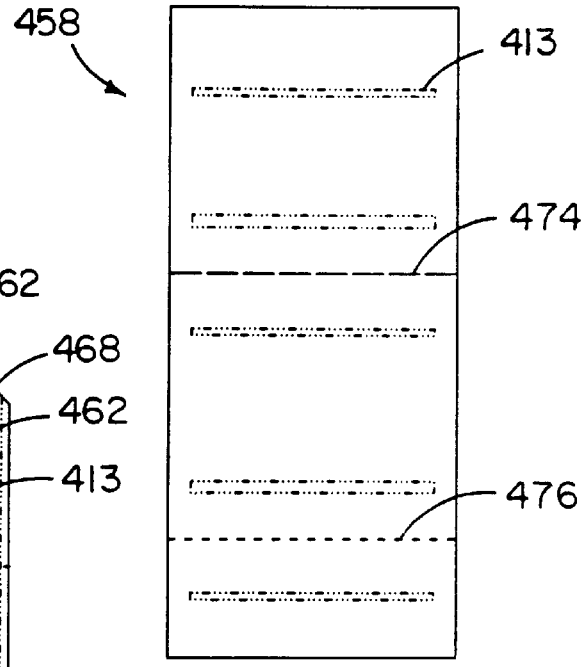
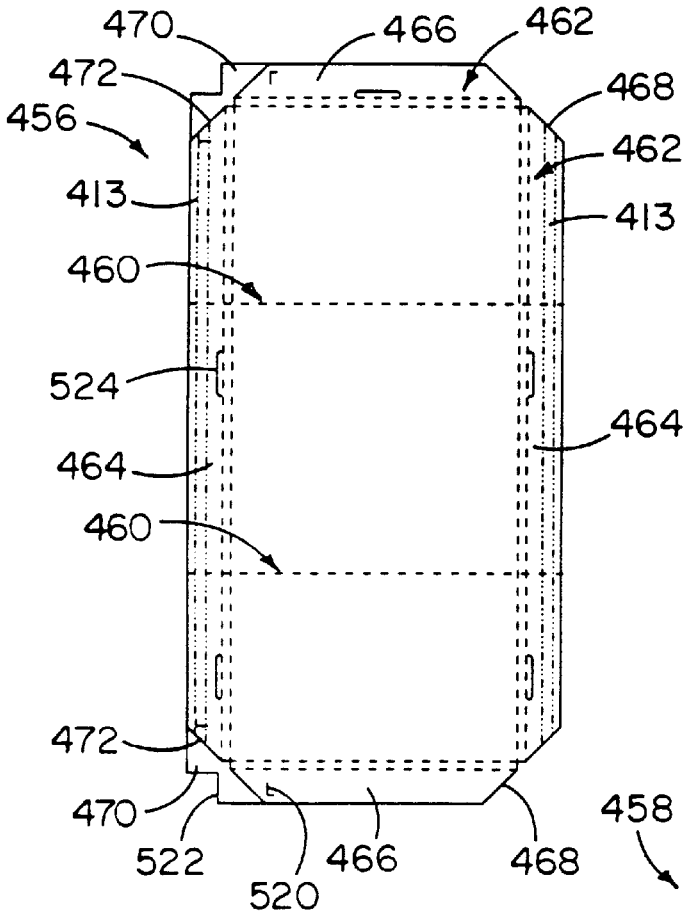
FIG. 78
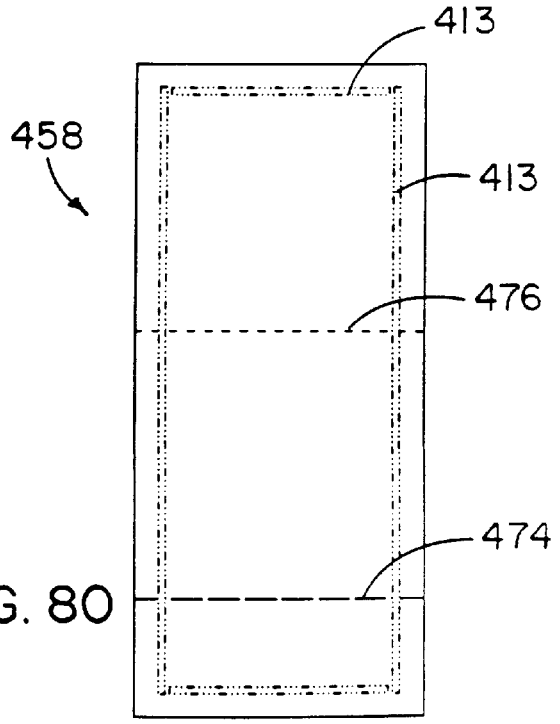
FIG. 80

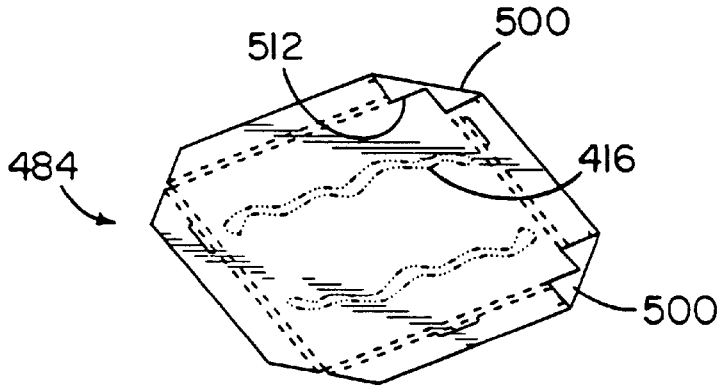
FIG. 97
FIG. 98
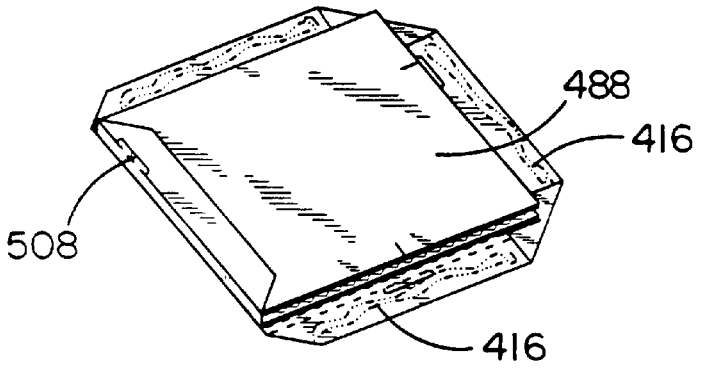
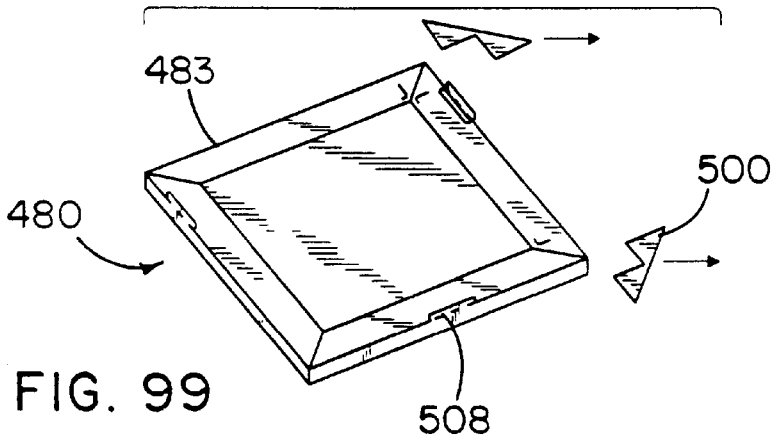
FIG. 99

FOLDABLE CONTAINER ASSEMBLY

CROSS-REFERENCE TO RELATED APPLICATION

This application is a continuation-in-part of U.S. patent application Ser. No. 08/822,073, filed on Mar. 20, 1997.

FIELD OF THE INVENTION

The invention relates to a foldable container assembly, and more particularly, to foldable containers of fiberboard material for use in supporting and containing a corpse therein.

BACKGROUND OF THE INVENTION

Use of corrugated fiberboard material for coffins or cremation containers is generally known. The advantage of such containers is in their low cost and light weight for transport or shipping and handling purposes versus wood or metal caskets, and, where used as a cremation container, the fiberboard provides a material that is readily burned off. Also, for storage and shipping purposes, it is known to provide for fold lines in the material so as to ship the unassembled containers in a collapsed state and to be able to assemble the container after shipping by folding of the fiberboard material into the desired form. Typically, such foldable containers are also provided with wood framing members to keep them in their folded, assembled form and to enhance their rigidity and thus their strength for supporting the relatively large weights to which they will be subjected. However, the use of wood framing members is undesirable for the weight and assembly reasons described above as the wood frame members weigh more than the fiberboard and cannot be folded. Accordingly, there is a need for a coffin or cremation container formed of fiberboard material which can be folded into its assembled, operative condition without the need for framing members to maintain the container in its folded configuration or for support and load bearing purposes.

In Japan, for example, where Buddhism is practiced and the need for cremation containers is high, there are few trucks available for use in transporting goods, in part due to the high cost of fuel therefor. As such, products that can fit in automobiles, such as in their trunks, facilitate transport thereof and reduce transportation expenses associated therewith. Where the assembled product is too big to be fit in a car trunk, parts for the product should be able to be placed in the trunk in a compact state. In prior foldable fiberboard containers, the transportation of the panels is difficult due to the size of the panels. The panels could be randomly folded along their fold lines provided for forming the final product to fit them into the trunk; however, this solution is unsatisfactory due to the random nature of the folding that would be done and further because it is not clear that such folding would result in a sufficiently compact form of the container panels for fitting in the car trunk. Accordingly, a fiberboard container that can be folded in a predetermined manner so as to fit compactly into a small space in a vehicle for their transport, such as in the trunk space of an automobile, would be desirable.

Another problem in forming these containers is that they need a liner which is substantially leak-proof to minimize the escape of fluid, e.g., body fluids and/or embalming fluids (if used), from the container. It has been proposed to use plastic tray liners in these containers to avoid leakage therefrom. Where the container is to be folded into its final operative form, such leakage can occur at the seams formed along adjacent walls which are folded into abutment with each other. The provision of a liner into such foldable containers can often complicate the assembly thereof.

U.S. Pat. No. 5,353,484 to Woedl et al. proposes a foldable blank of fiberboard material covered with a flexible liquid impervious fabric liner on one side thereof to minimize assembly problems with the liner. However, Woedl et al. also require the use of wood framing members secured to the blank before it is folded and assembled into its operative form. Fasteners are also needed to assemble the casket of Woedl et al., requiring fastener receiving holes to be aligned before the fasteners are inserted therethrough. The use of fasteners increases the number of parts needed to assemble the Woedl et al. casket and can create difficulties during assembly in properly aligning the holes for insertion of the fasteners therethrough, thus increasing the assembly time. These containers will be typically assembled by undertakers so that it is particularly important that they be easily and quickly assembled in a convenient fashion without requiring any special assembly parts or tools. Thus, there is a need for a leak-free, foldable coffin or cremation container of a fiberboard material which can be quickly assembled in a trouble-free manner and which does not need framing members to keep its shape or for support and rigidity purposes. In addition, it would be desirable to provide a foldable container as described wherein the structure utilized to minimize leakage therefrom was also adapted to support the loads to be taken by the fiberboard of the container.

SUMMARY OF THE INVENTION

In accordance with the present invention, a foldable container assembly of fiberboard material is provided which can support and contain a corpse therein solely with the container fiberboard material without the use of wood frame members and the attendant weight and expense associated therewith. In addition, the container assembly herein is formed from fiberboard panels provided with fold lines so as to allow the container to be folded and placed into a relatively small, compact transport container for transport as in the trunk of a car, and then into its final form after shipment in a quick and easy manner without the use of any special tools. The container assembly includes an outer body portion formed from a body panel of corrugated fiberboard material which is folded into a predetermined operative orientation. The body panel fold lines include bending lines which allow the outer body portion to be bent from its operative orientation to a smaller transport orientation for placement into a transport container which is smaller than the container assembly. The container assembly also includes a fluid containment portion formed from a fluid containment panel of corrugated fiberboard material which is folded to form the fluid containment portion and placed in the container body to minimize leakage of fluids from the container and to assist in supporting loads placed thereon. The fluid containment portion includes sealing gussets so that when the fluid containment panel is folded into its operative state for being placed into the container body, there will be no seams along the bottom of the upstanding walls of the folded fluid containment panel. In addition, the folding lines of the fluid containment panel can include bending lines which allows the fluid containment portion to be bent along these lines for facilitating placement into the container body, such as after the container body portion is removed from the small transport container and bent back about its bend lines from its small transport orientation to its larger operative orientation, and to allow first one half of the containment portion to be attached in the container interior such as by an adhesive, and then the other half of the folded containment panel to be adhered in the container interior. It has been found that the present container can be assembled in approximately 15 minutes, such as by an undertaker, without the need for special fasteners or tools for such assembly.

In one form of the invention, a container of corrugated fiberboard material which can be folded into it operative orientation having an interior for supporting and containing a corpse therein solely with the strength of the container fiberboard material is provided. The container assembly includes a main container body including an outer body portion formed from a body panel of corrugated fiberboard material having a plurality of fold lines to allow the body panel to be folded into a predetermined orientation for assembly with a base and upstanding walls therefrom. An inner fluid containment portion of the main container body is provided for minimizing fluid leakage therefrom with the containment portion being formed from a fluid containment panel of corrugated fiberboard material having a plurality of fold lines to allow the containment panel to be folded into a predetermined orientation for assembly for the fluid containment portion with a base and upstanding walls therefrom. The containment portion predetermined orientation is similar to the body portion predetermined orientation so that with the fluid containment portion placed into the container interior, the containment portion base will be over the body portion base and the containment portion walls will be adjacent corresponding body portion walls to add strength to the body portion base and walls. As is apparent, the foldable container herein utilizes folded panels of only fiberboard material to achieve its strength without utilizing wood framing members as in prior containers. In addition, the present container advantageously uses it fluid containment portion to provide structural strength to the base and walls of the container.

The fluid containment portion can include sealing gussets along bottom sections of its upstanding walls adjacent the containment portion base. In this manner, there is no seam between the bottom sections of adjacent containment portion walls so that the sealing gussets will act to minimize leakage of fluids from the main container body.

In one form, reinforcing fiberboards are attached between corresponding bases and upstanding walls of the outer container body portion and inner fluid containment portion. The boards can have a honeycomb interior structure to provide them with more strength and rigidity than the corrugated panels of the body and containment portions. The boards can include end boards having well portions formed at the bottom thereof for receiving the fluid containment portion sealing gussets therein when the fluid containment portion is placed into the container interior. Use of the reinforcing fiberboard enhances the rigidity and strength of the present container while also accommodating for the sealing gussets of the fluid containment portion.

The body portion walls can include upper flap sections and the body panel fold lines can include flap fold lines to allow the body upper flap sections to be folded over the reinforcing fiberboards and corresponding upstanding fluid containment portion walls and down into the container interior against the upstanding containment portion walls for being attached thereto. In this manner, the fluid containment portion walls and adjacent reinforcing fiberboards are positively captured between the folded down flaps and the upstanding body portion walls. The reinforcing fiberboards can include adhesive thereon to attach the base and upstanding walls of the body and fluid containment portions thereto. The upstanding walls of the fluid containment portion can similarly include adhesive thereon to attach the upper flap sections thereto. It will be recognized that where two members are to be attached together, the adhesive can be provided on one member or the other or both for attaining the desired attachment.

In one form, the fold lines of the fluid containment panel include intermediate bending lines with the bending lines allowing the fluid containment portion to be bent from its predetermined orientation for placing it into the container interior. In this manner, the fluid containment portion can be easily and quickly placed into the interior of the container.

In another form, the folded predetermined orientations of the body and fluid containment portions are that of rectangular boxes. Other shapes will be apparent to those skilled in the art.

A lid is provided and can be formed from at least one lid panel of corrugated fiberboard material having a plurality of fold lines to allow the lid panel to be folded to a predetermined orientation for the lid sized to be disposed over the container upstanding walls closing the container interior space.

In one form, the lid can be formed from first and second lid portions each formed from a panel having a plurality of fold lines to allow the lid panels to be folded to substantially the same predetermined orientation for their respective portions and be attached together to form the lid with one of the first and second lid portions having dimensions smaller than the other of the first and second lid portions. The differences in dimension is such so that there is a lip formed around the smaller lid portion when the lid portions are attached together to allow the smaller folded lid portion to extend into the container interior with the lip disposed over the upstanding walls of the container to close the container interior without extending beyond the outer body portion upstanding walls.

The folded lid panels can be attached together by cooperating tabs and slots formed around the folded lid portions.

In one form, the folded lid portions define a space therebetween and there is a lid stiffening panel which is captured by the attached lid portion to substantially occupy the space therebetween for providing the lid with greater rigidity.

The lid panels can each have a window opening with the window openings being aligned when the folded lid portions are attached together.

In one form, the body panel includes first and second body panel portions which can be attached together to form the body panel, and the fluid containment panel is a single piece of fiberboard material slightly larger than the individual body panel portions but smaller than the panel portions attached to form the body panel. In this manner, the two-piece body panel can take up less space for shipping and handling purposes than if it were a single larger piece.

The fold lines of the body and fluid containment panels can also allow the panels to be folded into collapsed states to fit into a small, compact transport container for transportation thereof which is smaller than the panels predetermined orientations for assembly. The transport container is preferably of a size that allows it to be readily fit into the trunk of a passenger automobile or the like.

In another aspect of the present invention, a fluid containment insert having a predetermined orientation for being placed in a container interior to minimize fluid leakage therefrom is provided and includes a fluid containment panel of corrugated fiberboard material having a plurality of fold lines to allow the panel to be folded to the insert predetermined orientation with a base and upstanding walls therefrom for being placed into the interior of the container adjacent the walls thereof. Adhesive is on one of the container and fluid containment panel for attaching the fluid containment insert in the container interior. The containment panel fold lines include bending lines which allow the fluid containment insert to be bent for first attaching a first portion of the containment insert on one side of the bending lines in the container interior and for then attaching a second portion of the containment insert on the other side of the bending lines in the container interior.

In one form, the folded fluid containment insert includes sealing gussets at the juncture of bottom sections of the upstanding walls thereof so that there is no seam between the bottom sections of adjacent upstanding fluid containment walls when the fluid containment panel is in its folded predetermined orientation.

In another form of the invention, the main container body includes an outer body portion formed from a body panel of corrugated fiberboard material having a plurality of fold lines to allow the body panel to be folded into a predetermined operative orientation with a base and upstanding walls therefrom. The body panel fold lines include bending lines which allow the outer body portion to be bent or collapsed from its predetermined operative orientation to a predetermined smaller transport orientation for being placed in a transport container smaller than the container assembly. In this manner, an undertaker can simply remove the outer body portion from the transport container in its transport orientation and open it back up such as in an accordion-style fashion to the operative orientation without having to fold it up from a flat panel about the fold lines, thus saving time in assembly of the container assembly herein.

In one form, the upstanding walls have an upper periphery bounding an opening and the outer body portion opening is smaller with the outer body portion bent or collapsed to its predetermined transport orientation than with the outer body portion folded into its predetermined operative orientation.

The outer body predetermined operative orientation can be a substantially rectangular box shape with the upstanding walls including opposite sidewalls and end walls, and the bending lines can be provided on the base and the sidewalls with the outer body portion being bent or collapsed to its predetermined transport orientation from the rectangular box predetermined operative orientation by bending or collapsing the sidewalls and base along the bend lines thereon to bring the end walls closer toward each other with the predetermined transport orientation being substantially a square box shape.

In another form, reinforcing fiberboards are provided for being attached to the base and side and end walls of the outer body portion to add strength thereto with the reinforcing fiberboards for the outer body portion base and end walls being substantially preassembled thereto with the outer body portion in its predetermined transport orientation. This provides additional savings in assembly of the container assembly in that attaching the fiberboard for the base and end walls can be done before the container assembly is received by the undertaker in the transport container.

The main container body can include an inner fluid containment portion formed from a fluid containment panel of corrugated fiberboard material having a plurality of fold lines to allow the containment panel to be folded into a predetermined operative orientation with a base and upstanding walls therefrom for being attached in the outer body portion to minimize fluid leakage from the main container body. Reinforcing fiberboards can be attached between the bases and walls of the outer body portion and the fluid containment portion with the fiberboards including fold lines for being folded for transport. When the outer body portion and the fluid containment portion are folded into their operative orientations with the reinforcing fiberboards attached therebetween, the respective fold lines of the outer body portion walls, the fluid containment portion walls and the reinforcing fiberboards therebetween will be in nonaligned relation with each other to enhance the strength of the main container body. In this manner, no areas of concentrated weakness are created such as if the fold lines between the respective outer body portion walls, fluid containment portion walls and fiberboards therebetween were in alignment with each other. Further, attaching the fiberboards with nonaligned fold lines prevents the outer body portion from being collapsed back to its transport orientation.

In one form, the main container body is provided in combination with a lid for closing the main container body. The lid has can have a first section and a second section with the sections each including first and second lid portions. One of the first and second lid portions has dimensions smaller than the other of the first and second lid portions to form a lip extending substantially around the one smaller lid portion which rests on top of the main container body with the one smaller lid portion extending into the main container body.

The first lid portion can include a first abutment edge and the second lid portion can include a second abutment edge that is in substantially aligned relation with the first abutment edge so that the lip does not extend around the one smaller lid portion at the aligned abutment edges. With the first and second sections resting on top of the main container body, their abutment edges will be in close fitting orientation with each other to close off the main container body with the lid sections.

The lid sections can each be formed from a lid panel of corrugated fiberboard material having a plurality of fold lines. Reinforcing fiberboards can be attached to the lid panels with the panels including flap sections for being folded about the lid panel fold lines and on to the reinforcing fiberboards for being attached thereto. Cooperating tabs and slots can be provided around the lid portions in the panel flap sections with the tabs and slots being aligned for inserting the tabs in the slots to attach the lid portions together. Cutouts are provided around the reinforcing fiberboards aligned with the tabs and slots of the lid portions to provide clearance for the tabs inserted in the slots.

BRIEF DESCRIPTION OF THE DRAWINGS

FIGS. 54–58 are plan views of reinforcing fiberboards for being attached between the outer body portion and the fluid containment portion in the main container body;

FIGS. 75–77 are plan views of a lid outer portion panel and both sides of a reinforcing fiberboard for being attached to the panel to form an outer lid portion for the large section of the lid;

FIGS. 78–80 are plan views of a lid inner portion panel and both sides of a reinforcing fiberboard for being attached to the panel to form an inner lid portion for the small section of the lid;

FIGS. 97–99 are perspective views of the assembly of the inner lid portion of the small lid section;

DETAILED DESCRIPTION OF THE PREFERRED EMBODIMENTS

Figure 1:
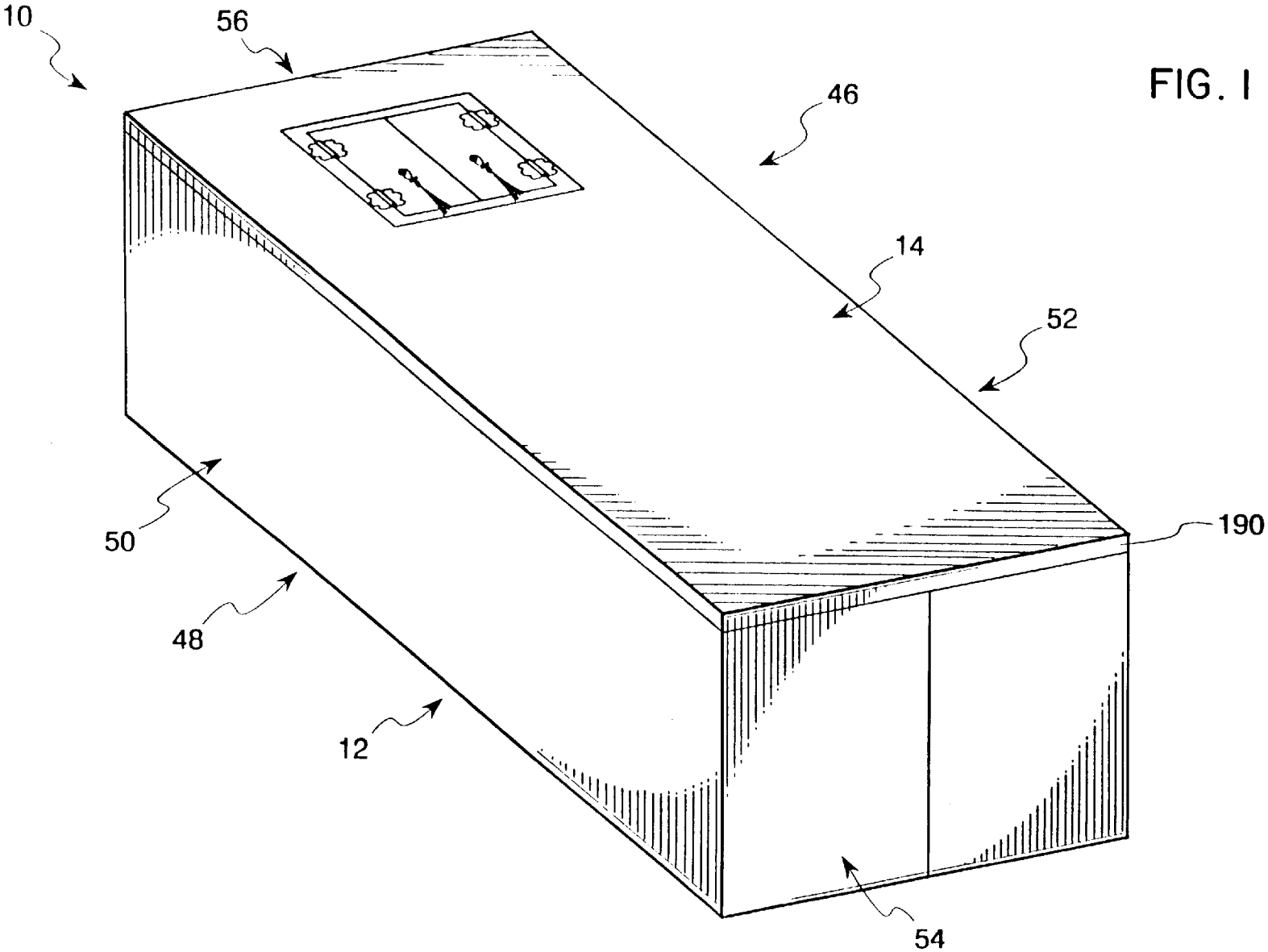
FIG. 1 is a perspective view of the completed container assembly in accordance with the present invention showing the lid of the container on a main body of the container with the lid including a window for viewing the interior of the container assembly.
Figure 23:
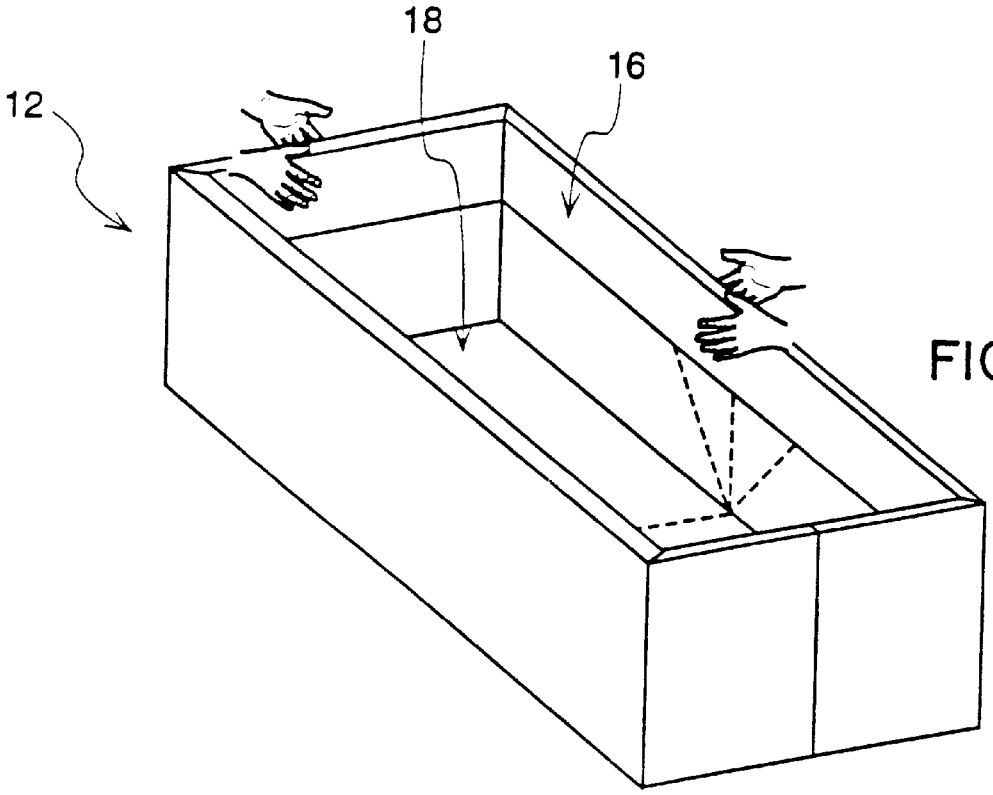

In FIG. 1, a container assembly 10 of fiberboard material in accordance with the present invention is illustrated. The container assembly 10 includes a main body 12 and a container lid 14 for being placed over an opening 16 of the container body 12 leading to the interior 18 thereof (FIG. 23). As the body 12 and lid 14 are formed of corrugated fiberboard, they will typically have a brown coloration thereto. It is preferred that the outside or exposed surfaces of the container body 12 and lid 14 be either bleached white or otherwise colored and/or covered with a decorative fabric or cloth material to present a more aesthetically acceptable appearance to the exterior of the assembly 10. In this manner, it will be difficult for an observer to determine the low-cost nature of the material from which the container 10 is formed.

Figure 16:
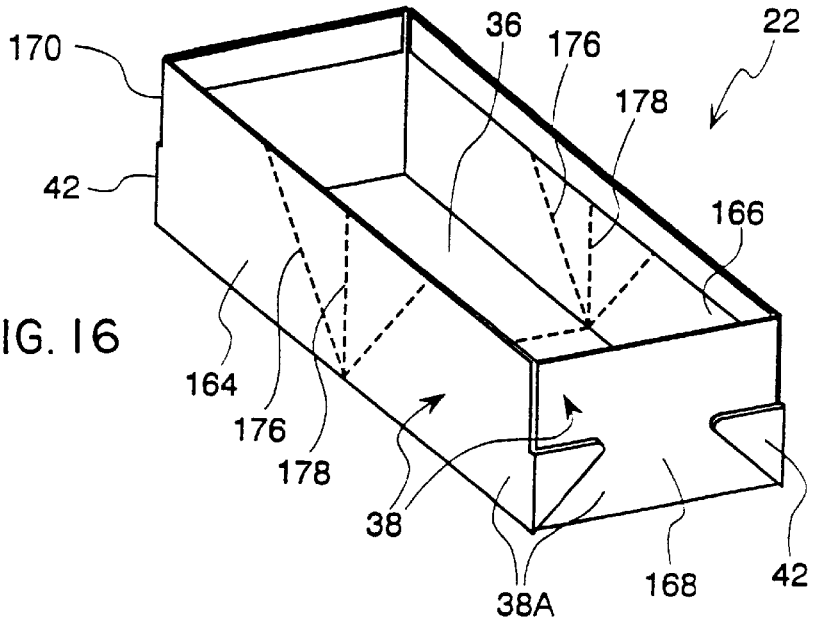

The main container body 12 is formed from an outer body portion 20 which has a predetermined orientation for assembly purposes, preferably of a rectangular box (FIG. 5), and an inner fluid containment portion which has a predetermined orientation for assembly purposes that is preferably similar to the body portion predetermined orientation of a rectangular box (FIG. 16). Both the outer body portion 20 and inner fluid containment portion 22 are formed from respective panels 24 and 26 of corrugated fiberboard material, and each having a plurality of fold lines generally designated 28 and 30 for the respective panels 24 and 36. The present container assembly 10 can be shipped in a very compact form, such as in a small transport container (FIG. 47) in the form of a small rectangular box of approximately 25.5 inches by 13.25 inches by 37 inches for fitting several of such containers into automobile trunks and then assembled into a final assembled form which is larger than the small transport container by folding of the panels 24 and 26 in a quick and easy manner, as will be more fully described hereinafter. In addition, the use of fiberboard material for the container assembly 10 makes it relatively light weight in comparison to wood or metal caskets which is desirable during transport of the container assembly 10. The fluid containment fiberboard panel 26 can be treated so as to be waterproofed against fluid leakage therefrom when assembled, as will be described herein.

The panels 24 and 26 are folded into their predetermined orientation for assembly of the main container body 12 without the need for any fasteners and/or rigid framing members to maintain its shape or to support the loads to be handled by the container assembly 10 as in many prior art fiberboard containers. One reason the main container body 12 does not need rigid wood support framing members is that the fluid containment portion 22 is formed from corrugated fiberboard material similar to the outer body portion 20 of the main container body 12 such that when the inner fluid containment portion 22 is placed in the outer body portion 20, the inner fluid containment portion 22 will act to add strength to the body portion 20 to assist in supporting the loads to which the container assembly 10 is to be subjected. Thus, even though the container assembly 10 herein is made light weight fiberboard, it is effective to support relatively heavy weights, e.g., corpses, without the need for wood framing members.

Figure 5:
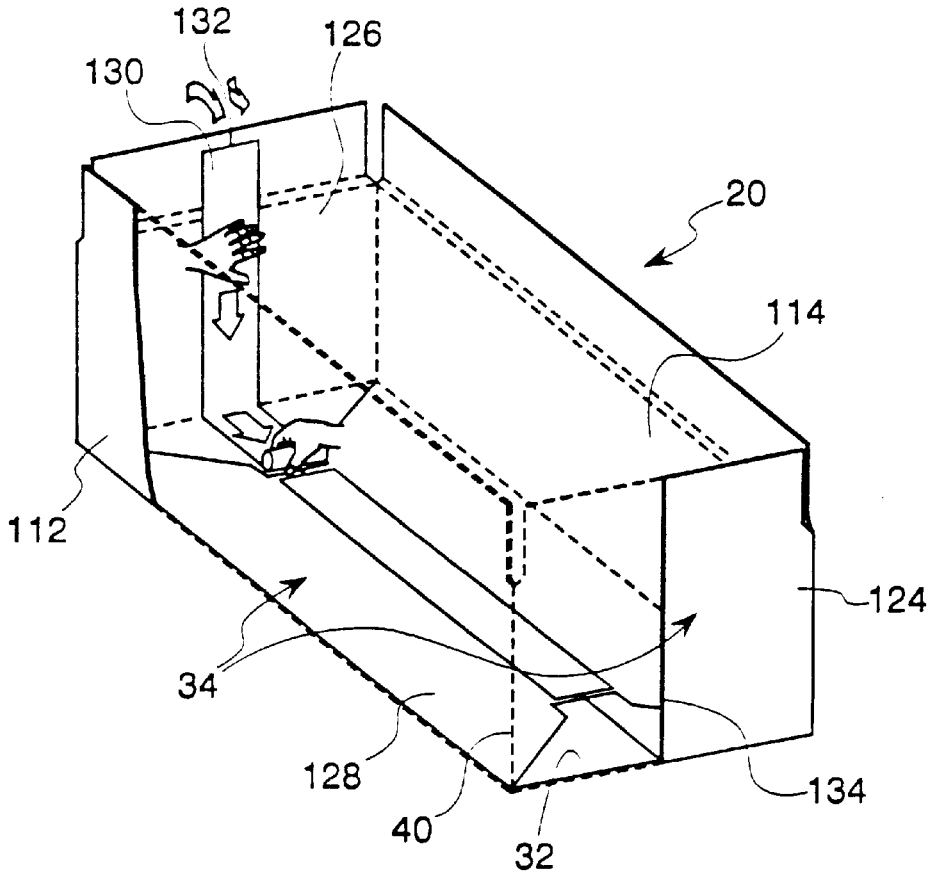

Referring to FIG. 5, the rectangular outer body portion 20 includes base 32 and walls 34 upstanding from the periphery of the base 32. Similarly, referring to FIG. 16, the inner fluid containment portion 22 includes base 36 and walls 38 upstanding from the periphery of its base 36. The body panel 24 and, accordingly, the base 32 and walls 34 of the outer body portion 20, have a predetermined thickness of preferably approximately 3/16 inch. The containment panel 26 and, accordingly, the base 36 and the walls 38 also have a predetermined thickness of preferably approximately 3/16 inch.

When the inner fluid containment portion 22 is placed in the outer body portion 20, the containment portion base 36 will be disposed over the body portion base 32 with walls 38 of the containment portion 22 being adjacent corresponding walls 34 of the body portion 20 so as to increase their thickness by at least the thickness of the body panel 24 to provide them with greater strength and rigidity for load bearing purposes. When the outer body portion 20 is folded to its assembled orientation of FIG. 5, adjacent walls 34 thereof will be in abutment with each other along corner seams 40. The fluid containment portion 22 is placed in the outer body portion 20 to minimize leakage of fluid from the main container body 12, and particularly from the corner seams 40 thereof. In this regard, the inner fluid containment portion 22 is provided with sealing gussets 42 along the bottom sections 38*a* of adjacent walls 38 thereof so as to avoid the formation of a seam thereat for fluid flow therethrough. Thus, the present fluid containment portion 22 is effective to provide both sealing and load supporting functions for the container assembly 10 herein.

It is also contemplated that the container assembly 10 utilize reinforcing fiberboard 44 having an internal honeycomb structure preferably approximately 0.50 inches thick between the outer body portion 20 and inner fluid containment portion 22 to add strength to the container assembly 10 as shown in FIGS. 6–13. The preferred construction of the main container body 12 including the outer body portion 20 and inner fluid containment portion 22 with the reinforcing fiberboard 44 therebetween will next be more specifically described with reference to FIGS. 2–23. For purposes of reference in the description, the rectangular configuration of the container assembly 10 will be used wherein the container assembly 10 has an elongate top and bottom 46 and 48 with elongate sides 50 and 52 extending longitudinally along the length of the box container assembly 10 between the top and bottom 46 and 48 with shorter transverse ends 54 and 56 completing the box container assembly 10, as shown in FIG. 1.

Figure 2:
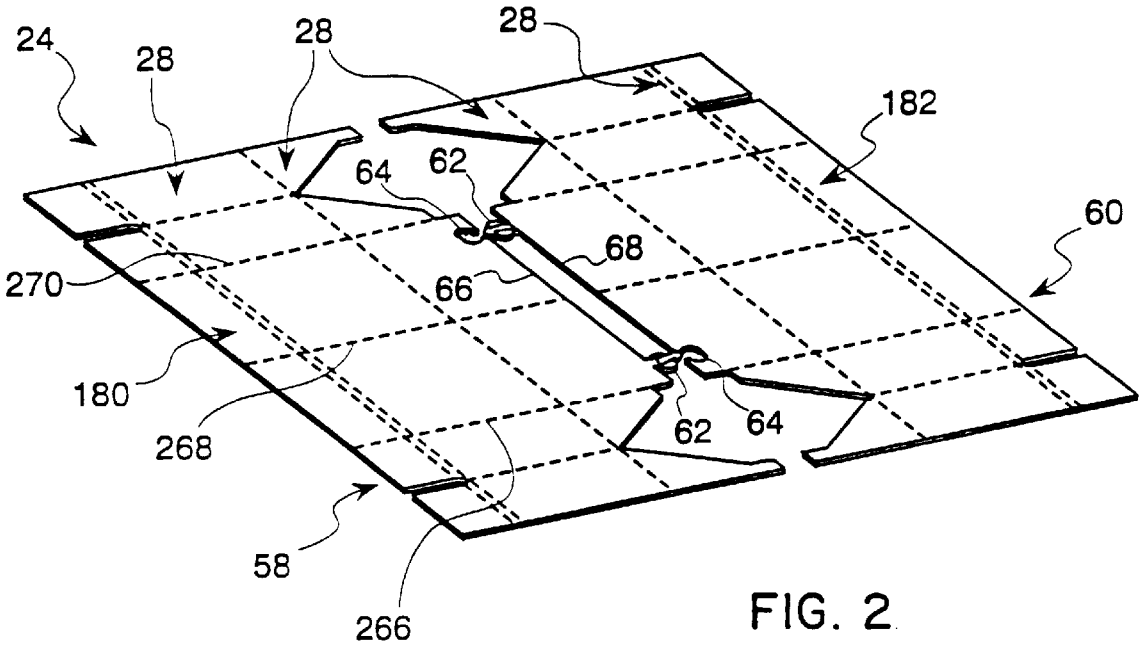
FIGS. 2–5 are perspective views of a body panel of corrugated fiberboard material being folded into assembled form for forming an outer body portion of the main container body.

Referring FIG. 2, the body panel 24 can include first and second body panel portions 58 and 60 which can be attached together to form the body panel 24. This provides for space savings as during shipping, the panel portions 58 and 60 can be stacked one on top of the other so as not to take up as much space in the widthwise or transverse direction, with the stacking only nominally adding to the thickness of the relatively thin panels. Alternatively, where the panels can not be stacked due to space constraints, it is possible to fold them into a collapsed state for fitting into a compact transport container as previously mentioned and as will be more particularly described hereinafter. Because the outer body portion 20 is larger than the inner fluid containment portion 22, the body panel 24 is necessarily somewhat larger than the corresponding fluid containment panel 26. However, when the body panel portions 58 and 60 are separated from each other, the fluid containment panel 26 will be slightly larger than the individual panel portions 58 and 60, particularly in the widthwise or transverse direction. Accordingly, the widthwise dimension which needs to be accommodated for shipping of the unfolded panel portions 58 and 60 is less than if the body panel 24 was a single fiberboard piece. Thus, the greatest width that must be accommodated during shipping is that of the unfolded containment panel 26.

Figure 3:
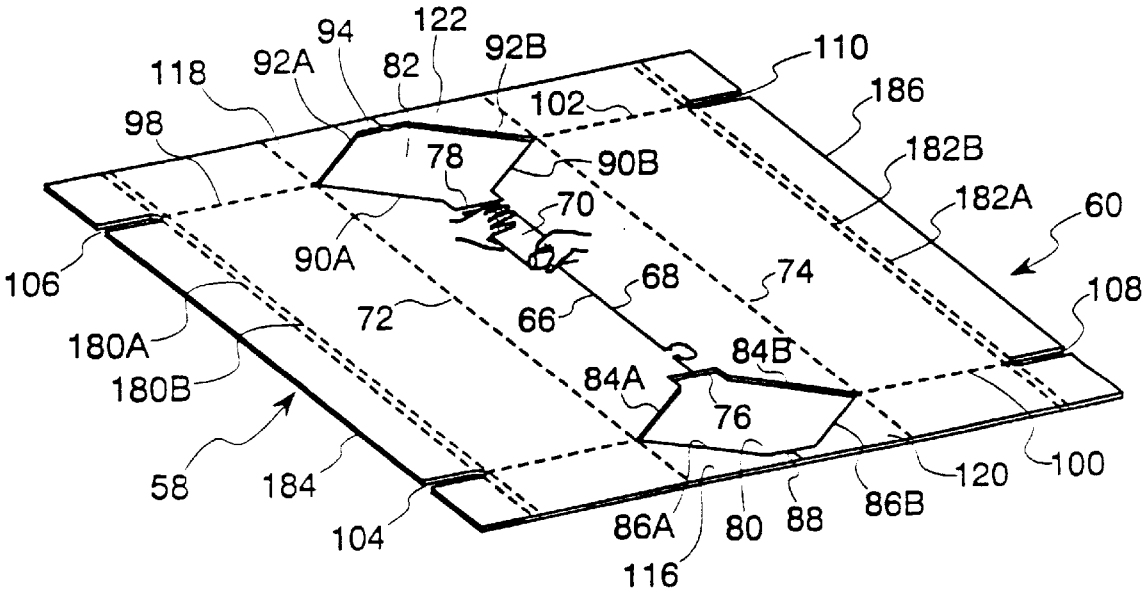

Before assembling the outer body portion 20, the body panel portions 58 and 60 are attached together as by tongue keys 62 and correspondingly shaped tongue-receiving sockets 64 provided on the inner edges 66 and 68 of the panel portions 58 and 60, respectively. As shown in the drawings, inner edge 66 can be provided with one tongue key 62 and one socket 64 with the edge 68 having a tongue key 62 and socket 64 in reversed positions relative to the edge 66. To attach the panel portions 58 and 60, the tongue keys 62 are aligned with and pressed into the opposite sockets 64 so as to bring the edges 66 and 68 flush together, as best seen in FIG. 3. Thereafter, a piece of tape 70, such as a strong fiber tape, can be run over the abutting edges 66 and 68 to secure the panel portions 58 and 60 together.

Assembly of the outer body portion 20 will next be described. Longitudinal fold lines 72 and 74 are formed on the panel portions 58 and 60, respectively. As seen best in FIG. 3, when the panel portions 58 and 60 are attached together to form the body panel 24, small rectangular openings 76 and 78 are formed facing oppositely each other at either end of the joined inner edges 66 and 68. The rectangular openings 76 and 78, in turn, open to respective hex-shaped openings 80 and 82 with opening 80 formed by inclined or bevelled edges 84*a* on panel portion 58 and bevelled edge 84*b* on panel portion 60 which extend from the rectangular opening 76 transversely and longitudinally away from each other and bevelled edges 86*a* on panel portion 58 and bevelled edge 86*b* on panel portion 60 which extend longitudinally and transversely back towards each other to a transverse edge 88 which spans the panel portions 58 and 60. The hex-shaped opening 82 is similarly formed on the opposite end of the body panel 24 by bevelled edges 90*a* of panel portion 58 and 90*b* of panel portion 60 which extend longitudinally and transversely away from each other and bevelled edges 92*a* and 92*b* which extend longitudinally and transversely back towards one another to a transverse edge 94 spanning the two panel portions 58 and 60. The fold lines 72 and 74 extend longitudinally parallel to each other and are spaced from the edges 66 and 68 of their respective panel portions 58 and 60 so as to intersect the juncture of the bevelled edges 84, 86 and 90, 92. It is preferred that the inclination of the bevelled edges 84, 86, 90 and 92 be at an angle of 45° to the fold lines 72 and 74.

In addition to the longitudinal fold lines 72 and 74, each panel portion 58 and 60 includes a pair of widthwise or transverse fold lines with panel portion 58 having transverse fold lines 96 and 98 and panel portion 60 having transverse fold lines 100 and 102. The transverse fold line 96 of panel portion 58 and fold line 100 of panel portion 60 are aligned with each other when the panel portions 58 and 60 are attached together, and the transverse fold lines 98 and 102 are aligned together when the panel portions 58 and 60 are attached together. The transverse fold lines 96 and 98 of the panel portion 58 extend at one end from flap slits 104 and 106 to their other end at the juncture of bevelled edges 84*a* and 86*a* and bevelled edges 90*a* and 92*a*, respectively. Similarly, the transverse fold lines 100 and 102 extend at one end from flap slits 108 and 110 to their other end at the juncture of bevelled edges 84*b* and 86*b* and bevelled edges 90*b* and 92*b*, respectively.

Figure 4:
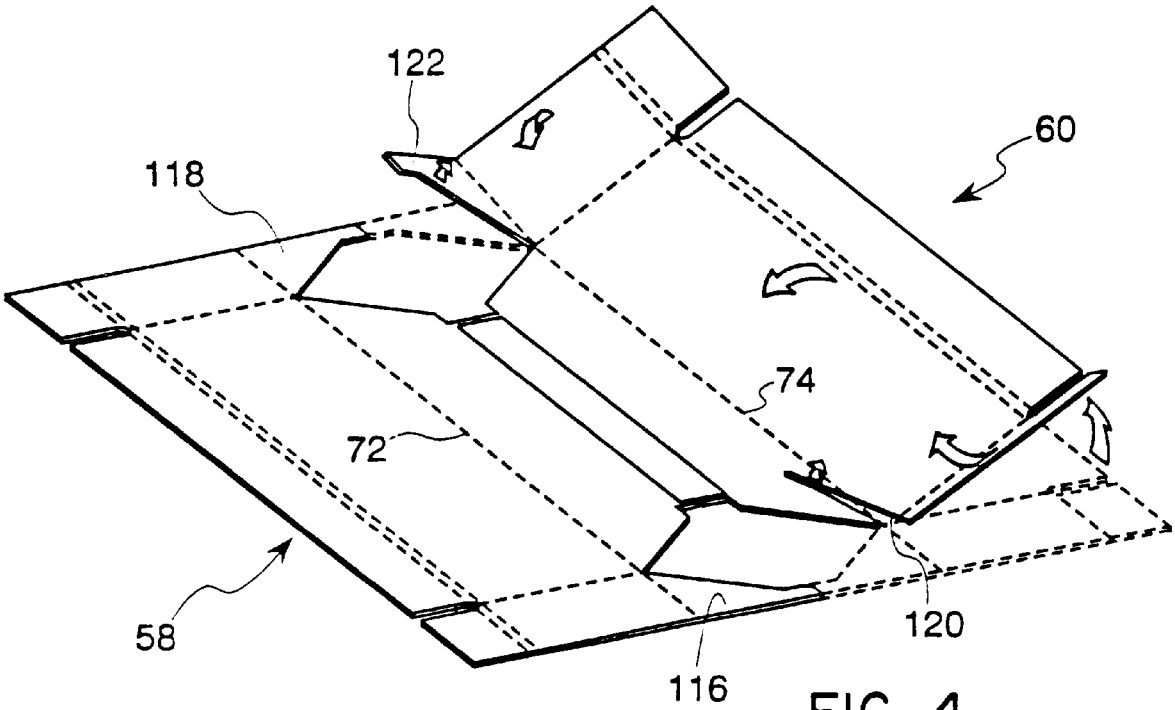

Thus, to fold the body panel 24 into the body portion 20, the panel portions 58 and 60 are folded up about their respective fold lines 72 and 74 as shown in FIG. 4 where panel portion 60 is undergoing such folding so as to form sidewalls 112 and 114 of the walls 34 of body portion 20. The folding about lines 72 and 74 occurs until the sidewalls 112 and 114 are raised to extend perpendicular to the base 32.

As the longitudinal fold lines 72 and 74 extend the entire length of the panel portions 58 and 60, the longitudinal fold line 72 along with bevelled edges 86*a* and 92*a* define respective triangular sections 116 and 118 of the panel portion 58 and longitudinal fold line 74 along with bevelled edges 86*b* and 92*b* define respective triangular sections 120 and 122 of the panel portion 60.

To form end walls 124 and 126 and to complete the bottom base wall 32 for the base portion 20, the panel portion 58 is folded about its transverse fold lines 96 and 98 so as to be at right angles to the sidewall 112 and the triangular sections 116 and 118 are folded about longitudinal fold line 72 so as to be at right angles to the end walls 124 and 126 with the triangular sections 116 and 118 fitting in corresponding portions of respective hex openings 80 and 82 and rectangular openings 76 and 80 so that the bevelled edge 86*a* abuts flush against the bevelled edge 84*a* and the bevelled edge 92*a* of the triangular portion 118 abuts flush against the bevelled 90*a*. The other base portion 60 is folded similarly to base portion 58 to complete the end walls 124 and 126 and the bottom base wall 32, as shown in FIG. 4.

Referring to FIG. 5, when the base panel 24 is folded into its predetermined rectangular box orientation with the base wall 34 and the sidewalls 112 and 114 and the end walls 124 and 126 upstanding perpendicularly therefrom, additional fabric tape 130 can be run along the joint 132 formed in the end wall 126 between the two folded up panel portions 58 and 60 and between the abutting triangular sections 118 and 122 of the respective panel portions 58 and 60. A similar piece of tape (not shown) can be run along the joint 134 in end wall 124 and abutting triangular sections 116 and 120 of the base wall 32. The use of tape 130 keeps the body portion walls 34 in their upstanding condition without the need for wood framing members as in prior fiberboard containers.

Figure 6:
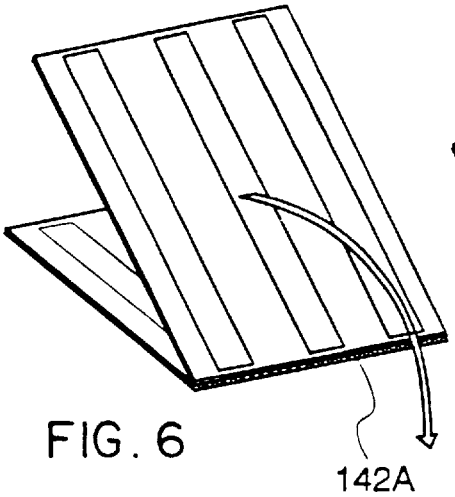
FIGS. 6–13 are perspective views of reinforcing fiberboards being assembled and attached in the interior of the assembled outer body portion.
Figure 7:
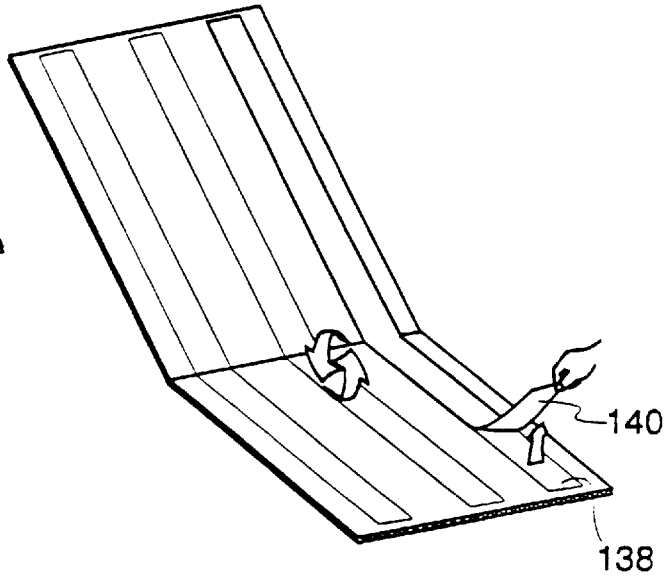
Figure 8:
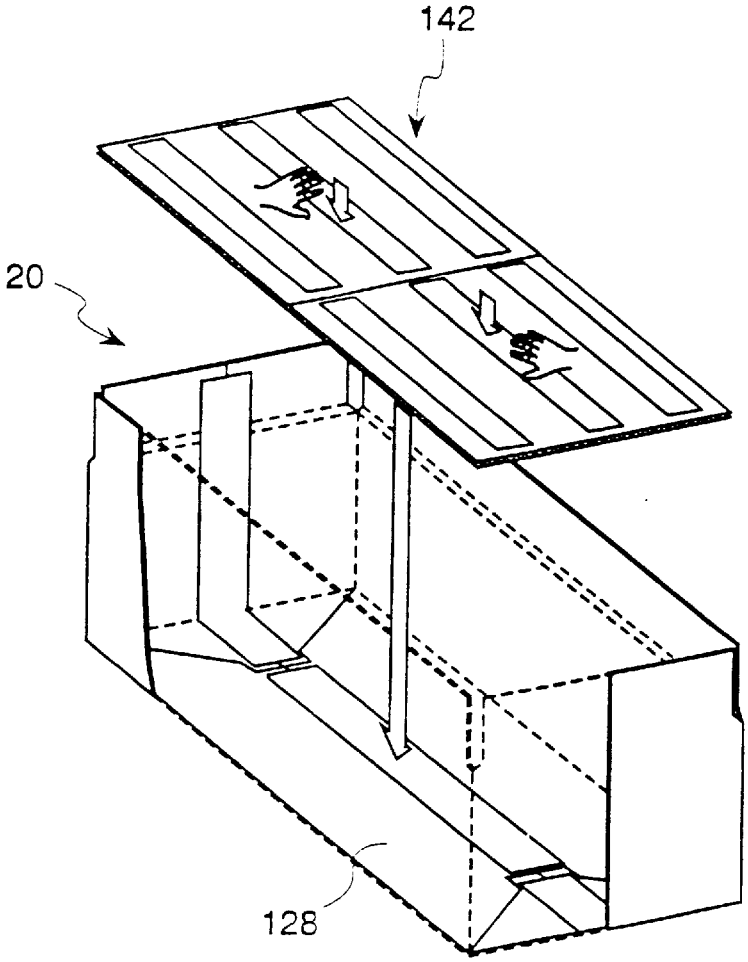

As previously mentioned, to enhance the strength and rigidity of the container assembly 10, it is preferred to utilize reinforcing fiberboard panels 44 therein. The fiberboard panels 44 can have pressure sensitive adhesive 138 on both sides thereof such as in strips under adhesive cover strips 140. FIGS. 6–8 illustrate the installation of reinforcing base fiberboard 142 onto the top of bottom base wall 32 of body portion 20. The reinforcement base fiberboard 142 can have an intermediate transverse joint 142*a* to allow the base board 142 to be folded in half so it can be folded smaller for shipping purposes. When the board 142 is open and unfolded, its length is substantially that of the base wall 32 between end walls 124 and 126 with its width also corresponding to that of the base wall 32 between sidewalls 112 and 114. After opening of the board 142 as shown in FIG. 6, the cover strips 140 can be peeled from one side thereof to expose the pressure sensitive adhesive 138 thereunder. The board 142 can then be flipped over and placed into the body portion 20 with the exposed adhesive 138 engaging the top of the bottom base wall 32. The board 142 can then be pressed so as to provide good adherence between the board 142 and base wall 128 with the pressure sensitive adhesive 138.

Figure 9:
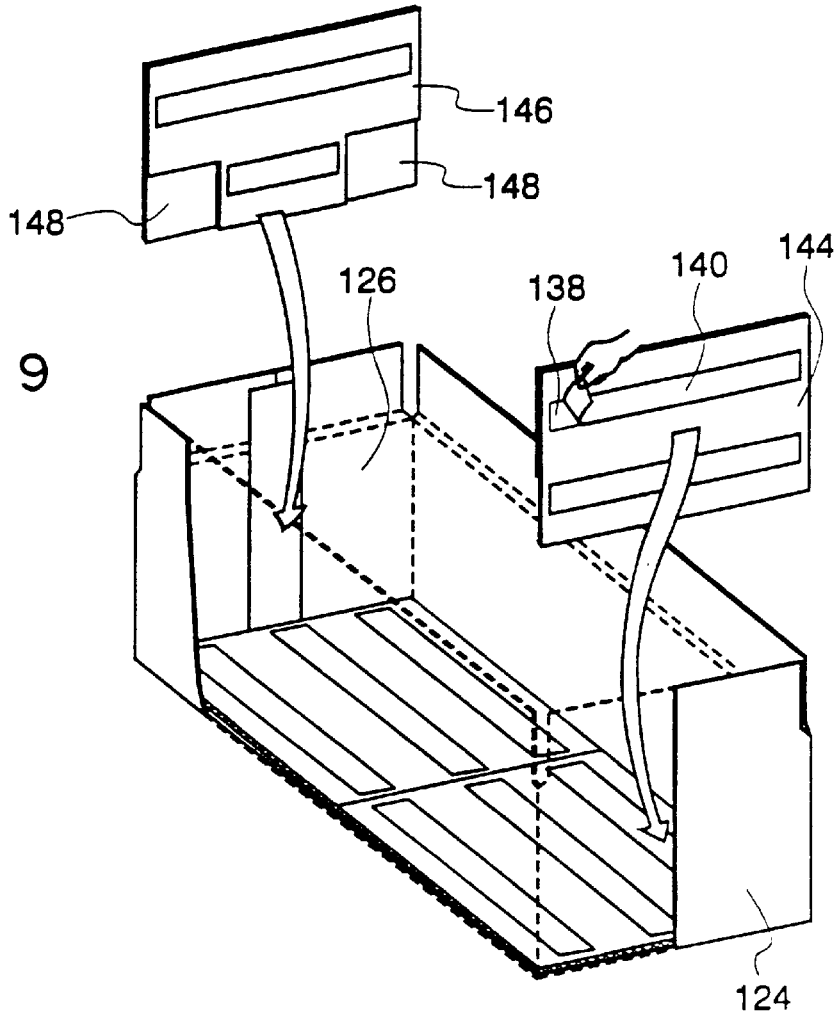
Figure 10:
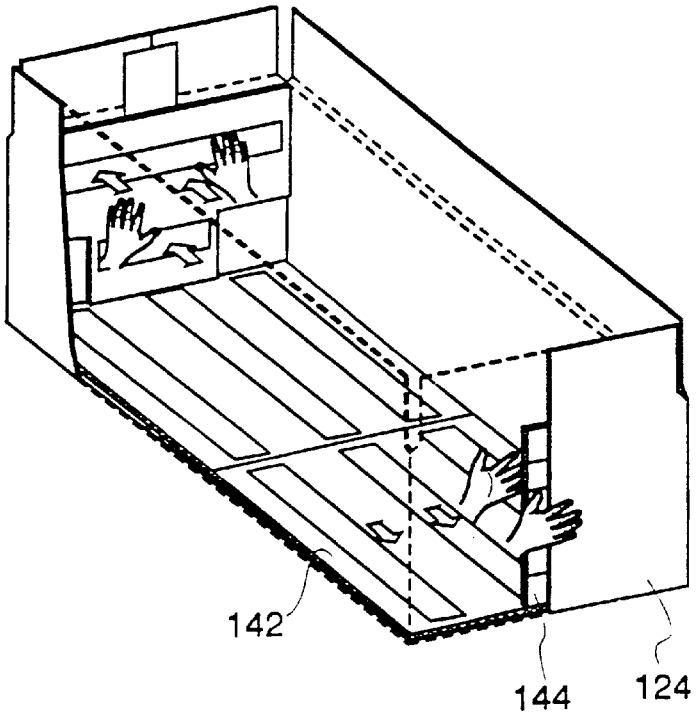

Reinforcing end boards 144 and 146 are also provided for being inserted into the body portion 20 and adhered to the inside of respective end walls 124 and 126 thereof. The end boards 144 and 146 have substantially the same transverse dimension as the body portion end walls 124 and 126 between sidewalls 112 and 114, but are shorter in height for reasons to be described hereinafter. On one side, the bottom corner sections of the end fiberboards 144 and 146 have their honeycomb structure compressed so as to provide bottom corner wells 148, as best seen in FIG. 9. To attach the boards 144 and 146 in the body portion 20, the cover strips 140 on the side of the boards 144 and 146 opposite the side in which the wells 148 are formed are peeled to expose the adhesive 138 on that side and the boards 144 and 146 are inserted into the body portion 20 so as to abut the top of the board 142 at their bottom; however, because of the height differential, the end walls 124 and 126 will have a portion which extends beyond the top of respective boards 144 and 146. With the boards 144 and 146 so attached in the body portion 20, when the fluid containment portion 22 is inserted into the body portion 20 as will be more fully described hereinafter, the sealing gussets 42 of the fluid containment portion 26 can be disposed in the wells 148.

Figure 12:
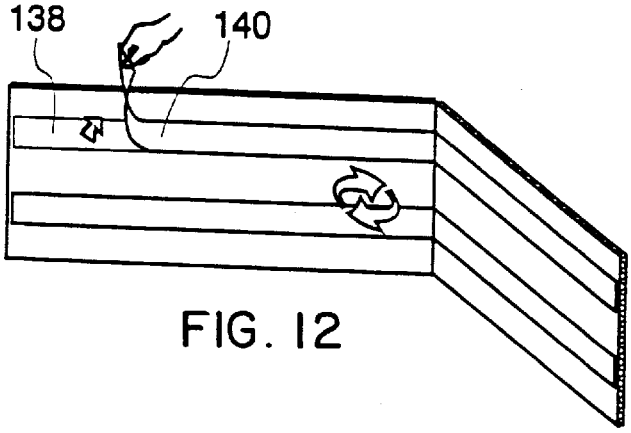
Figure 11:
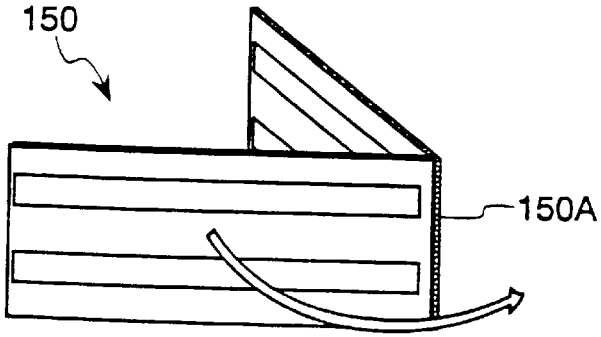
Figure 13:
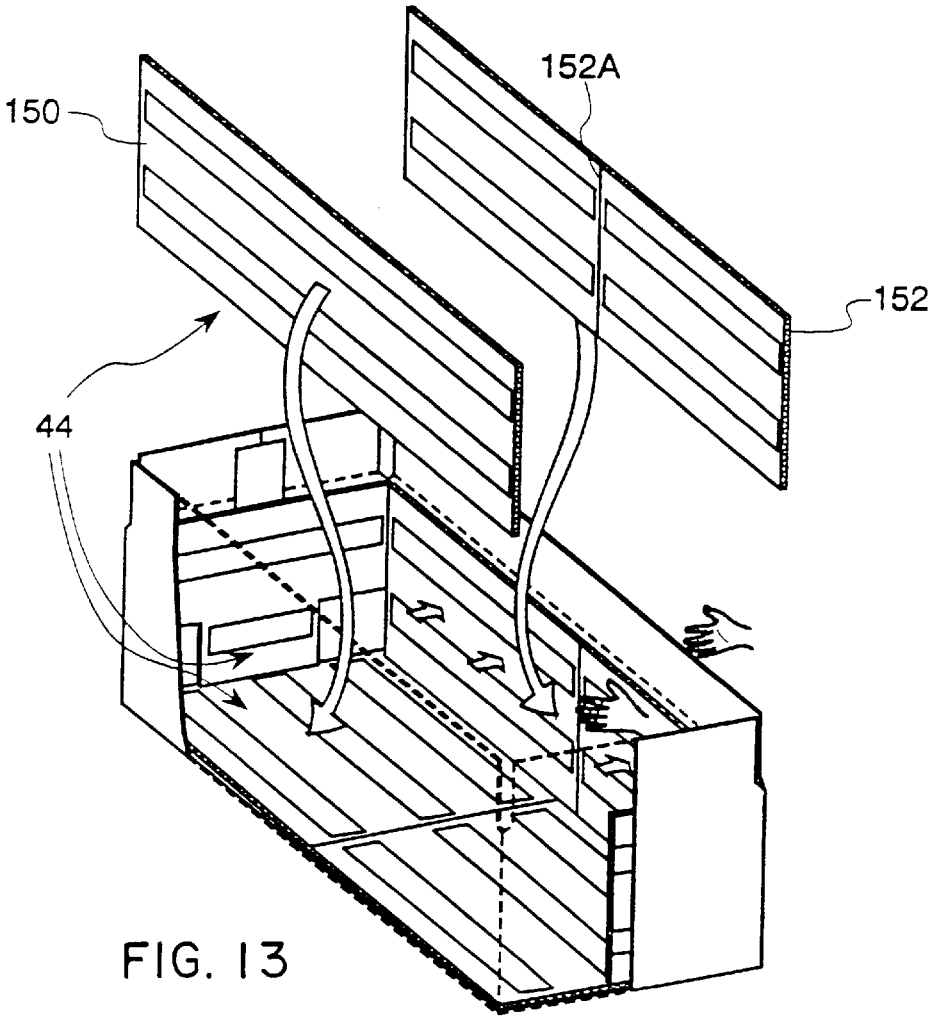

FIGS. 11–13 illustrate the installation of reinforcing side fiberboards 150 and 152 into the container body portion 20. The reinforcing side fiberboards 150 and 152 have a length slightly shorter than corresponding body portion sidewalls 112 and 114 to which they are to be attached due to the thickness of attached end boards 144 and 146, and similar to reinforcing end fiberboards 144 and 146, they have a height which is shorter than the corresponding sidewalls 112 and 114 for reasons to be discussed hereinafter. Similar to the reinforcing base fiberboard 142, the side fiberboards 150 and 152 can be provided with transverse joints 150*a* and 152*a*, respectively, so that they can be folded during their transport and unfolded for installation into body portion 20. The side fiberboards 150 and 152 are installed into the body portion 20 in a similar fashion as to the other fiberboards by the peeling of cover strip 140 from one side of the boards 150 and 152 to expose the adhesive 138 thereon so that side can be pressed against the interior of the corresponding sidewalls 112 and 114 of the body portion 20 with the bottom of the boards 150 and 152 in engagement with the top of the base board 142 and the sidewalls 112 and 114 extending beyond the top of the boards 150 and 152 due to the height differential therebetween.

Figure 14:
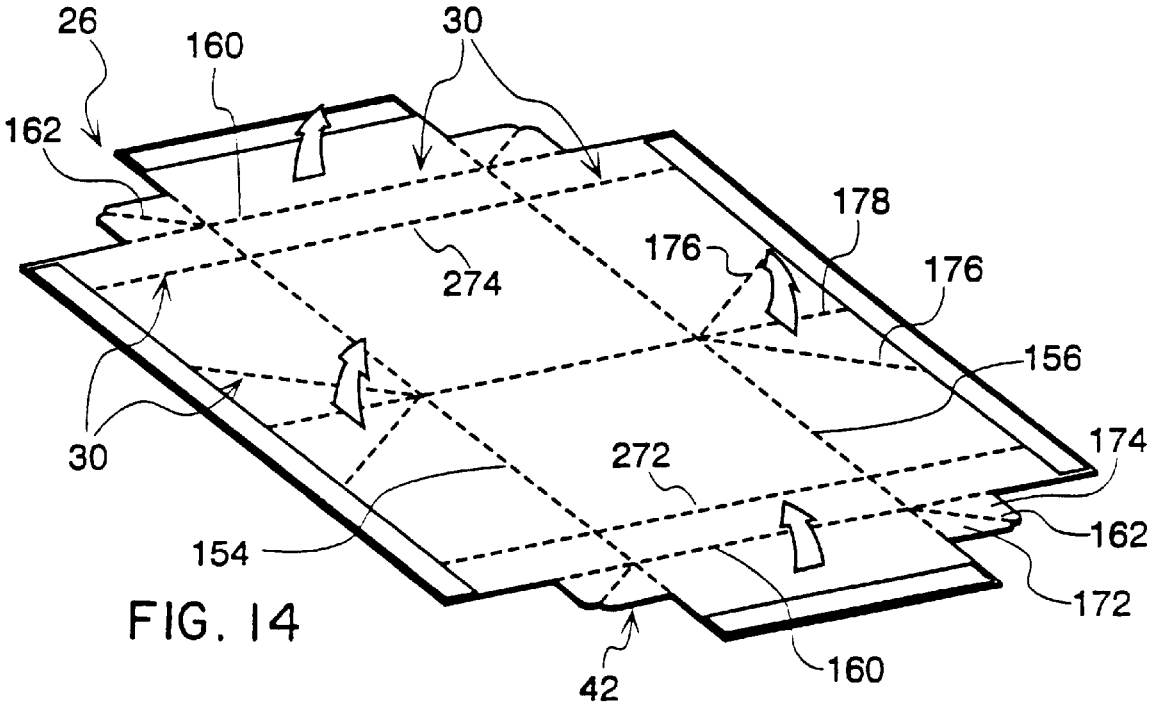
FIGS. 14–23 are perspective views of a fluid containment panel being folded into assembled form for forming an inner fluid containment portion of the main container body and showing the placement and attachment of the assembled fluid containment portion in the container interior.
Figure 15:
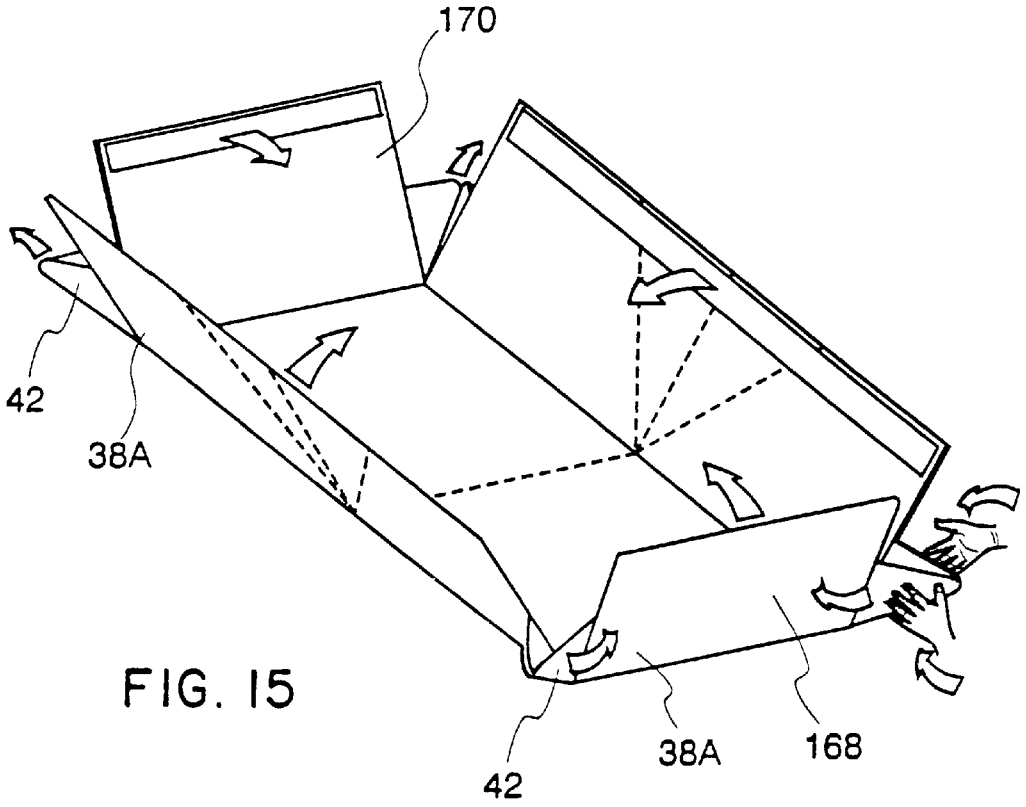

Turning now to the assembly of the inner fluid containment portion 22, reference will be made to FIGS. 14–16. As seen in FIG. 14, the fluid containment panel 26 is shown in a generally flat configuration and is provided with a plurality of fold lines 30 to assemble it in its operative rectangular box orientation, as shown in FIG. 16. The fold lines 30 include a pair of spaced, parallel longitudinal fold lines 154 and 156, and spaced, parallel transverse fold lines 158 and 160. The spaced longitudinal fold lines 154 and 156 intersect the transverse fold lines 158 and 160 and define inner joints of the gussets 42 with the fluid containment portion walls 164–170. Gusset diagonal fold lines 162 extend from the point at which the longitudinal fold lines 154, 156 and the transverse fold lines 158, 160 intersect each other to the opposite corner of the gusset 42.

To assemble the fluid containment portion 22, the panel 26 is folded about the fold lines 154 and 156 to form sidewalls 164 and 166 of the fluid containment portion 22 and about the transverse fold lines 158 and 160 to form end walls 168 and 170 of the fluid containment portion 22. Similar to the body portion 20, the sidewalls 164 and 166 and end walls 168 and 170 are folded so as to extend perpendicular from the fluid containment base 36. As the walls 164–170 are folded up to their perpendicular orientation, the gussets 42 will also be folded to extend out about the intersecting fold lines 154, 156 and 160, 162, and creased along their fold lines 162 so as to bring the two gusset halves 170 and 172 on either side of the fold line 162 together. With the gusset halves 172 and 174 collapsed together, they can be folded towards their respective end walls 168 and 170 so as to protrude slightly beyond the surface of the end walls, as shown in FIG. 16. Thus, by the provision of gussets 42 along the bottom sections 38*a* of the fluid containment portion walls 38 which include the juncture of the bottom sections of the sidewalls 164 and 166 with the end walls 168 and 170, there is no seam or flow path for fluids formed therebetween. In this manner, when the fluid containment portion 22 is inserted into the reinforced body portion 20, the fluid containment portion 22 will act to minimize any fluid leakage from the main container body 12.

The base 36 and walls 38 of the fluid containment portion 22 have similar dimensions to the corresponding reinforcing fiberboard panels 44 so that the body portion walls 34 extend beyond the height of the fluid containment portion walls 38 when the fluid containment portion 22 is installed in the reinforced body portion 20, as described below. As the fluid containment portion 22 has dimensions such that it is to be tightly fit into the reinforced body portion 20, the fluid containment panel 26 is provided with diagonal and transverse bending lines 176 and 178, respectively, with the transverse bend line 178 extending across the entire panel 26. The bending lines 176 and 178 allow the fluid containment portion 22 to be bent for installation into the reinforced body portion 20. In this manner, when the fluid containment portion 22 is assembled, as shown in FIG. 16, a pair of diagonal bend lines 176 and a section of the transverse bend line 178 will be provided in each sidewall 164 and 166 to circumscribe triangular portions thereof.

Figure 17:
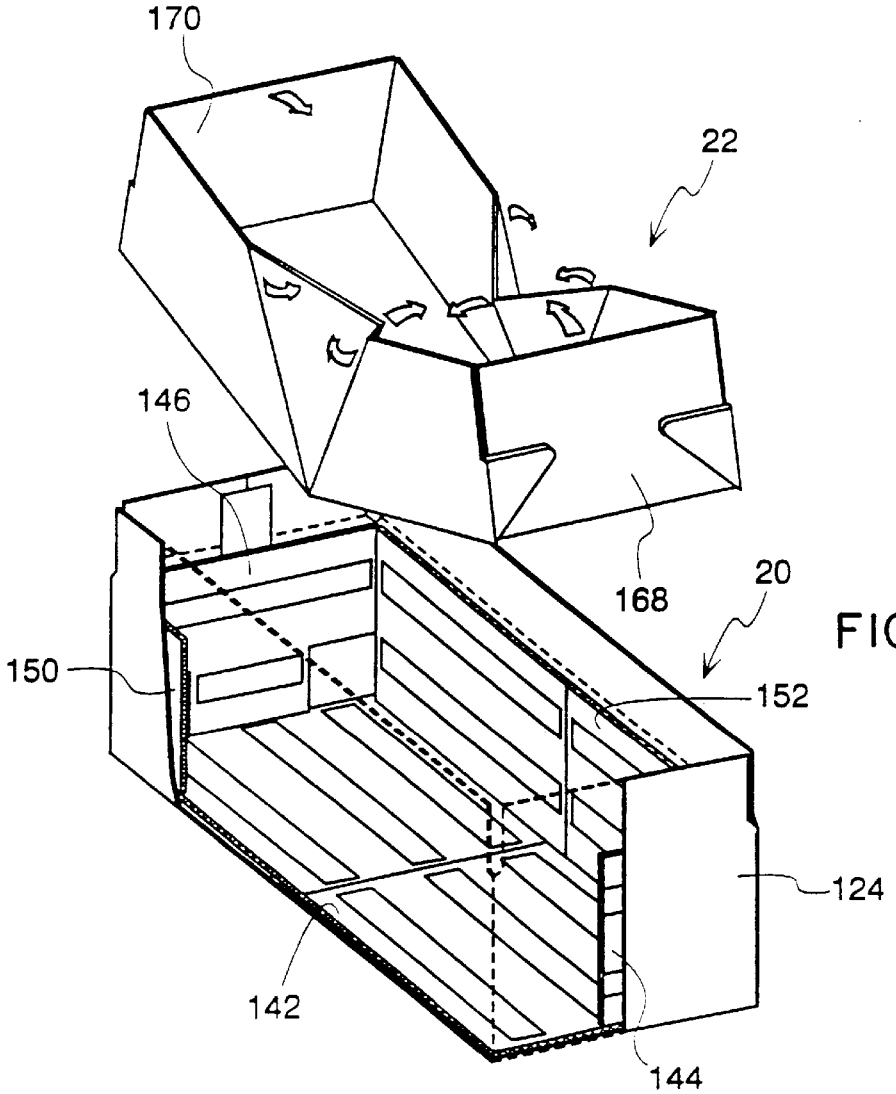

To insert the fluid containment portion 22 into the reinforced body portion 20, the end walls 168 and 170 can be pushed towards each other with the bend lines 176 and 178 in the sidewalls 164 and 166 allowing these walls to bend or collapse at the circumscribed triangular sidewall portions about the bend lines 176 and 178 in an accordion-style fashion so as to bring the end walls 168 and 170 closer to each other with the upper ends of the transverse bend lines 178 of each sidewall 164 and 166 moving towards one another, as shown in FIG. 17. Bending the fluid containment portion 22 shortens its length so that it can more readily fit between the reinforced end walls 124 and 126 having the end boards 144 and 146 attached thereto.

Figure 18:
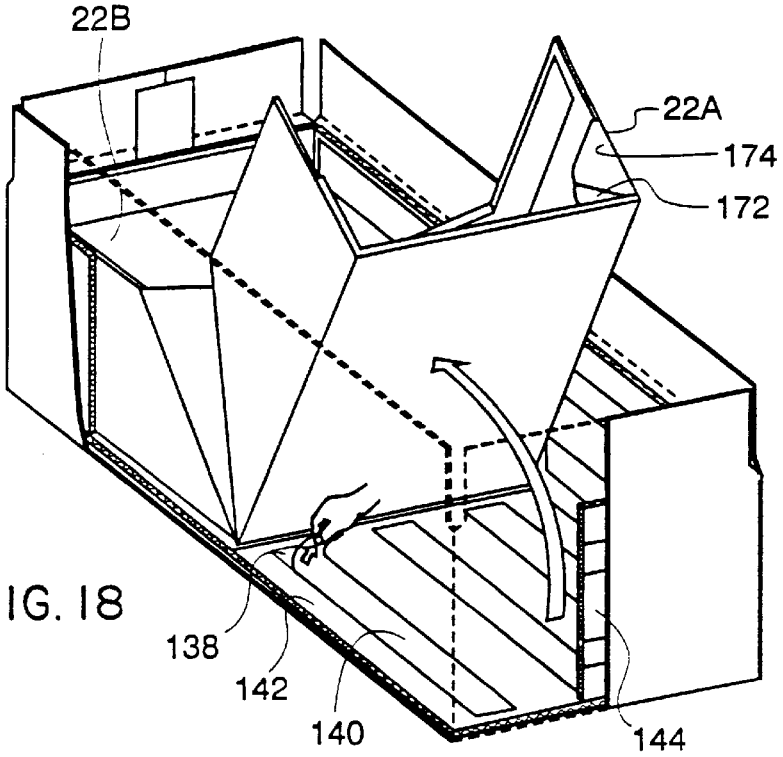
Figure 19:
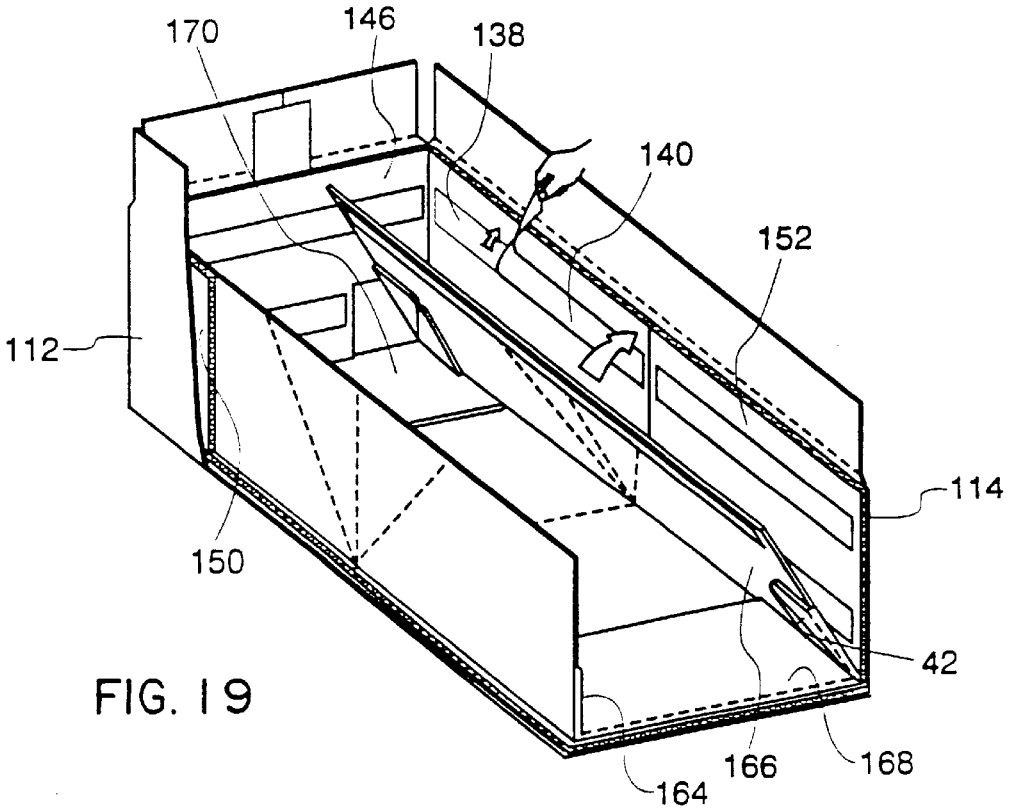

In addition to facilitating insertion, the bending of the fluid containment portion 22 facilities attachment to the top of the reinforcing base fiberboard 142. Referring to FIG. 18, once the fluid containment portion 22 is placed inside the body portion 20, one portion or half 22*a* of the fluid containment portion 22 is bent up off the reinforcement base fiberboard 142 so as to allow the cover strips 140 to be peeled to expose the adhesive 138 thereon. In addition, with the fluid containment portion 22*a* pivoted up, it is preferred that the corresponding fluid containment end wall 168 be pivoted or folded back down onto the top of the base 36 about fold line 160 with such pivoting down of end wall 168 causing the corresponding folded gusset portions 172 and 174 to unfold and move against the adjacent sidewall 164 or 166. With the adhesive 138 exposed, the fluid containment portion 22*a* can be pivoted back down onto the exposed adhesive 138 and pressed thereon so as to secure the fluid containment portion half 22*a* against the base fiberboard 142. With the fluid containment portion 22 so secured, the same process can be repeated with the fluid containment portion 22*b* pivoting it up off of the base fiberboard 142 by bending about bend lines 176 and 178, peeling cover strips 140 to expose adhesive 138 and pressing it pack down onto the exposed adhesive 138 to attach the fluid containment base wall 36 to the reinforcement base fiberboard 142. In addition, the fluid containment portion end wall 170 can be pivoted down as described with respect to end wall 168.

After the fluid containment portion bottom wall 36 is secured and adhered to the base fiberboard 142, the fluid containment portion sidewalls 164 and 166 can be attached to the inside surfaces of respective reinforcement side boards 150 and 152. To do this, the fluid containment sidewalls 164 and 166 are folded over their respective longitudinal fold lines 154 and 156 and down onto the fluid containment portion base 36 and the containment portion end walls 168 and 170 folded thereon. Adhesive 138 and cover strips 140 on the inside surface of the reinforcing side fiberboards 150 and 152 are provided. After the cover strips 140 have been peeled off to expose the adhesive on the fiberboards 150 and 152, the corresponding fluid containment portion sidewall 164 and 166 can be pivoted back up against the corresponding side fiberboards 150 and 152 and pressed thereagainst so as to secure and adhere the fluid containment portion sidewalls 164 and 166 against their corresponding reinforcement side fiberboards 150 and 152, respectively.

Figure 20:
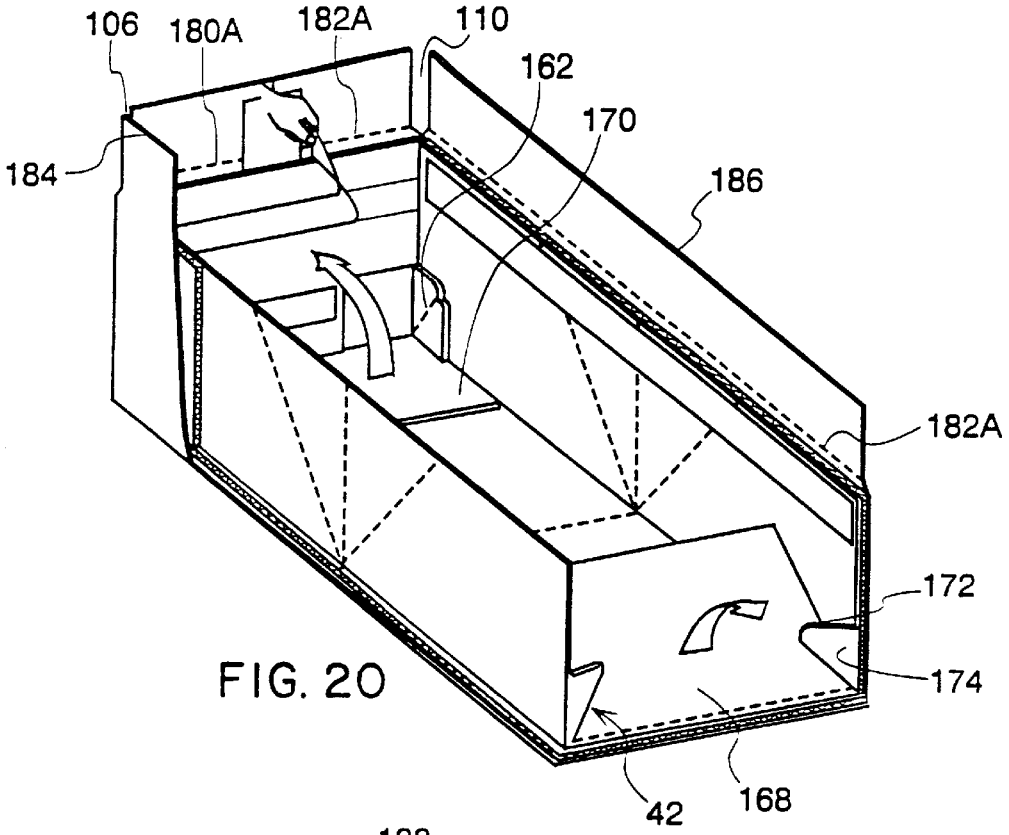

With the fluid containment portion sidewalls 164 and 166 so attached, the fluid containment portion end walls 168 and 170 can next be pivoted up to be attached to corresponding reinforcement end fiberboards 144 and 146. Referring to FIG. 20, the cover strip 140 can be peeled from the inside surface of the end boards 144 and 146. The end walls 168 and 170 can then be pivoted up to be brought against the exposed adhesive 138 on the end boards 144 and 146 with such pivoting causing the opened gusset halves 172 and 174 to be folded about their diagonal fold lines 162. Once the end walls 168 and 170 are pivoted up into engagement with the adhesive 138 on the end boards 144 and 146, they can be pressed thereagainst to obtain good adhesive sticking therebetween.

Figure 21:
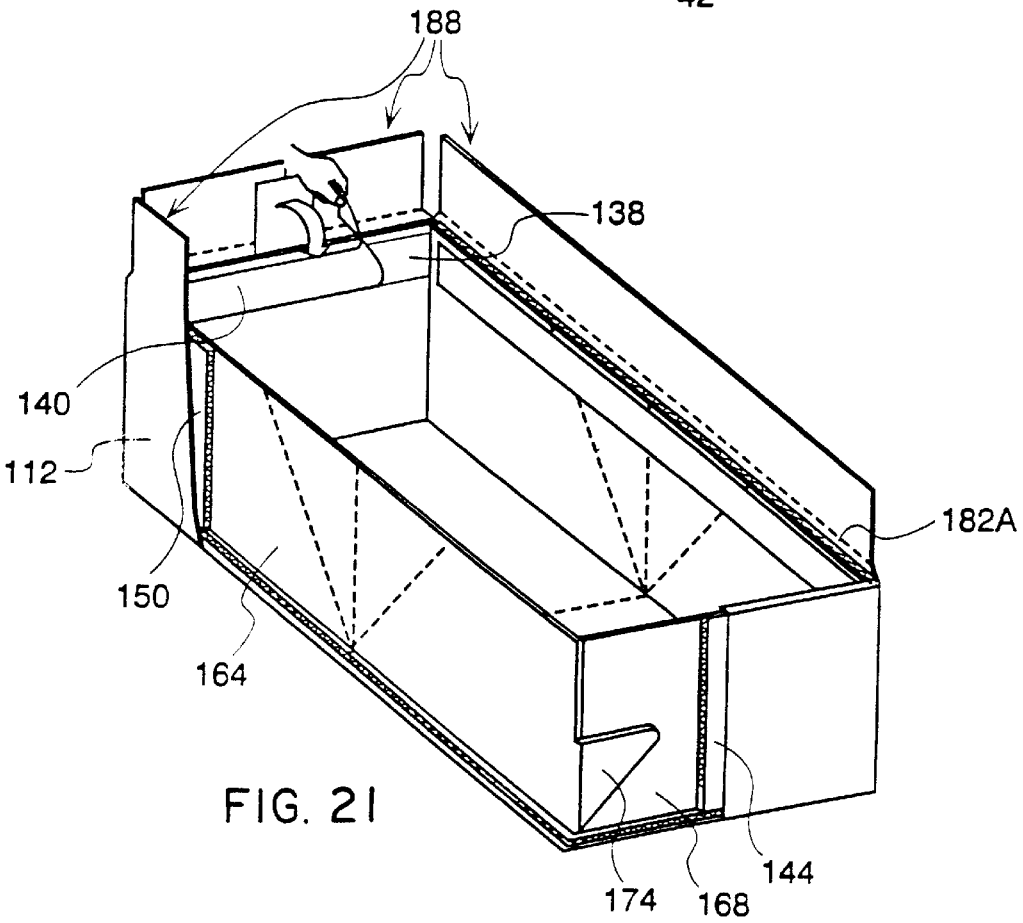
Figure 22:
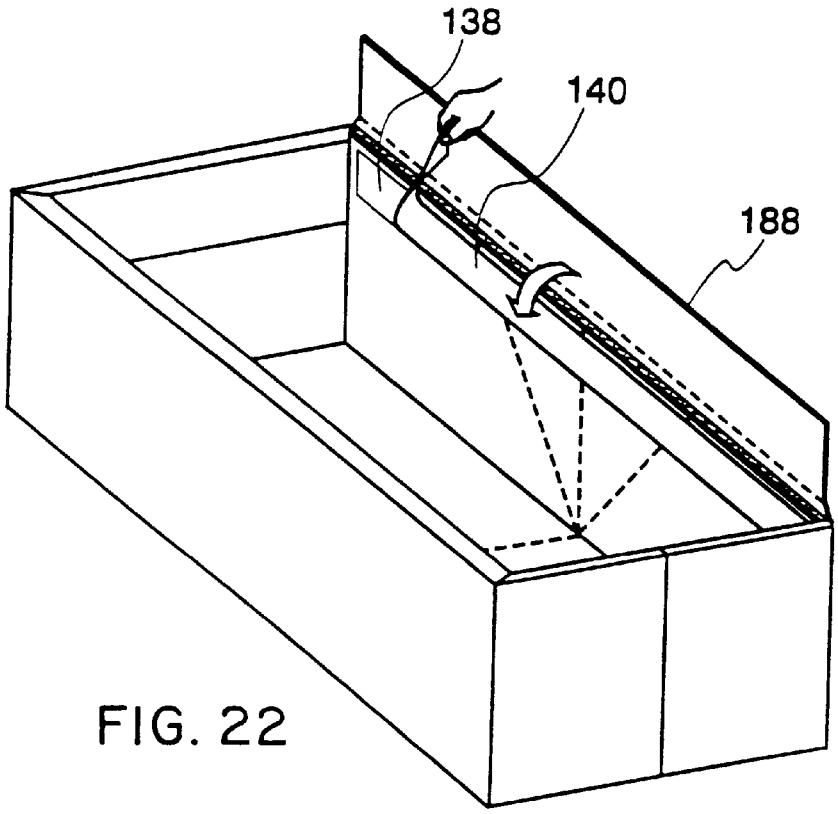

With the end walls 168 and 170 adhered to the corresponding end boards 144 and 146, the gusset halves 172 and 174 will be folded together and against their corresponding end walls 168 and 170, as previously described and shown in FIG. 21. The inwardly facing wells 148 in the end boards 144 and 146 accommodate the folded together gusset halves 172 and 174 so as to permit the end walls 168 and 170 to be pressed flush against the inside surface of the end boards 144 and 146.

As previously indicated, the reinforcement fiberboards 44 and the fluid containment portion walls 38 are of approximately the same height which is less than the height of the body portion walls 34 before final assembly into the main container body 12. In this regard, the body panel 24 has longitudinal fold lines 180 on panel portion 58 and longitudinal fold lines 182 on panel portion 60, shown in FIGS. 2 and 3. The flap fold lines 180 of base panel portion 58 include a pair of closely adjacent parallel longitudinal flap fold lines 180*a* and 180*b* with longitudinal flap fold line 180*a* spaced from the outer edge 184 of the flap portion 58 so that the flap slits 104 and 106 generally bottom out along the fold line 180*a*. Similarly, flap fold line 182 of base panel portion 60 includes a pair of closely adjacent parallel longitudinal flap fold lines 182*a* and 182*b* with flap fold line 182*a* spaced from base portion outer edge 186 so that the flap slits 108 and 110 generally bottom out along the fold line 182*a*. The height of the reinforcement end and side fiberboards 144 and 146 and 150 and 152 and the height of the fluid containment side and end walls 164 and 166 and 168 and 170 substantially correspond to the distance between the fold lines 72 and 180*b* and the fold lines 74 and 182*b* of the body panel 24 so that with the fiberboard panels 44 and the fluid containment portion 22 adhered in the body portion 20, there will be upper flap sections 188 of the body portion walls 34 which extend beyond the height of the end and side fiberboard panels 144 and 146 and 150 and 152 and the corresponding fluid containment side and end walls 164 and 166 and 168 and 170.

At the top of the inside surfaces of the fluid containment sidewalls 164 and 166 and end walls 168 and 170, there is provided pressure-sensitive adhesive 138 covered by cover strip 140 similar to that provided on the reinforcing fiberboards 44. To complete the main container body 12, the cover strips 140 are peeled from the adhesive 138 and the upper flap sections 188 are folded first down about fold lines 180*b* and 182*b* to extend perpendicular to their respective body portion walls 34. The distance between flap fold lines 180*a* and 180*b*, and 182*a* and 182*b* substantially correspond to the combined thickness of the fiberboard 44 and adjacent attached containment portion walls 38 to allow the flap sections 188 to be folded down about fold lines 180*a* and 182*a* into the container interior 18 against the exposed adhesive 138 at the top of the inside surfaces of the containment portion walls 38. The flap slots 104–110 provide the requisite clearance for folding of the flaps 188 down against the exposed adhesive 138 on the containment portion walls 38. In this manner, the containment portion walls 38 and the adjacent reinforcing boards 44 are positively captured between the folded down flap sections 188 and the remainder of the upstanding body portion walls 34 to form the main container body 12 as a structurally sound, sturdy, self-supporting piece which does not require any additional framing members to lend it rigidity or strength, as best seen in FIG. 23.

Thus, the container assembly 10 herein includes a main container body 12 formed from a combination of an outer body portion 20 and an inner fluid containment portion 22 which sandwich reinforcing fiberboard panels 44 therebetween to form a very high strength and rigid container body 12 having triple layered sidewalls 50 and 52, end walls 54 and 56 and a base wall 48. The main container body 12, in addition to using the reinforcing fiberboard panel 44, utilizes the fluid containment portion 22 to further strengthen the body 12 for supporting loads to be taken thereby. In addition, because of its entirely fiberboard construction, the present container assembly 10 is relatively inexpensive to manufacture and ship due to its lightweight. In this regard, the container assembly 10 should include a corrugated fiberboard lid 14 to form the top 46 of the container assembly 10 for closing off the opening 16 to the interior space 18 of the container body 12.

As shown in FIG. 1, when placed on the container body 12, the container lid 14 does not extend beyond the container walls 50–56 so as to present an entirely enclosed rectangular box shape for the container assembly 10. The container lid 14 is preferably formed from first and second rectangular lid portions 192 and 194 with the rectangular lid portion 194 having dimensions slightly smaller than the rectangular lid portion 192 and being centrally attached thereto so as to form a shoulder or lip 196 around the smaller lid portion 194. The smaller or inner rectangular lid portion 194 is sized so as to fit through the opening 16 and in the interior space 18 when the lid 14 is placed on the main container body 12 with the shoulder 196 resting on the top of the container walls 50–56.

Figure 24:
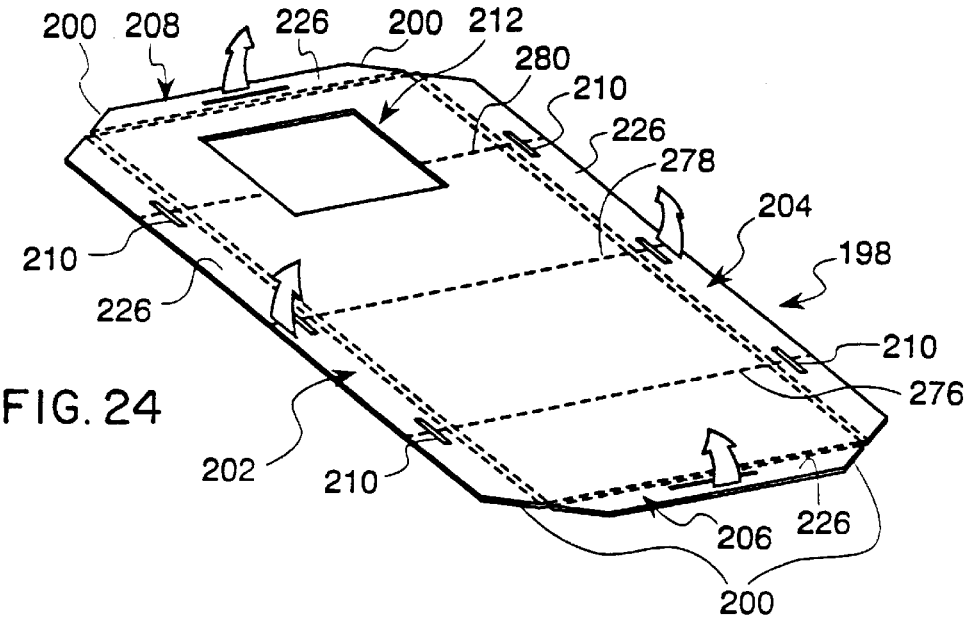
FIGS. 24–31 are perspective views of an outer lid panel being folded into assembled form for forming an outer lid portion including window-forming parts and reinforcing boards.
Figure 25:
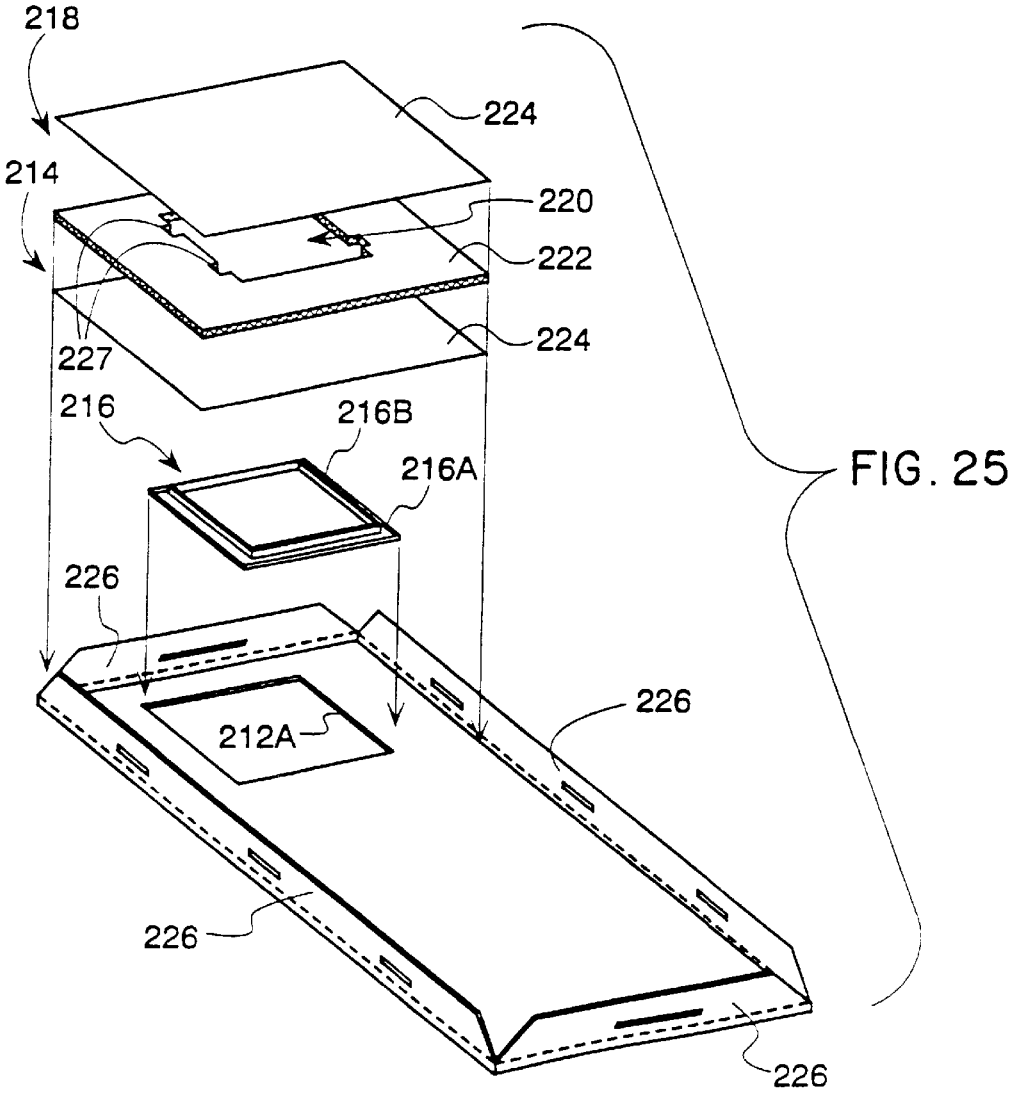
Figure 26:
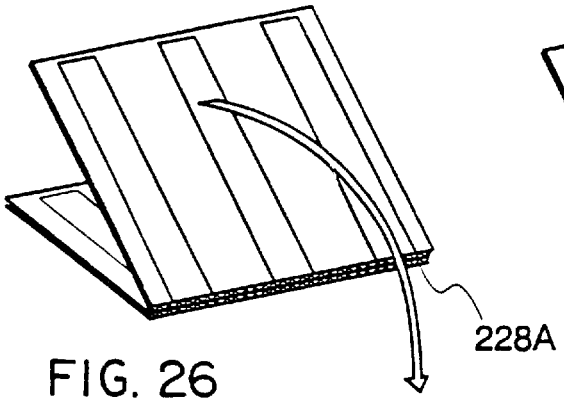

Turning first to the construction of the larger outer rectangular lid portion 192, reference will be had to FIGS. 24–31. FIG. 24 illustrates a flat, unfolded outer lid panel 198 having bevelled corners 200. A pair of adjacent, closely spaced longitudinal fold lines 202 extend lengthwise of the panel 198 terminating at intermediate points along longitudinally opposite bevelled corners 200. Similarly, on the opposite side of the panel 198, a pair of adjacent closely spaced longitudinal fold lines 204 extend the length of the panel 198 between midpoints of longitudinally opposite bevelled corners 200. A pair of adjacent closely spaced transverse fold lines 206 extend between intermediate points of transversely opposite bevelled corners 200, and a pair of adjacent closely spaced transverse fold lines 208 extend between intermediate points of bevelled corners 200 at the opposite end of the panel 198. Slots 210 are formed around the periphery of the panel 198 between the fold lines 202–208 and the corresponding exterior edges of the panel 198. A substantially square window opening 212 is formed on one end of the panel 198 spaced inwardly from the transverse fold lines 208.

Window parts generally designated 214 for the outer lid panel 198 include a substantially square plastic window frame 214 and a substantially square fiberboard window member 218 having a centered substantially square opening 220 formed therein. The window member 218 is coated with pressure sensitive adhesive 222 on both sides thereof with square covering sheets 224 covering the adhesive 222 on either side of the window member 218.

Figure 27:
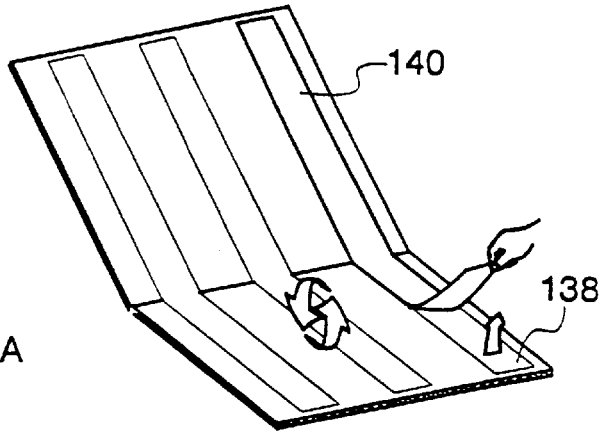
Figure 28:
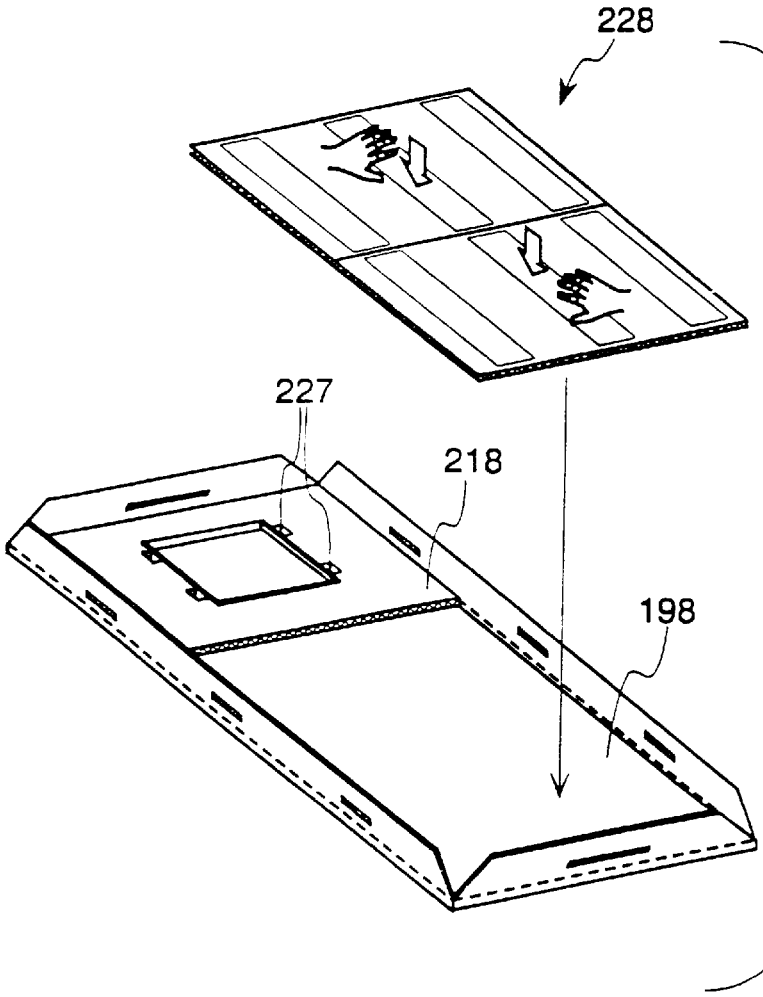
Figure 30:
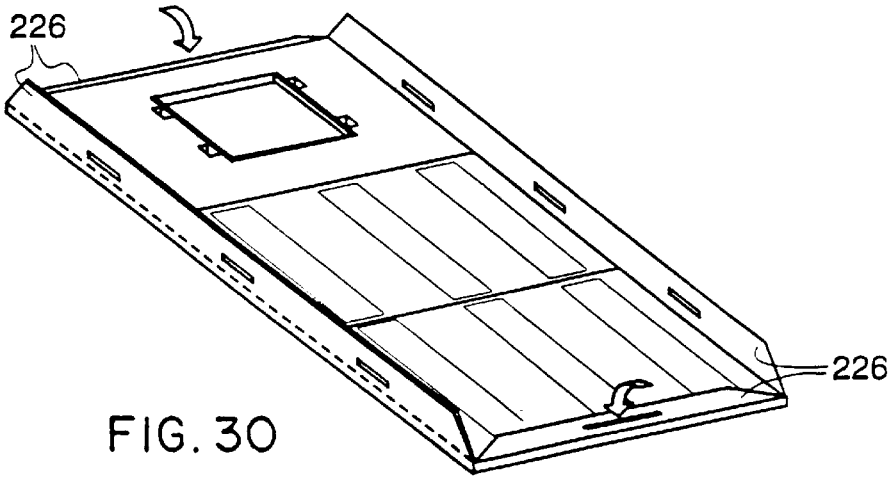
Figure 31:
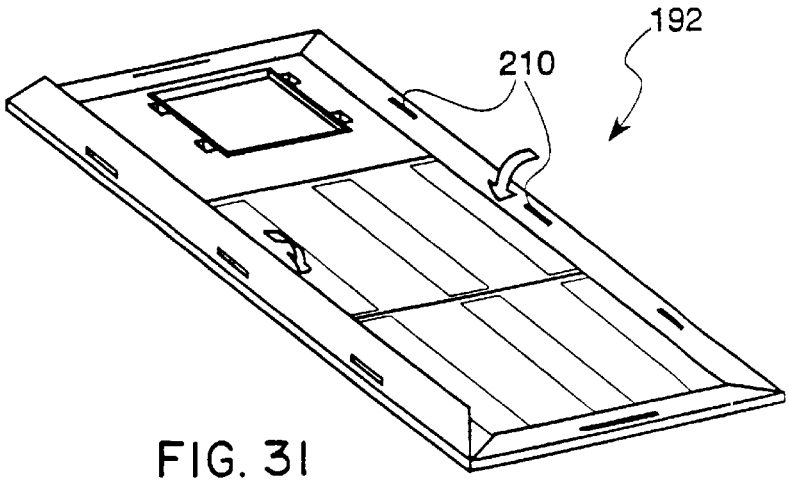

To assemble the outer lid portion 192, outer flaps 226 of the outer lid panel 198 are folded up about the innermost fold lines of the pairs of fold lines 202–208 so that the flaps 226 extend substantially perpendicularly to the remainder of the panel 198. The plastic window frame 216 is then placed in the window opening 212 with the outer edges 216*a* of the frame in tight abutment against the edges 212*a* of the window opening. The cover sheets 224 are peeled from the window member 218 and it is adhered onto the lid panel 198 with the raised inner edges 216*b* of the window frame 216 in registry with the square opening 220 of the window member 218. In this regard, it will be noted that the window opening 220 has slightly shorter sides than the window opening 212 of the panel 198. In addition, the window opening 220 has notches 227 formed on opposite sides thereof for purposes to be described hereinafter. To complete the outer lid portion 192, a honeycomb fiberboard panel 228 which is jointed at 228*a* so that it can be folded onto itself is provided. Similar to the previously described fiberboard panels 44, the fiberboard panel 228 has adhesive strips 138 provided thereon covered by covering strips 140. To attach the fiberboard panel 228 onto the outer lid panel 198 adjacent the window member 218, the strips 140 on one side thereof are removed and the panel is flipped over and placed down against the outer lid panel 198, as indicated in FIGS. 27 and 28. In this manner, the entire inside surface of the panel 198 will be covered by the abutting window member 218 and panel 228, as shown in FIGS. 29–31.

Figure 29:
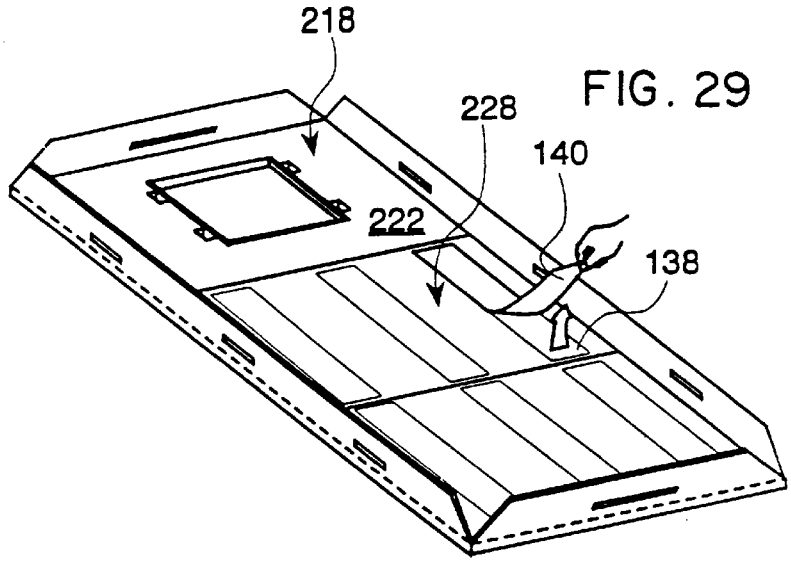

With the window member 218 and panel 228 in place on the outer lid panel 198, the strips 140 on the upwardly facing side of the panel 228 can be removed to expose the adhesive 138 thereunder, as illustrated in FIG. 29. The folded up flaps 226 can then folded down about the outermost fold lines of the pairs of flap fold lines 202–208 onto the exposed adhesive 138 with the peripheral slots 210 now located around the folded down flaps 226, as shown in FIG. 31.

Figure 32:
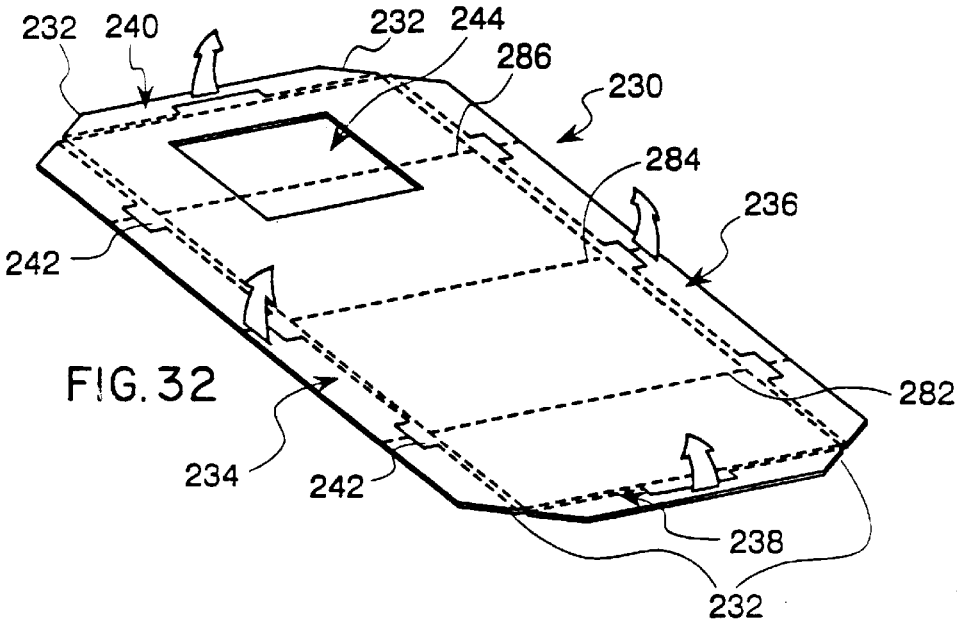
FIGS. 32–39 are perspective views of an inner lid panel being folded into assembled form for forming an inner lid portion including window-forming parts and reinforcement boards.

The preferred assembly of the inner lid portion 194 will next be described. Inner lid portion 194 is formed from an inner lid panel 230 similar to outer lid panel 198, but slightly smaller relative thereto. The inner lid panel has bevelled corners 232 and pairs of longitudinal fold lines 234 and 236 with each pair including lines that are adjacent and closely spaced relative to each other and extending longitudinally between midpoints at longitudinally opposite bevelled corners 232. Pairs of transverse fold lines 238 and 240 are also provided with each pair including lines that extend adjacent and closely spaced relative to each other and extending transversely across the panel 230 to midpoints of transversely opposite bevelled corners 232. Rectangular die cuts 242 are formed around the periphery of the panel 230 and extend towards the exterior edges thereof from the outside fold lines of the pairs of fold lines 234–240 of the panels 230, as best seen in FIG. 32. A substantially square window opening 244 is formed in the panel 230 adjacent the transverse fold lines 240 spaced inwardly therefrom.

Figure 33:
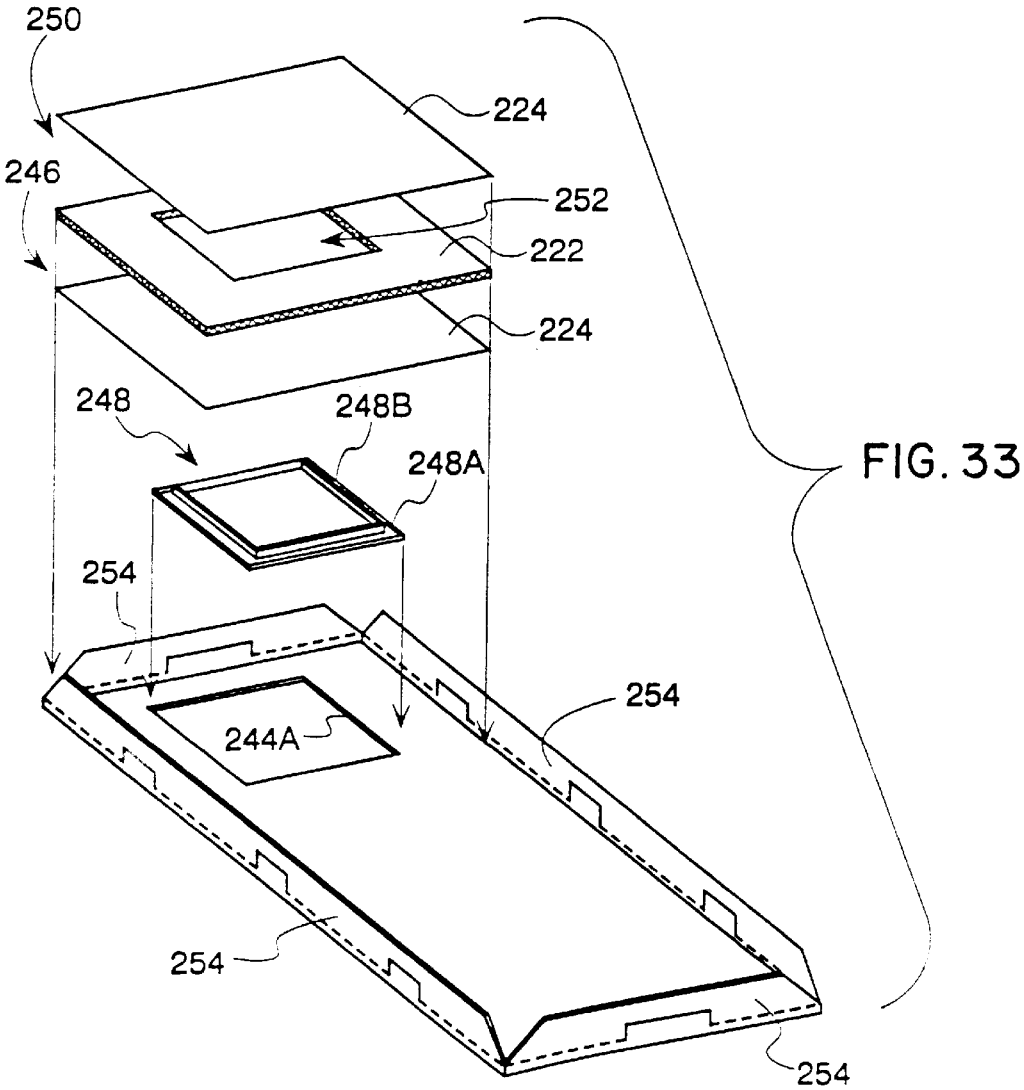
Figure 34:
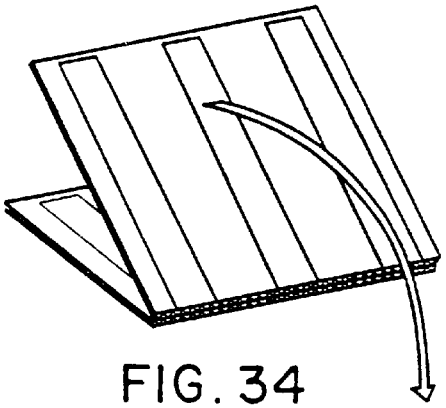
Figure 35:
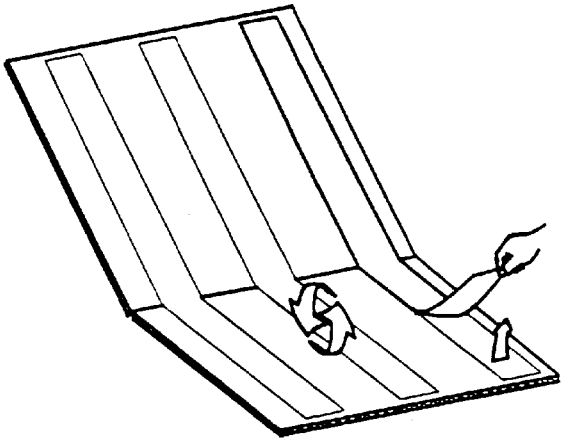
Figure 36:
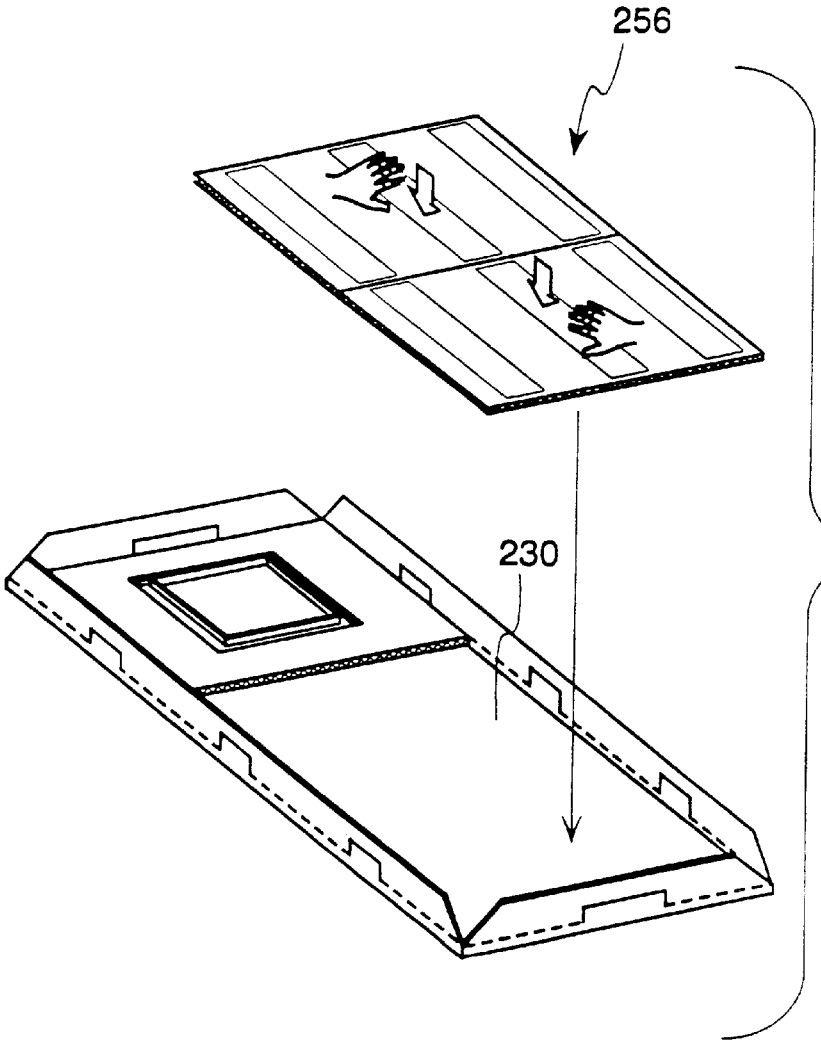
Figure 37:
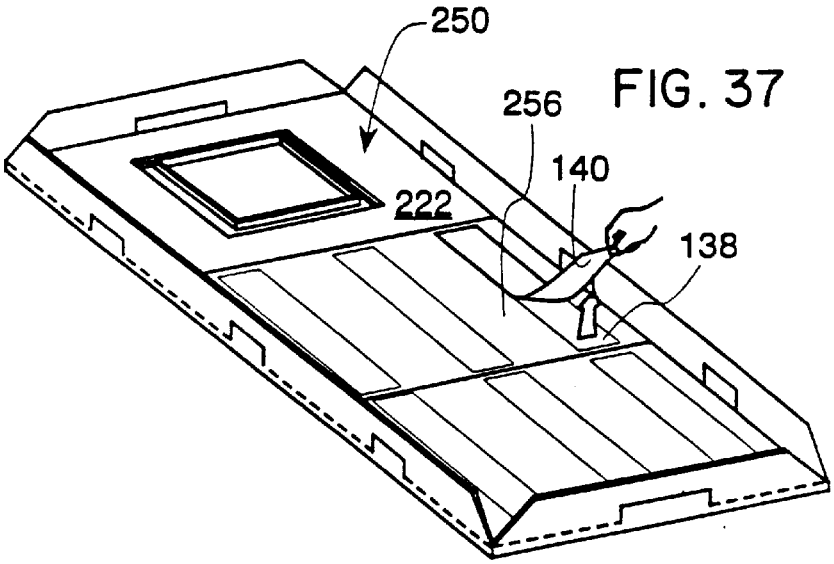

Referring to FIG. 33, window parts generally designated 246 are shown. The window parts 246 include a substantially square plastic window frame 248 and a substantially square fiberboard window member 250 similar to the fiberboard window member 218 in that it includes a centrally positioned square opening 252 formed therein and is coated with pressure sensitive adhesive 222 on both sides thereof and covered with cover sheets 224.

To assemble the inner lid portion 194, peripheral flaps 254 of the panel 230 are folded up about the innermost fold lines of the pairs of fold lines 234–240 so as to extend perpendicularly to the remainder of the inner lid panel 230. The window frame 248 is placed in the panel window opening 244 tightly received therein with its outer edges 248*a* in engagement with the window opening edges 244*a*. Thereafter, the window member 250 is attached to the panel 230 by peeling the sheets 224 to expose the adhesive 222 thereon with the member 250 then being pressed onto the panel 230 about the window frame 248 with the frame raised inner edges 248*b* being in registry with and spaced from the edges of the window member opening 252, as can be seen in FIGS. 36–39.

Figure 38:
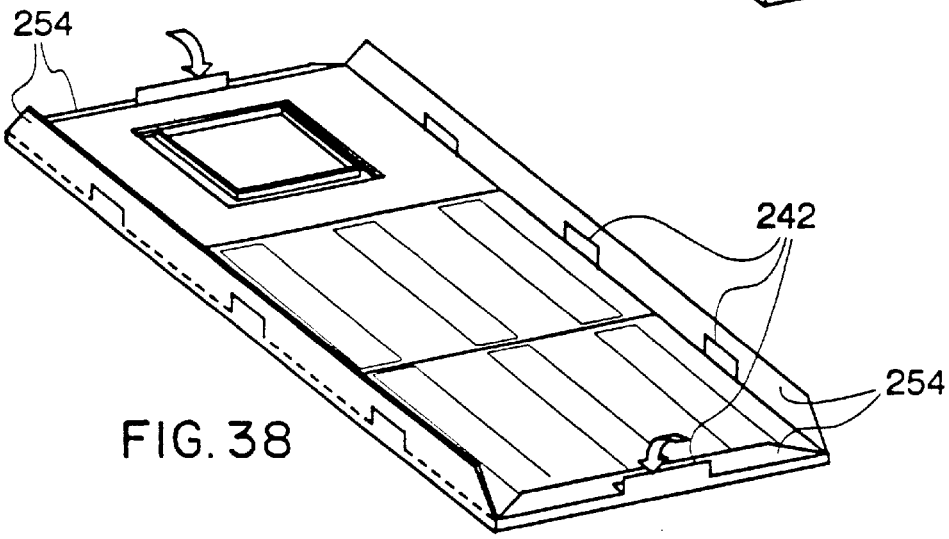
Figure 39:
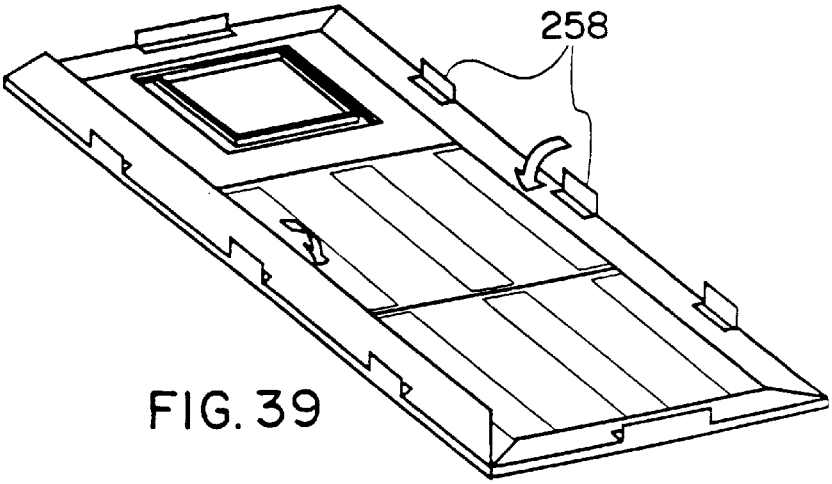
Figure 40:
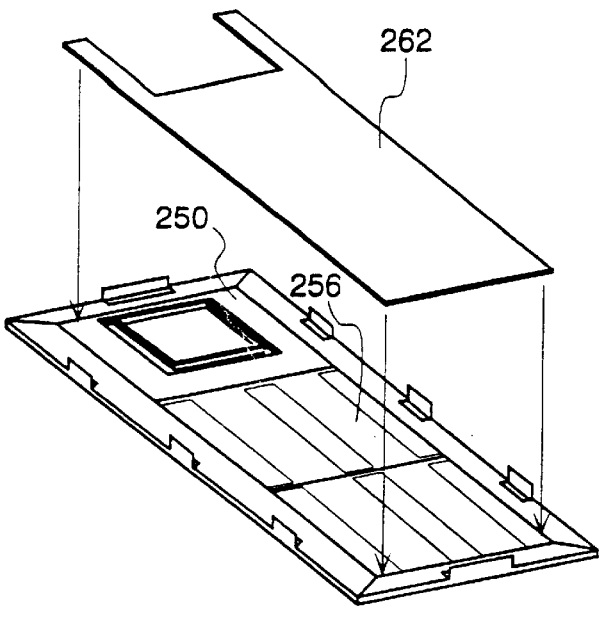
FIGS. 40–43 are perspective views of the assembly of the lid including the attachment of the assembled inner and outer lid portions together with a lid-stiffening panel therebetween.
Figure 41:
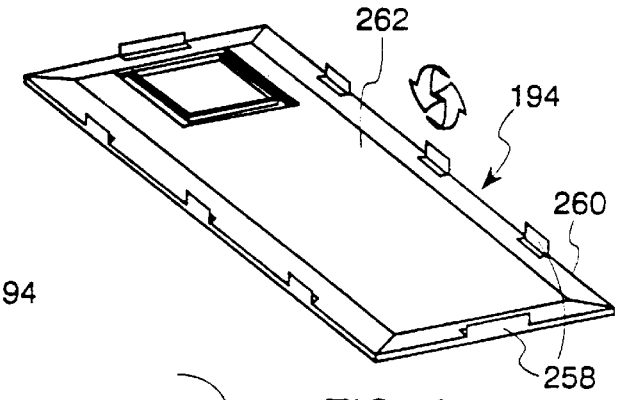

With the window member 250 secured on the panel 230, a fiberboard panel 256 is attached onto the remainder of the lid panel 230 in a manner similar to that of the attachment of fiberboard panel 228 on panel 198. With the window member 250 and panel 256 firmly in place on the lid panel 230 in abutment with each other, the folded up flaps 254 can be folded down about the outermost fold lines in the pairs of fold lines 234–240 so as to bring them into contact with the exposed adhesive 138 of the fiberboard panel 256 and the exposed adhesive 222 of the window frame member 250. Because of the die cuts 242 formed in the flaps 254, as the flaps are folded down about the outer fold lines as shown in FIGS. 38 and 39, the flap material will separate along the die cuts 242 to form rectangular projecting tabs 258 around the outermost edge 260 of the finished inner lid portion 194 (FIG. 41).

To complete the lid 14, a lid stiffening panel 262 having an upper cut-out 262*a* for accommodating the window openings 212 and 244 in the lid portions 192 and 194, respectively, is provided. Because the flaps 226 and 254 of the respective lid portions 192 and 194 are folded over onto the respective window members 218 and 250 and fiberboard panel 228 and 256, there is a gap or space that is formed between the lid portions 192 and 194 when they are attached together. Such a gap allows the lid 14 to be more flexible than is desirable when pressure is placed thereon.

Accordingly, the lid stiffening panel 262 is attached to the inner lid portion on the window member 250 and panel 256 so as to take up this space when the lid portions 192 and 194 are attached. In this regard, the stiffening panel 262 has a thickness roughly equivalent to twice the thickness of the panels 198 and 230 since the gap provided by folding over the flaps 226 and 254 will be roughly equivalent to the thickness of their respective panels 198 and 230. Once the stiffening panel 262 is attached on to the window member 250 and panel 256, the lid portions 192 and 194 can be attached to each other. In this manner, loads applied to the outer lid portion 192 will be transmitted to the stiffening panel 262 and the inner lid portion 194 to provide the lid 14 with greater rigidity and strength.

Figure 42:
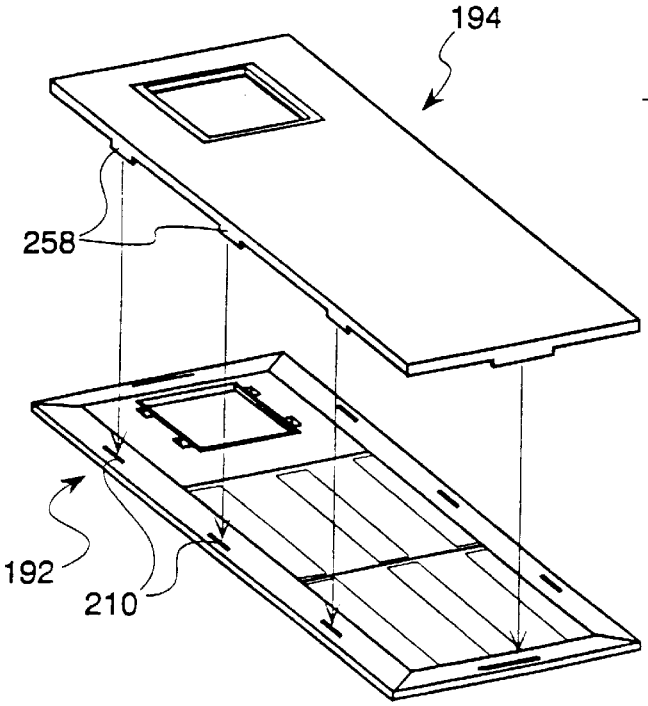

As previously mentioned, the inner lid portion 194 is slightly smaller than the outer lid portion 192, although having the same generally rectangular configuration. The relative sizing of the lid portions 192 and 194 is such that with the tabs 158 formed around the exterior edge 260 of the inner lid portion 194, they can be aligned to slide into corresponding slots 210 formed in the flap sections 226 of the outer lid portion 192, as depicted in FIG. 42. With the inner lid portion 194 flipped over and the tabs 258 aligned with the corresponding slots 210 of the outer lid portion 192, the lid portion 194 can be dropped down onto the lid portion 192 with the tabs 258 frictionally fitting in slots 210 and the lid stiffening panel 262 being tightly captured between the window members 218 and 250 and the fiberboard panels 228 and 256 and adhered thereto so as to somewhat load the tabs 258 in the slots 210 to enhance the strength of the frictional connection therebetween and thus of the connection between the lid portions 192 and 194.

Figure 43:
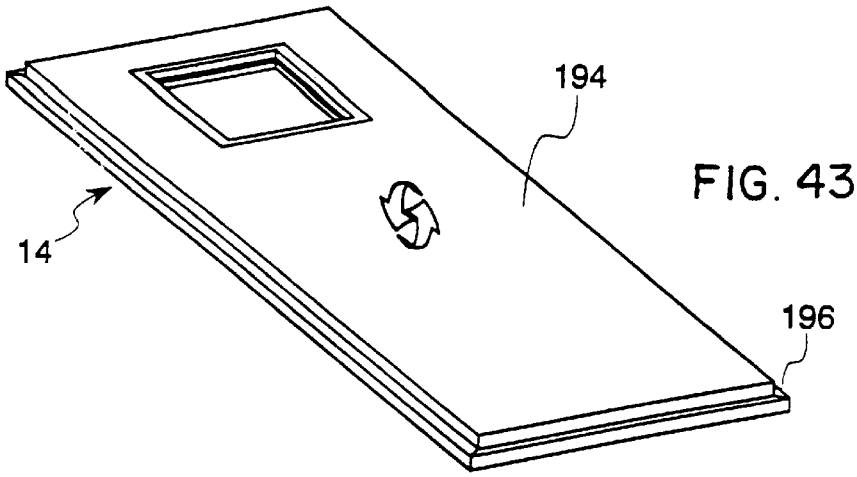
Figure 44:
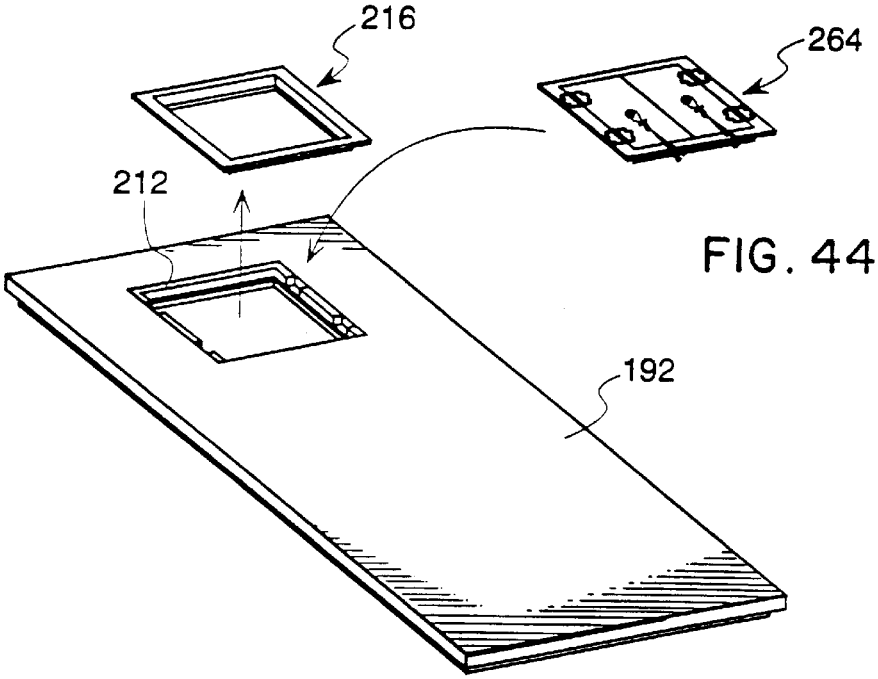
FIGS. 44–45 are perspective views of the assembled lid and showing the installation of a window unit on the lid.
Figure 45:
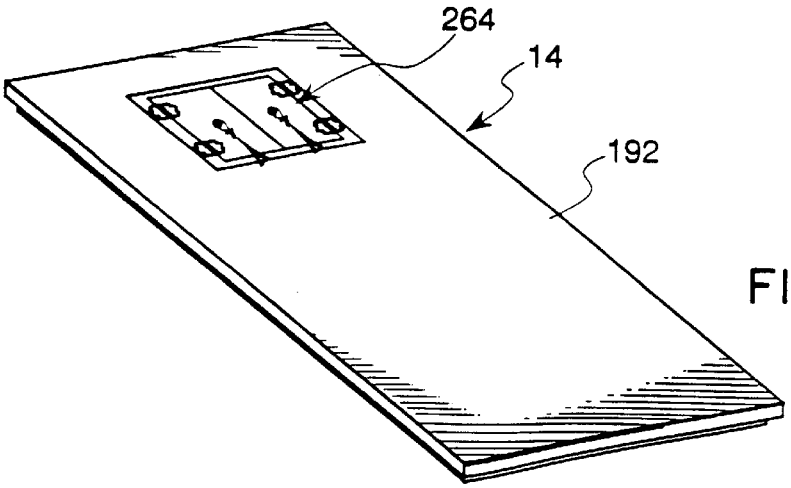

When the lid portions 192 and 194 are attached, their window openings 212 and 244 and corresponding window parts 214 and 246 will be aligned with each other. A window unit 264 is mounted into the window opening 212 of the outer lid portion 192 by flipping over the finished lid 14 of FIG. 43 so as to provide access to the window frame 216 in the window opening 212 thereof. To install the window unit 264, the plastic window frame 216 is removed from the opening 212 to expose portions of the lid stiffening panel 262 under the notches 227 for attaching the window unit 264 thereto. FIG. 45 illustrates the lid 14 having the window unit 264 attached thereto, as by suitable screw fasteners.

Figure 46:
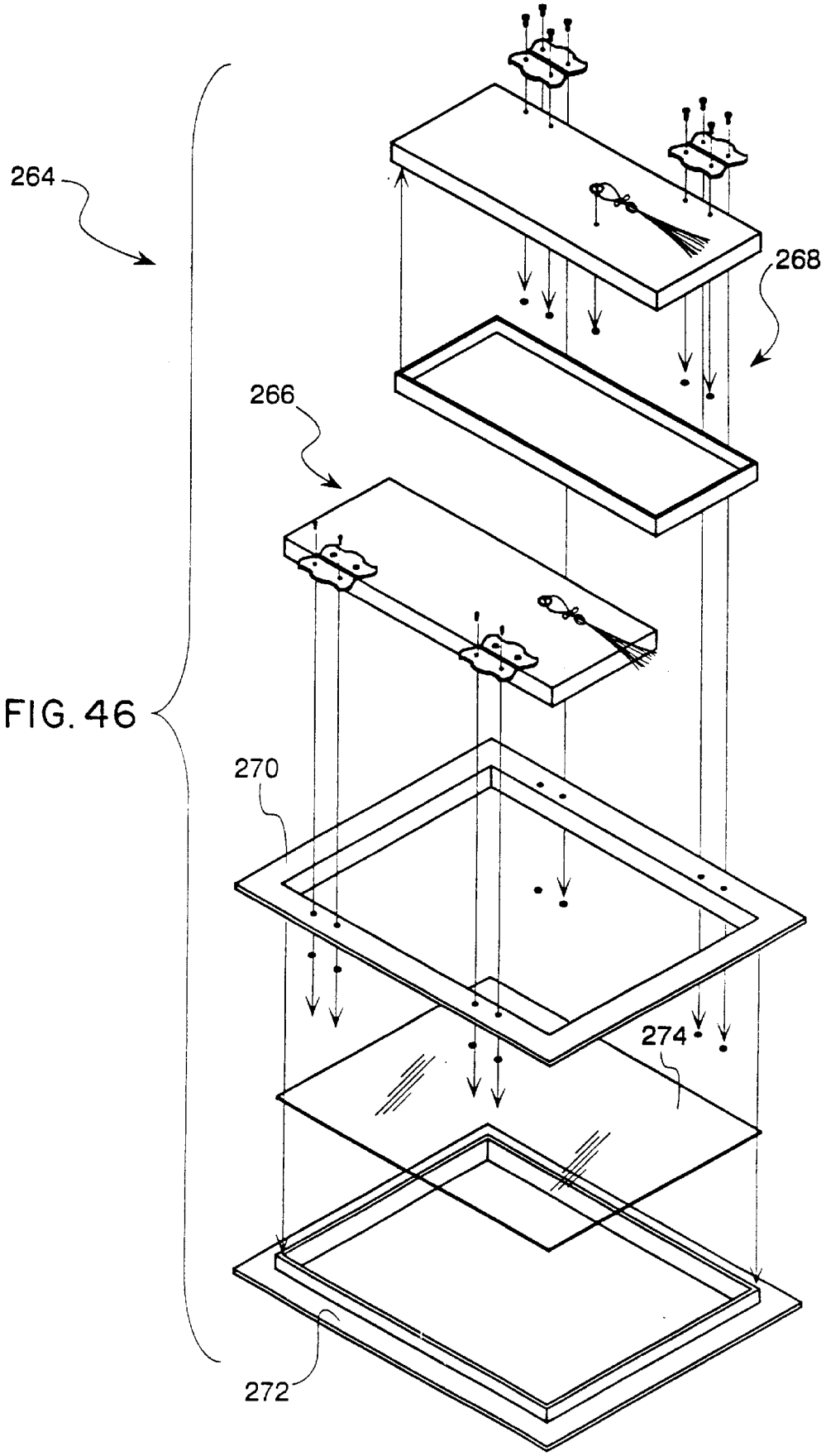
FIG. 46 is an exploded perspective view of the window unit of FIGS. 44 and 45.

FIG. 46 illustrates in exploded view one suitable construction for a window unit 264 that can be used with the lid 14 herein. As shown, the window unit 264 includes hinged covers 266 and 268 attached to glass frames 270 and 272 which capture a glass panel 274 therebetween. The window unit 264 allows the interior 18 of the container 10 to be viewed through the glass 274 by pivoting open of the window covers 266 and 268 without having to remove the lid 14 from the container body 12. Thus, when the deceased is being waked, the decedent's face can be viewed by opening of the window covers 266 and 268.

Figure 47:
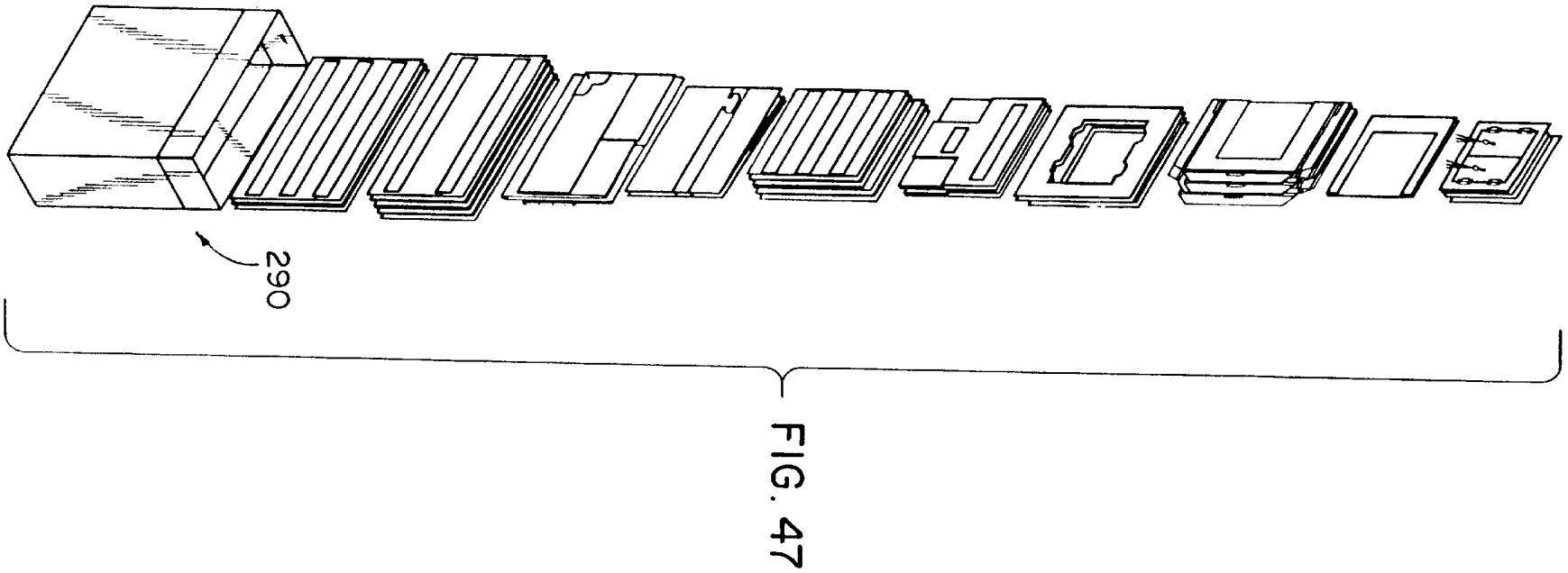
FIG. 47 is a perspective view of a compact transport container for the container assembly portions of the present invention.

Another important advantage provided by the present container 10 is that it can be folded into a small transport container 290 for shipping purposes as opposed to simply shipping the panels 24, 26, 44, 198 and 230 in their flat, unfolded configuration. Where the container 10 has to be transported by automobile before final assembly thereof, the provision of the transport container 290 as seen in FIG. 47 is especially advantageous so that the panels can be folded or collapsed with the panels fitting into the compact container 290 for being placed in the trunk of an automobile for transportation. To provide for such folding, the fold lines 28 for the body panel portions 58 and 60 include additional transverse fold lines 266, 268 and 270 spaced longitudinally at approximately equal intervals along the length of the body panel portions 58 and 60. Similarly, the fold lines 30 for the fluid containment panel 26 include additional transverse fold lines 272 and 274 which, along with transverse fold line 178, are spaced longitudinally at approximately equal intervals along the length of panel 26. Likewise, lid panels 198 and 230 include additional transverse fold lines 276, 278 and 280, and 282, 284 and 286, respectively, which are spaced longitudinally at approximately equal intervals along the length of their respective lid panels 198 and 230. As is apparent, the above transverse fold lines for the panels 24, 26, 198 and 230 allow them to be folded into a collapsed state with the jointed panels 44 folded so as to be also fitted in the container 290. Accordingly, the parts for the entire container assembly 10 can be collapsed and fit into a very compact form for transport in a small space, as in a car trunk, and can be later assembled into its operative condition by a person who does not have any special assembly skills and without the use of fasteners or tools in a quick and easy manner.

Figure 48:
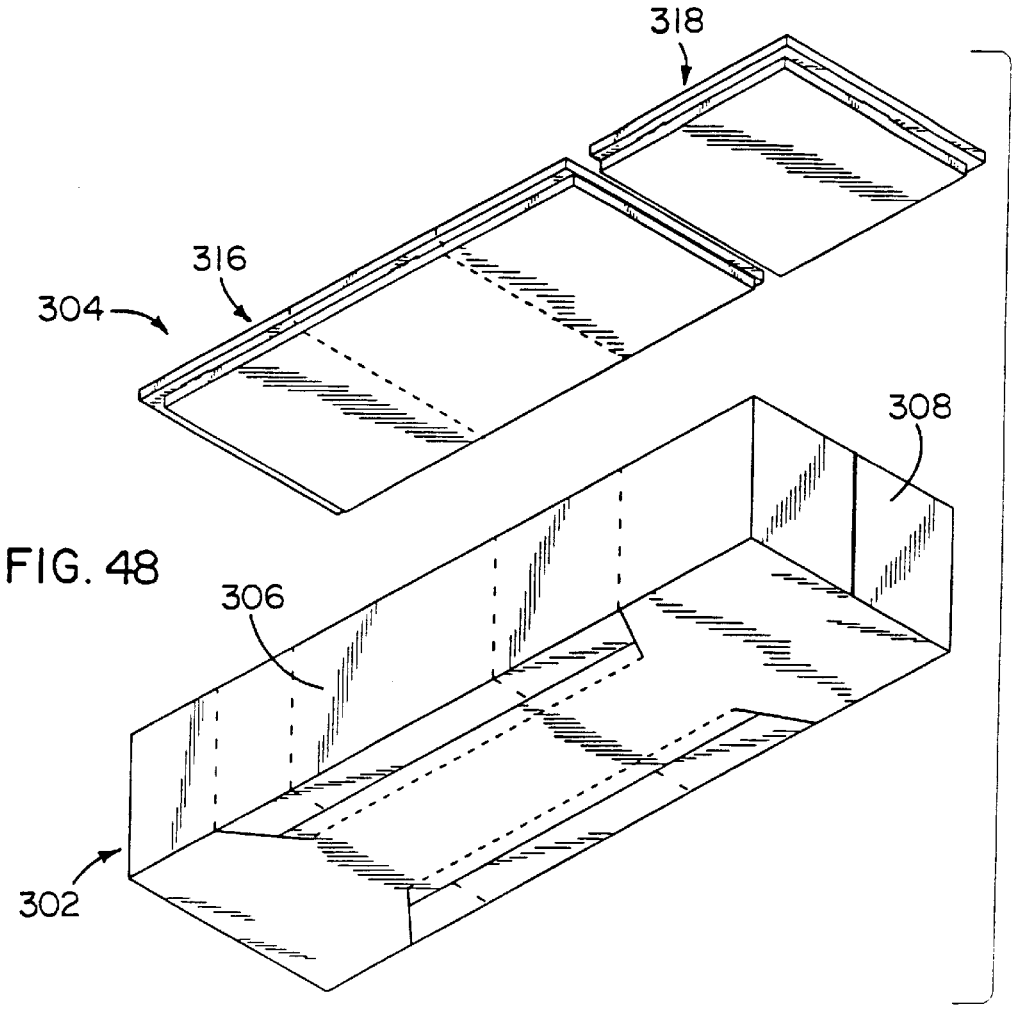
FIG. 48 is a perspective view of another completed container assembly in accordance with the present invention showing the lid having small and large sections which are removed off from a main container body of the container assembly.
Figure 49:
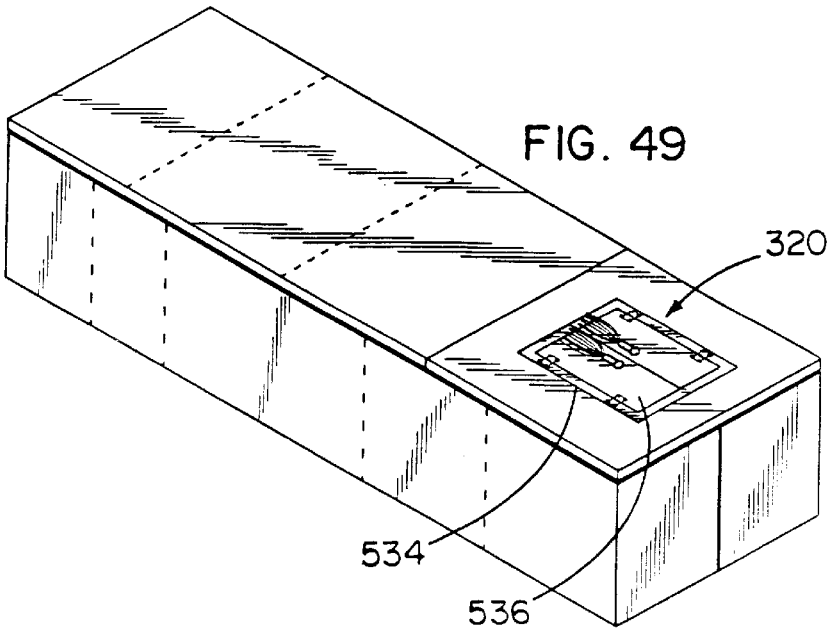
FIG. 49 is a perspective view of the container assembly of FIG. 48 with an alternative small lid section having a window unit.
Figure 113:
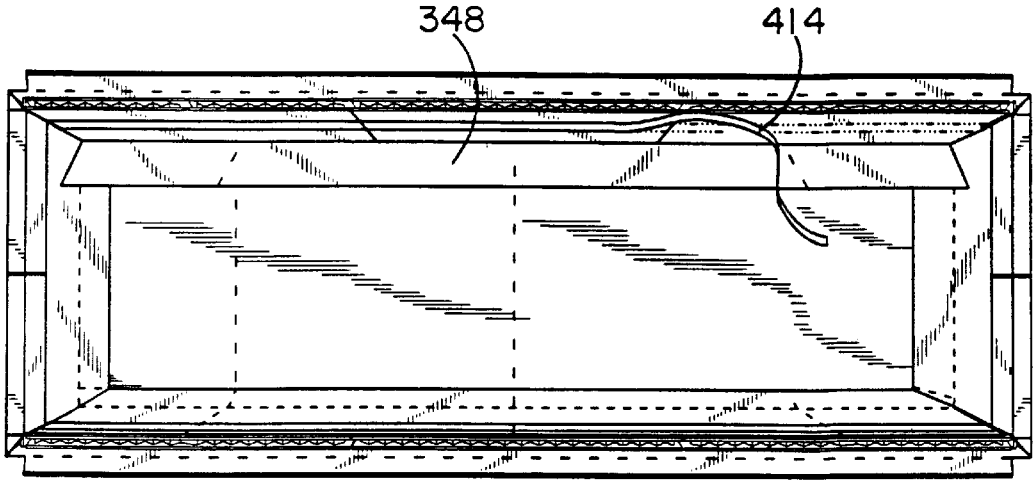

FIGS. 48 and 49 illustrate another container assembly 300 formed of fiberboard material in accordance with the present invention. The container assembly 300 is similar to the container assembly 10 as it includes a main container body 302 having a base 310 and upstanding sides 306 and ends 308, and a lid 304 which is sized to rest on upper ends of the upstanding sides 306 and ends 308 of the main container body 302. Thus, with the lid 304 on the main container body sides 306 and ends 308, the lid 304 will close off the opening 312 leading to the interior space 314 defined by the sides 306, ends 308 and base 310 of the main container body 302 (FIG. 113). As can be seen in FIG. 48, the lid 304 for the container assembly 300 preferably includes a first large section 316 and a second small section 318 which when placed on the top of the sides 306 and ends 308 cooperate to close off the main container body opening 312, as will be more particularly described herein. With the sectioned lid 304 and a corpse contained in the container assembly 300, the small lid section 318 can be arranged to be over the upper torso 318 so that to view the head region of the deceased, one need only remove the small lid section 318. Alternatively, the small lid section 318 can be provided with a window unit 320 similar to that provided with the lid 14 of the container assembly 10 for viewing of the deceased. In addition, the lid 304 can have a contoured or shaped top, such as a dome or peak shaped top (not shown) as opposed to the illustrated flat top, to provide for different models and grades of containers.

Figure 111:
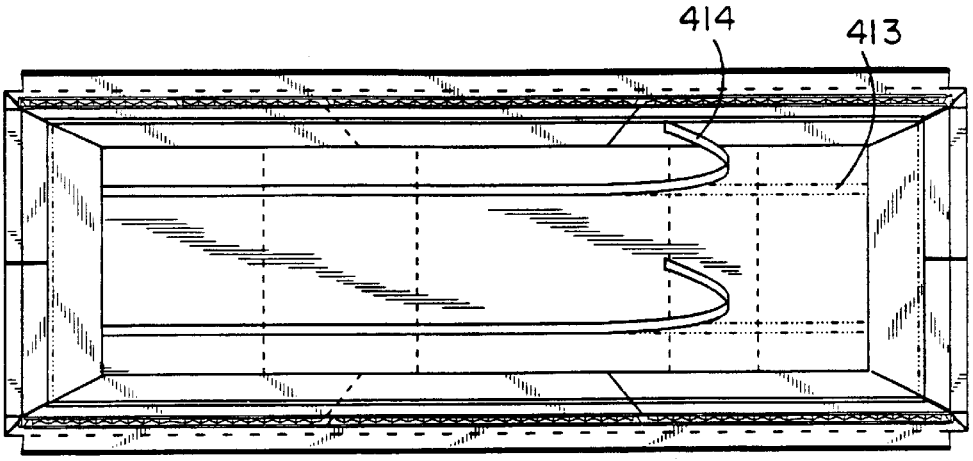
FIGS. 111–114 are plan and perspective views of the assembly of the fluid containment portion into the outer body portion having the reinforcing fiberboards attached therein to complete the assembly of the main container body.

The main advantage of the container assembly 300 over the container assembly 10 described previously herein is that the main container body 302 is adapted to be in a partially preassembled condition when an undertaker removes it from its transport container 320. More particularly, the main container body 302, similar to the previously described main container body 12, is formed from an outer body portion 322 and a fluid containment portion 324 (FIG. 111) placed therein with reinforcing fiberboards, generally designated 326, therebetween. Again, similar to the previously described container body 12, the main container body 302, and in particular the outer body portion 322 and fluid containment portion 324 thereof, are formed from respective panels 328 and 330 which include a plurality of fold lines, generally designated 332 and 334, respectively, to allow the panels 328 and 330 to be folded to a predetermined operative orientation to form the outer body portion 322 and the fluid containment portion 324. As can be seen in FIG. 111, the predetermined operative orientation of both the outer body portion 322 and fluid containment portion 324 is that of a substantially rectangular box having an open top with the fluid containment portion 324 preferably having a slightly tapered bottom for reasons to be described hereinafter.

Thus, with the outer body portion 322 folded to its predetermined rectangular box shape, the outer body portion 322 will include a base 336 and upstanding walls therefrom including opposite sidewalls 338 and 340 and opposite end walls 342 and 344. Similarly, with the fluid containment portion 324 folded to its operative substantially rectangular box shape, the fluid containment portion 324 will have a base 346 and upstanding walls therefrom including opposite sidewalls 348 and 350 and opposite end walls 352 and 354. Similar to the outer body portion 322 and fluid containment portion 324, the transport container 320 can be formed from a panel 356 having a plurality of fold lines 358 to fold the panel 356 into a predetermined orientation which is preferably that of a compact open top square box shape which is smaller than the container assembly 300. The folding up of the transport container 320, outer body portion 322 and fluid containment portion 324 can be readily determined from the location of the respective fold lines, 358, 332 and 334, such that their assembly into their operative orientations will not be described in detail herein except where deemed necessary for proper understanding of the advantageous features of the container assembly 300, such as with respect to the partial preassembly of the container body 302 and the ability of the outer body portion 322 to be bent or collapsed from its predetermined operative orientation to a smaller predetermined transport orientation.

Figure 52:
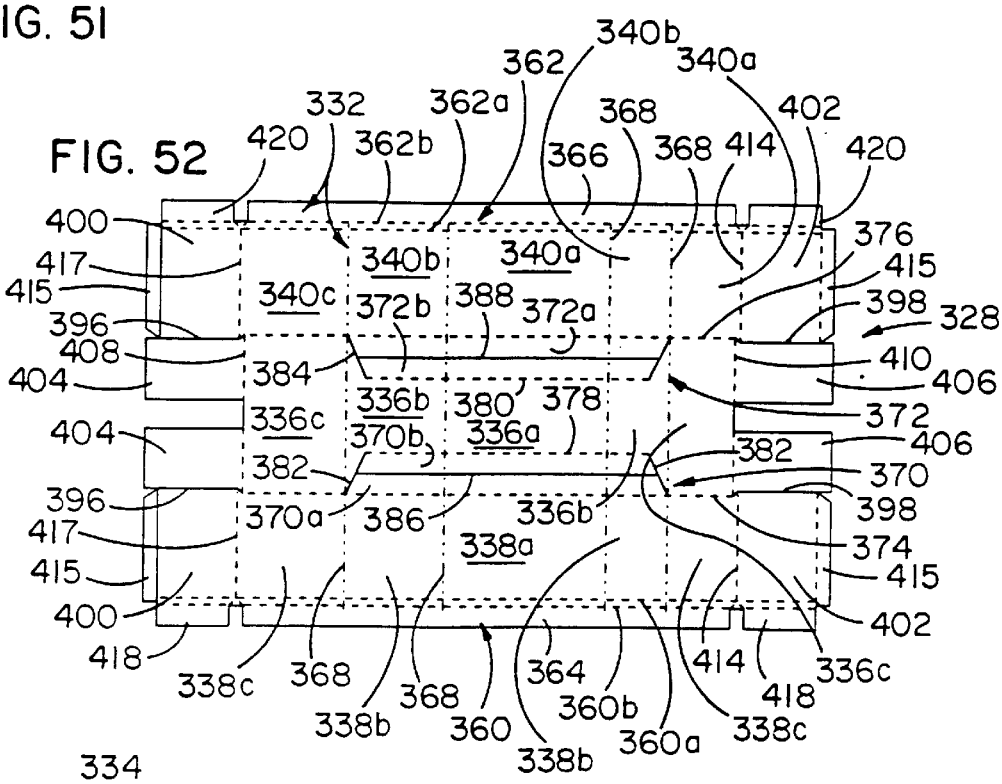
Figure 53:
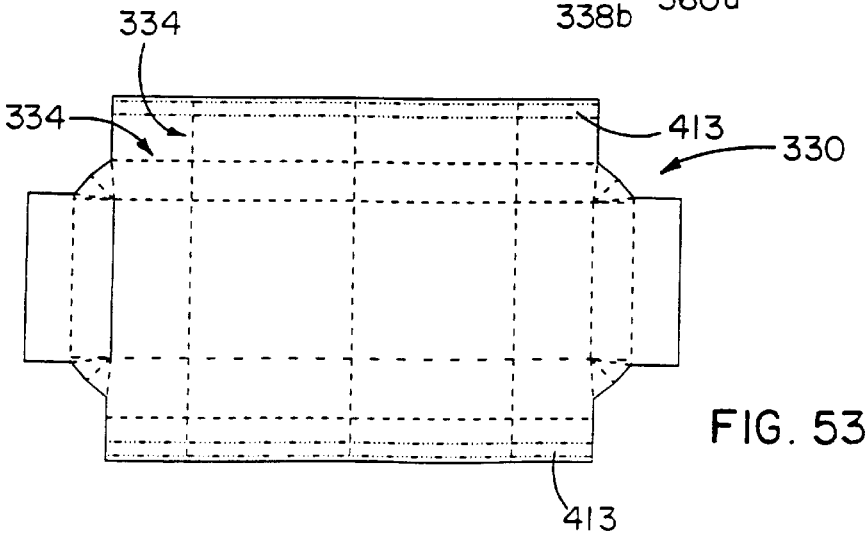

Referring to FIG. 52, the fold lines 332 of the outer body panel 328 include two pairs of closely spaced, parallel longitudinal fold lines 360 and 362 which extend along either long side of the body panel 328 to delineate and form upper flaps 364 and 366. The fold lines 332 of the outer body panel 328 also include a plurality of transverse bend lines 368 for bending or collapsing the outer body portion 322 from its predetermined operative orientation to a smaller predetermined transport orientation, shown in FIGS. 59 and 60. In this regard, access flaps 370 and 372 are provided on the outer body base 336. The access flaps 370 and 372 are provided to allow the assembly of one of the reinforcing fiberboards 326 to the base 336 to be completed, as will be described hereinafter, and to allow the base 336 and sidewalls 338 and 340 to be bent or collapsed when the outer body portion 322 is changed from its larger operative orientation to its smaller transport orientation.

More specifically, the access flaps 370 and 372 preferably have a trapezoidal shape as formed on the outer body panel 328. The base of the trapezoidal access flaps 370 and 372 is a central portion of respective longitudinal fold lines 374 and 376 which define the junction or corner between the base 336 and sidewalls 338 and 340 of the outer body portion 322. Longitudinal fold lines 378 and 380 are spaced inwardly from respective fold lines 374 and 376 and are shorter in length such that pairs of oblique or diagonal pert lines 382 and 384, respectively, extend from the ends of the short longitudinal fold lines 378 and 380 to their respective longer longitudinal fold lines 374 and 376 to form the trapezoidal shaped access flaps 370 and 372. Intermediate longitudinal perf lines 386 and 388 extend between the respective pairs of oblique perf lines 382 and 384 intermediate the longitudinal fold lines 374 and 378 and the longitudinal fold lines 376 and 380, respectively.

Accordingly, when the outer body panel 328 is folded to its operative orientation with the sidewalls 338 and 340 bent up about fold lines 374 and 376, the access flaps 370 and 372 can be separated along their respective perf lines 382–388 so that the access flaps 370 and 372 include portions 370*a* and 370*b*, and 372*a* and 372*b*, respectively, with the flap portions 370*a* and 372*a* being associated with their respective sidewalls 338 and 340 and the access flap portions 370*b* and 372*b* being associated with the outer body portion base 336. With the sidewalls 338 and 340 thusly separated from the base 336 by the intermediate longitudinal pert lines 386 and 388, the sidewalls 338 and 340 and base 336 can be folded or bent or collapsed in an accordion-style fashion about the transverse bend lines 368 to bring the end walls 342 and 344 closer together with portions of the sidewalls 338 and 340 and portions of the base 336 collapsed together, as will be more fully described herein. Preferably, the bending or collapsing of the sidewalls 338 and 340 and the base 336 changes the outer body portion 322 from its predetermined operative rectangular box shape with the opening 312 thereto having a rectangular shape to a predetermined smaller square box shape with the opening 312 changing to a smaller square shape for fitting into the compact transport container 320 with the opening 312 and interior 314 still being sized sufficient to receive the remaining parts of the container assembly 300 therethrough and therein.

As previously mentioned, it is preferred that reinforcing fiberboards 326 be provided between the outer body portion 322 and the fluid containment portion 324 in forming the main container body 302. The container assembly 300 provides for preassembly of certain of these reinforcing fiberboards 326 to the outer body portion 322 when in its transport orientation. More particularly, the reinforcing fiberboards 326 include a base reinforcing fiberboard 390 (FIGS. 54 and 56) for being attached to the outer body portion base 336, a pair of end fiberboards 392 (FIG. 58) for being attached to the outer body portion end walls 342 and 344, and a pair of side fiberboards 394 (FIGS. 55 and 57) for being attached to outer body portion sidewalls 338 and 340. The reinforcing fiberboards 326 are preferably constructed with a pair of fiberboard sheets that sandwich an internal honeycomb fiberboard structure attached therebetween to provide the reinforcing fiberboards 326 with additional strength over the corrugated fiberboard used for the outer body portion 322 and fluid containment portion 324.

To form the end walls 342 and 344 of the outer body portion 322, pairs of longitudinal perf lines 396 and 398 are provided at either end of the panel 328 so that pairs of corner sections 400 and 402 can be separated from respective pairs of end panel sections 404 and 406. The end panel sections 404, 406 in a pair are laterally spaced from each other so that when the pairs of end panel sections 404 and 406 are folded up about transverse fold lines 408 and 410, respectively, to be perpendicular with the base 336, the pairs of corner sections 400 and 402 folded up about longitudinal fold lines 374 and 376 and separated along perf lines 396 and 398 from the corner sections 400 and 402 for forming the sidewalls 338 and 340 can be bent at right angles to the sidewalls 338 and 340 about transverse fold lines 417 and 419, respectively, so as to extend behind the pairs of end panel sections 404 and 406 and substantially abut each other along their inner edges defined by fold lines 400*a* and 402*a* to cover the space left between the end panel sections 404 and 406. Each of the corner sections 400 and 402 can include transverse flaps 415 which extend along their inner edges 400*a* and 402*a* when the corner sections 400 and 402 are folded up behind the end panel sections 404 and 406.

Figure 50:
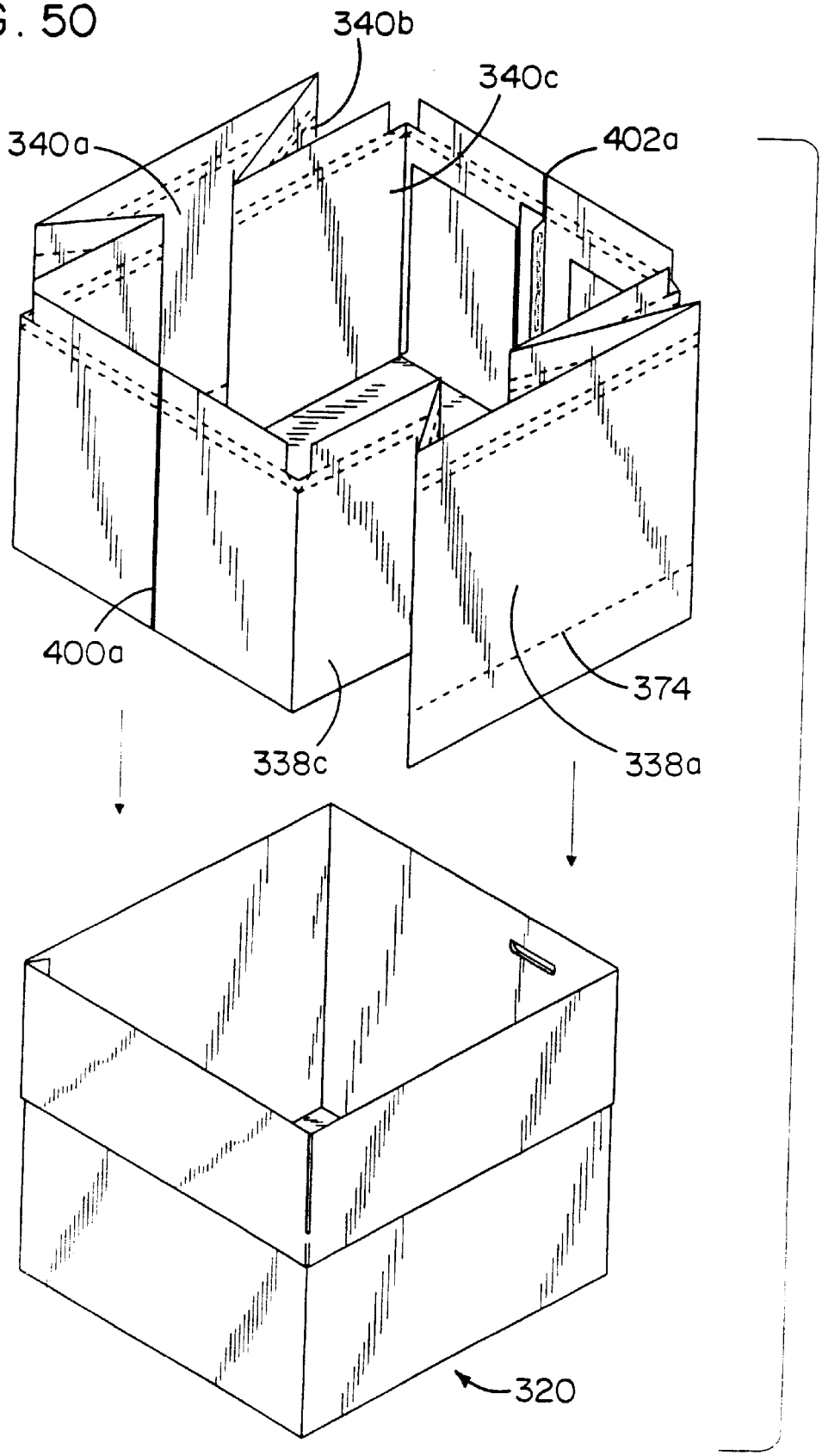
FIG. 50 is a perspective of an outer body portion of the main container body being bent or collapsed to a predetermined transport orientation for being placed in a compact transport container.
Figure 51:
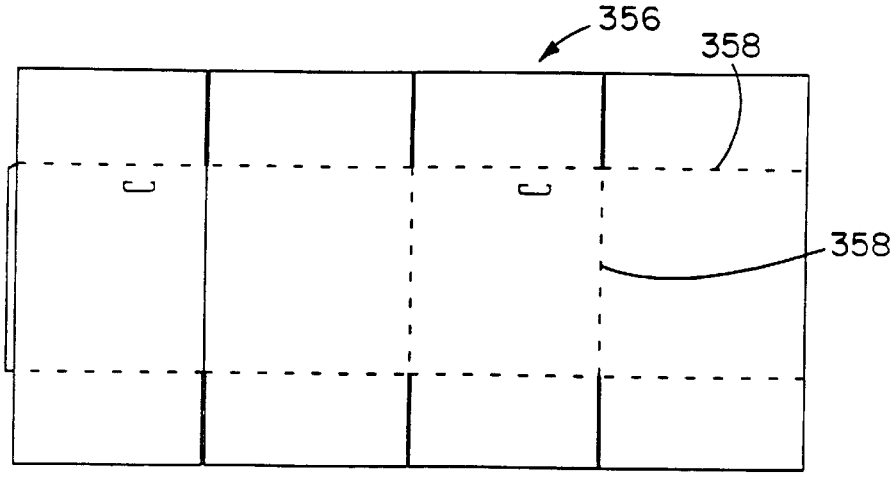
FIGS. 51–53 are plan views of panels of corrugated fiberboard material including fold lines for being folded into the compact transport container, the outer body portion and a fluid containment portion, respectively.

As previously discussed with respect to container assembly 10, it is preferred that the exposed surfaces be covered with a cloth material. Thus, with the outer or exposed surfaces of the outer body portion 322 being cloth covered, the flaps 415 can include the cloth thereon. Since the inner edges 400*a* and 402*a* are abutting with the outer body portion 322 folded to its operative orientation, the transverse flaps 415 can be folded about the fold lines 400*a* and 402*a* towards the interior 314 of the container so as to avoid exposure of the edge of the cloth on the outside of the container, as best seen in FIG. 50. To keep the outer body portion 322 folded up with the sidewalls 338 and 340 and end walls 342 and 344 extending substantially perpendicular to the base 336, adhesive 416 can be manually applied to the flaps 415 so that they can be folded back down against the inner surfaces of the corner sections 400 and 402 to be adhered thereto.

After folding the outer body panel 328 as described above, the outer body portion 322 can be collapsed in an accordion-style fashion to its predetermined transport orientation by bringing the end walls 342 and 344 closer together, as previously mentioned. More particularly, the base 336 and sidewalls 338 and 340 are segregated into five sections by the transverse bend lines 368 for purposes of changing the outer body portion 322 to its transport orientation with each including a large central section 336*a*, 338*a* and 340*a* with intermediate sections 336*b*, 338*b* and 340*b* on either side thereof and outer sections 336*c*, 338*c* and 340*c* between the intermediate sections 336*b*, 338*b* and 340*b* and, for the sidewalls 338 and 340, the corner sections 400 and 402, and for the base 336, the end panel sections 404 and 406.

To bend the outer body portion 322 accordion-style from its operative orientation to its transport orientation, the sidewall sections 338*b* and 338*c* and 340*b* and 340*c* are folded about bend lines 368 extending therebetween so that their exterior surfaces are brought into engagement with each other with the sidewall sections 338*a* and 338*b* and 340*a* and 340*b* being folded about bend lines 368 therebetween so that their interior surfaces are engaged with each other with such bending or folding being shown in progress in FIG. 50. As the sidewalls 338 and 340 are collapsed, the base 336 will likewise be collapsed. The base sections 336*b* and 336*c* will be folded about transverse bend lines 368 therebetween so that their exterior surfaces will be brought into engagement with each other and the base sections 336*a* and 336*b* will be folded about the bend lines 368 therebetween so that their interior surfaces are in engagement with each other. Thus, when the outer body portion 322 is in its transport orientation as in the transport container 320, the base section 336*c* and the sidewall sections 338*c* and 340*c* will be exposed in the interior of the container before preassembly of the reinforcing fiberboards thereto.

Figure 59:
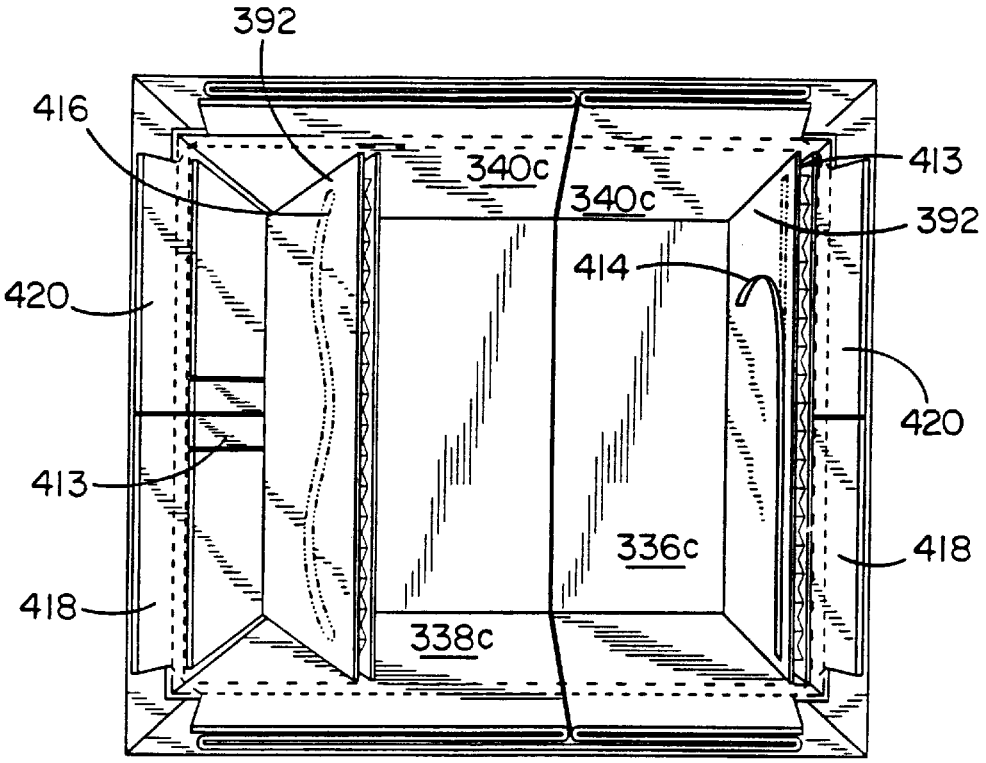
FIGS. 59 and 60 are plan views of the preassembly of the end fiberboards to the outer body portion bent to its predetermined transport orientation and placed in the compact transport container.
Figure 60:
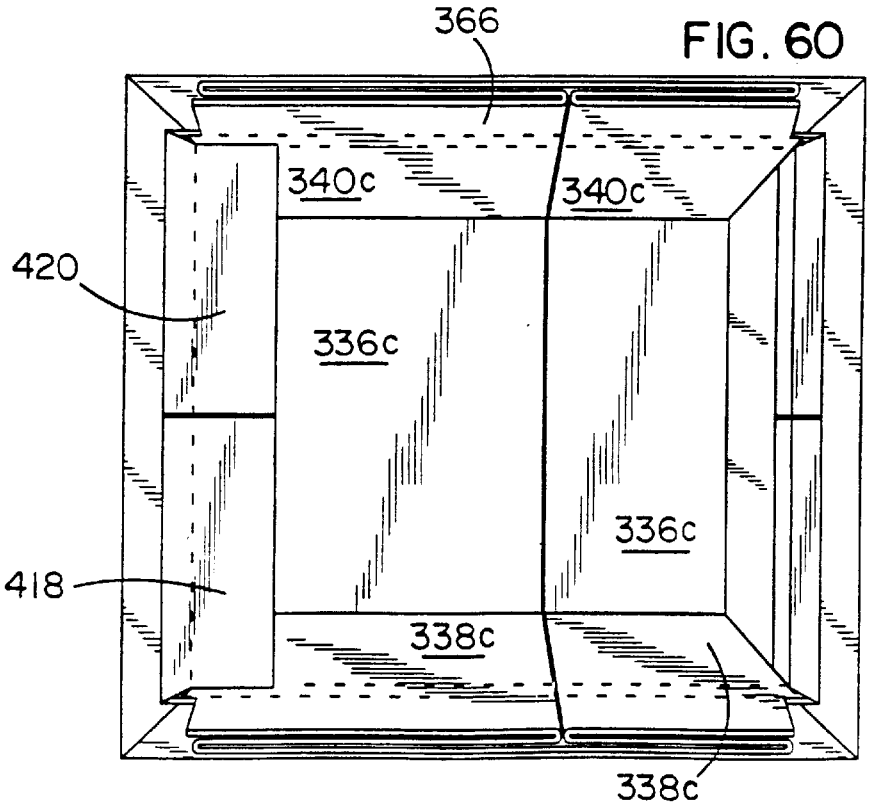

With the outer body portion 322 in its predetermined transport orientation and placed in the transport container 320, the reinforcing end fiberboards 392 can be preassembled to the outer body portion end walls 342 and 344, as shown in FIGS. 59 and 60. The reinforcing end fiberboards 392 can be provided with a strip of pressure sensitive adhesive 413 preapplied onto one of the surfaces thereof and covered with cover release tape 414 which can be peeled to expose the adhesive strip 413 thereunder. To attach the reinforcing end fiberboards 392 to the end walls 342 and 344, the side without the adhesive strip 412 thereon can have adhesive 416 manually applied thereto with the adhesive 416 then being pressed against the inside facing surface of the end walls 342 and 344.

The flap sections 364 and 366 of the outer body panel 328 include respective end sections 418 and 420 which are separated from the remainder of the flaps 364 and 366 and are associated with panel corner sections 400 and 402. The reinforcing end fiberboards 392 have a height which substantially corresponds to the distance between the base section 336*c* and the inner or lower fold lines 360*a* and 362*a* in the flap fold line pairs 360 and 362 when the panel 328 is folded up to its operative or transport orientations. In addition, the distance between the parallel longitudinal flap fold lines 360*a* and 360*b* and 362*a* and 362*b* is sufficient to accommodate the thickness of the reinforcing end fiberboards 392 with some play provided so that when the end flap sections 418 and 420 are folded over the pair of longitudinal flap fold lines 360 and 362, the thickness of the end panel sections 404 and 406 can also be accommodated. Before folding the end flap sections 418 and 420 down onto the inside surface of the reinforcing end fiberboards 392, the release tape 414 is removed from the end fiberboards 392 to expose the adhesive strip 413 thereunder for adhering to the flap sections 418 and 420, as shown in FIGS. 59 and 60. In this manner, the reinforcing end fiberboards 392 are preassembled to the outer body portion 322 of the main container body 302.

Figure 61:
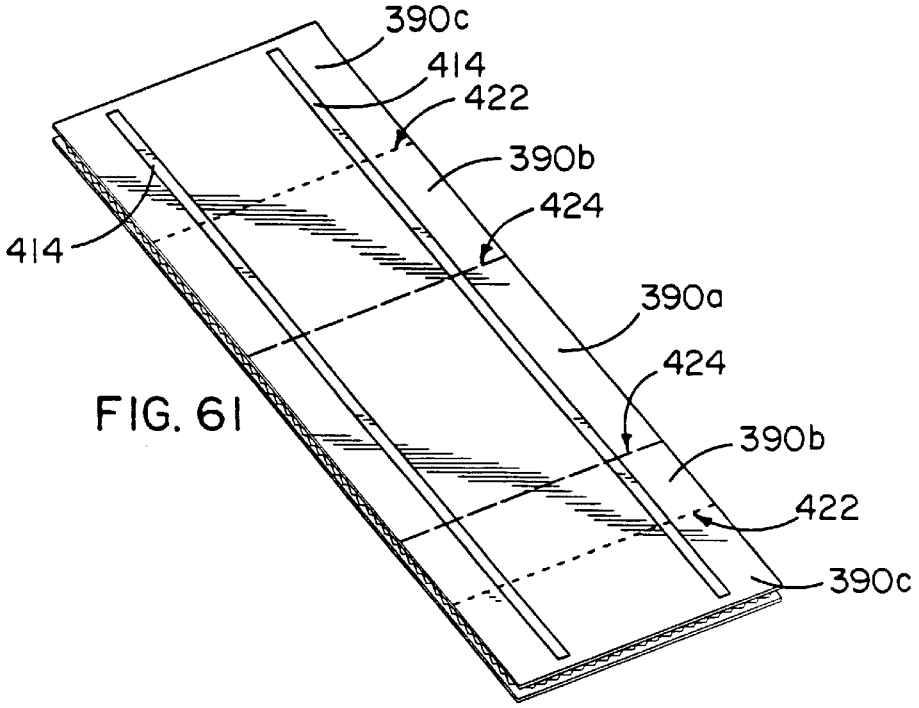
FIGS. 61–65 are perspective views of the base fiberboard being folded for transport and preassembled into the outer body portion bent to its transport orientation in the transport container.

After preassembly of the reinforcing end fiberboards 392 to the outer body portion end walls 342 and 344, the reinforcing base fiberboard 390 can be substantially preassembled to the outer body portion 322 in its transport orientation in the transport container 320. As best shown in FIGS. 54, 56 and 61, the reinforcing base fiberboard 390 has a plurality of transverse fold lines 422 and score or perf lines 424 which divide the base fiberboard 390 into five sections, with a large central section 390*a* adjacent two intermediate sections 390*b* on either side which in turn are attached to end sections 390*c*. As previously mentioned, the construction of the reinforcing fiberboards 326 is that of a pair of sheets sandwiching a fiberboard honeycomb internal structure so that for folding of the reinforcing fiberboards 326, one sheet must have a perf line for rupturing the sheet thereat to allow it to bend about a fold line aligned with a perf line on the other sheet. Accordingly, the fold lines 422 of the base fiberboard 390 have corresponding aligned perf lines 424 on the opposite sheet and the perf lines 424 have corresponding aligned fold lines 422 on the opposite sheet. FIG. 54 is a plan view of the top sheet 426 of the base fiberboard 390 with the top sheet 426 including a pair of longitudinal strips of adhesive 413 preapplied thereto. FIG. 56 is a plan view of the bottom sheet 428 with the bottom sheet 428 having a pair of shorter longitudinal adhesive strips 413 preapplied to extend the length of the base fiberboard central section 390*a* and into the adjacent intermediate base fiberboard sections 390*b*. In addition, each of the base fiberboard end sections 390*c* include a pair of transverse adhesive strips 413 preapplied thereto.

Figure 62:
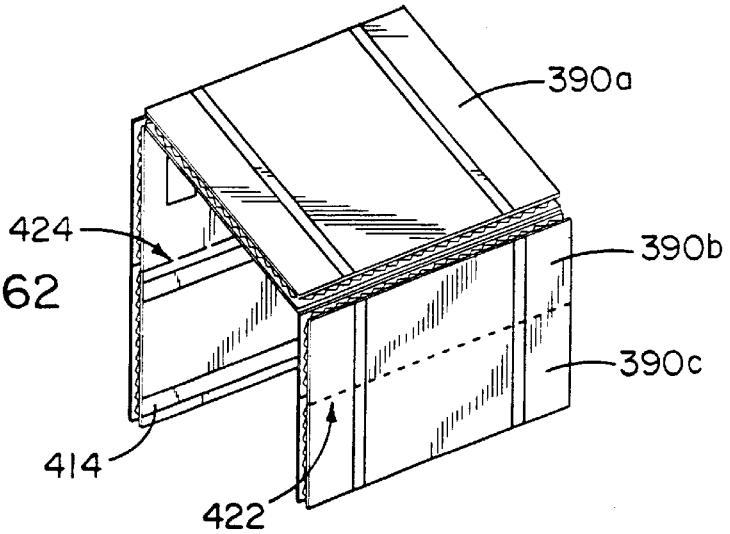
Figure 63:
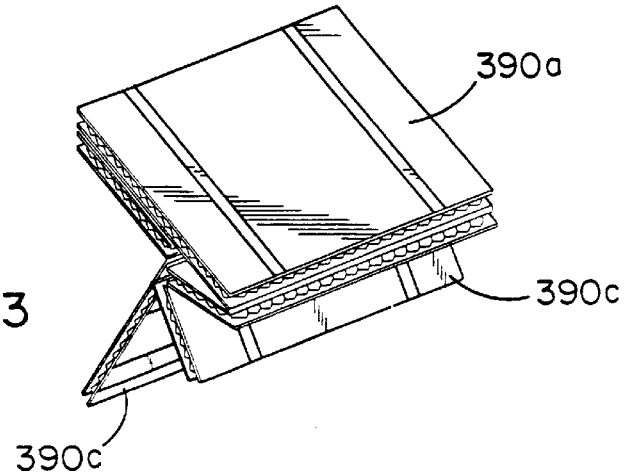
Figure 64:
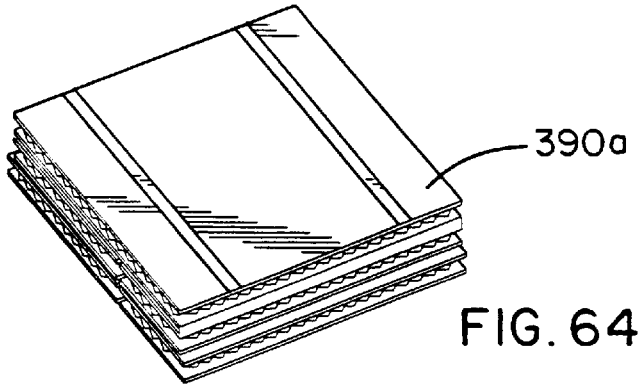
Figure 65:
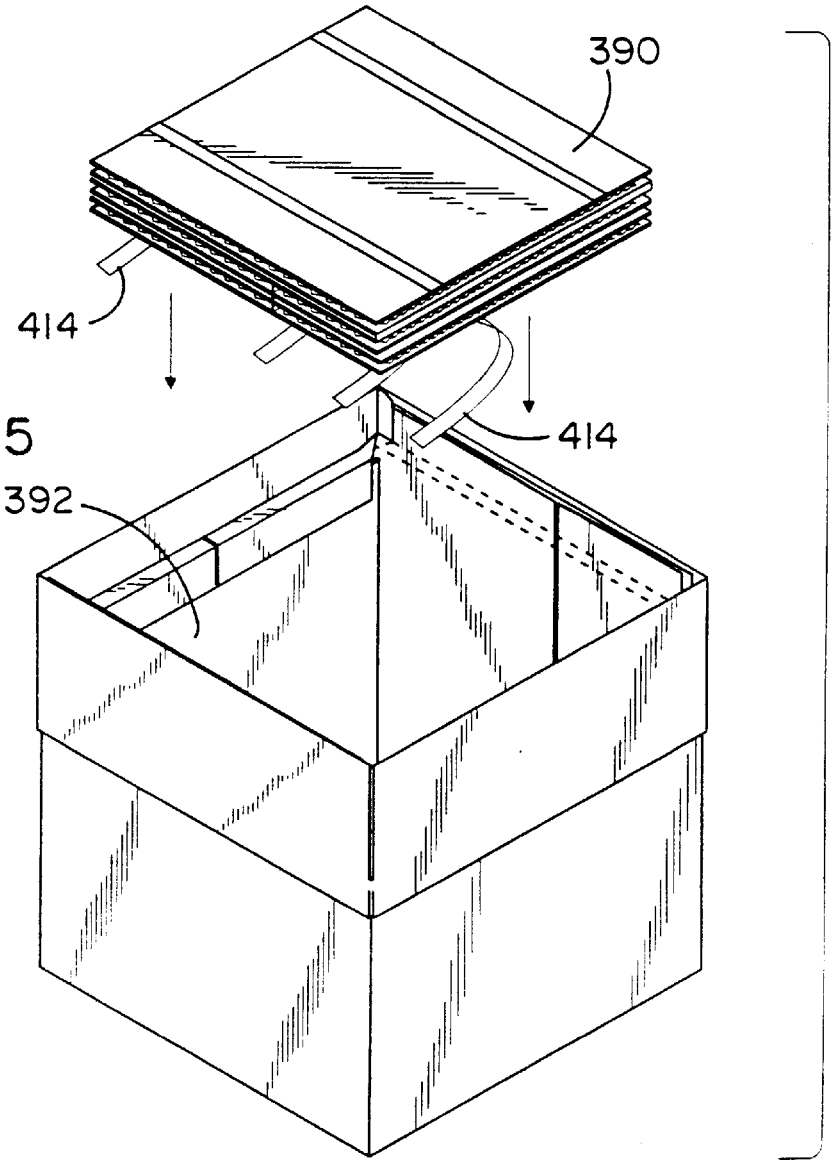

To bend or collapse the reinforcing base fiberboard 390 for preassembly into the container outer body portion 322 in its transport orientation, the base fiberboard intermediate sections 390*b* on either side of central section 390A are folded down so as to rupture the top sheet 426 along the perf lines 424 in the top sheet 426 and with the bottom sheet 428 folded about corresponding fold lines 422 on either side of the central section 390*a*, as shown in FIG. 62. Thereafter, the base fiberboard end sections 390*c* are bent or collapsed relative to the intermediate sections 390*b* by folding about the fold lines 422 therebetween in the top sheet 426 and rupturing the bottom sheet 428 about the corresponding perf lines 424 formed therein, as shown in FIG. 63. With the reinforcing base fiberboard 390 so collapsed, the portion of the bottom sheet 428 on the intermediate sections 390*b* will be brought into engagement with the portion of the bottom sheet 428 on the intermediate sections 390*b* will be brought into engagement with the portion of the bottom sheet 428 on the central section 390*a* and the portions of the top sheet on the intermediate sections 390*b* and the end sections 390*c* will be brought into engagement with each other, as illustrated in FIG. 64. The dimensions of the two intermediate sections 390*b* and the two end sections 390*c* substantially correspond to that of the central section 390*a* so that when the reinforcing base fiberboard 390 is collapsed for preassembly, all the edges of the various sections 390*a–c* will be aligned and will substantially correspond to the combined outer peripheral edge dimensions of the outer body portion base sections 336*c* less the thickness of the reinforcing end fiberboards 392 preassembled in the outer body portion 322 in its transport orientation. In this manner, the collapsed base fiberboard 390 can be set into the outer body portion 322 for preassembly to the exposed outer body portion base sections 336*c*.

Figure 66:
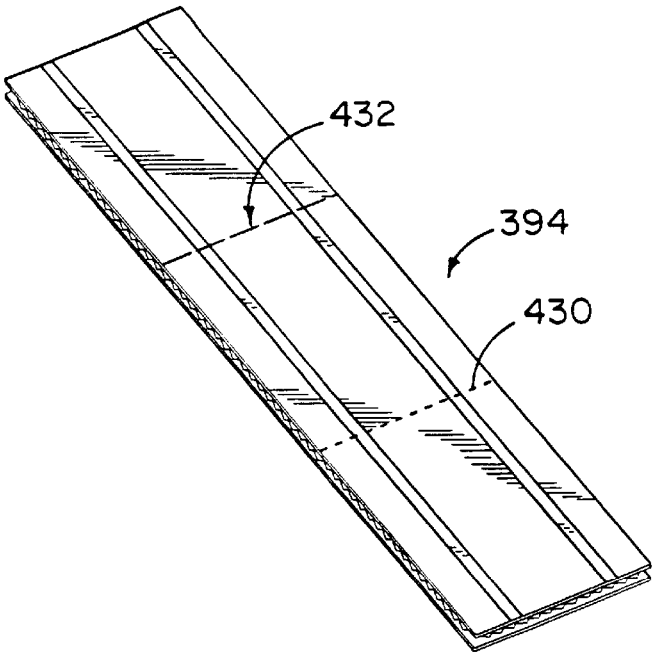
FIGS. 66–68 are perspective views of one of the reinforcement side fiberboards being folded for transport in the transport container.
Figure 67:
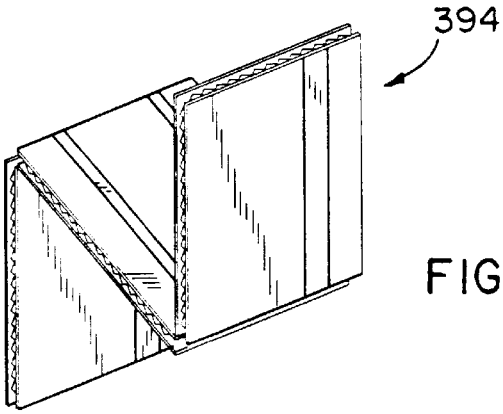
Figure 68:
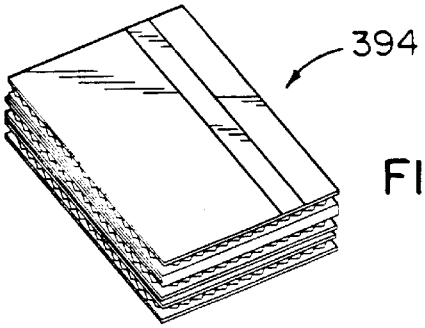
Figure 69:
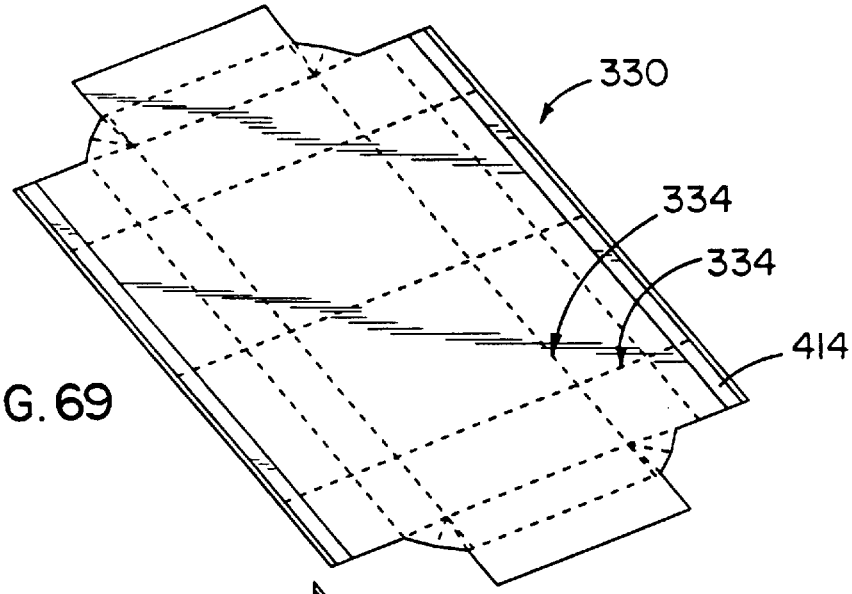
FIGS. 69–74 are perspective views of the fluid containment panel being folded for transport in the transport container.
Figure 70:
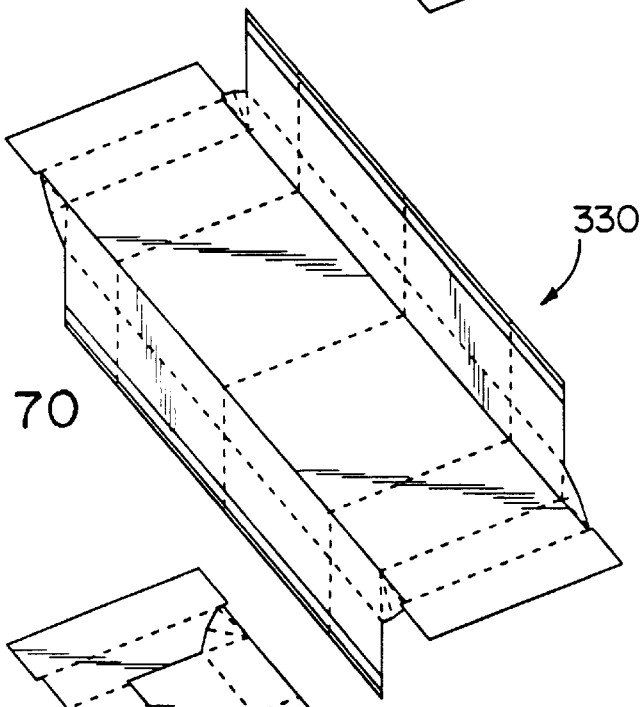
Figure 71:
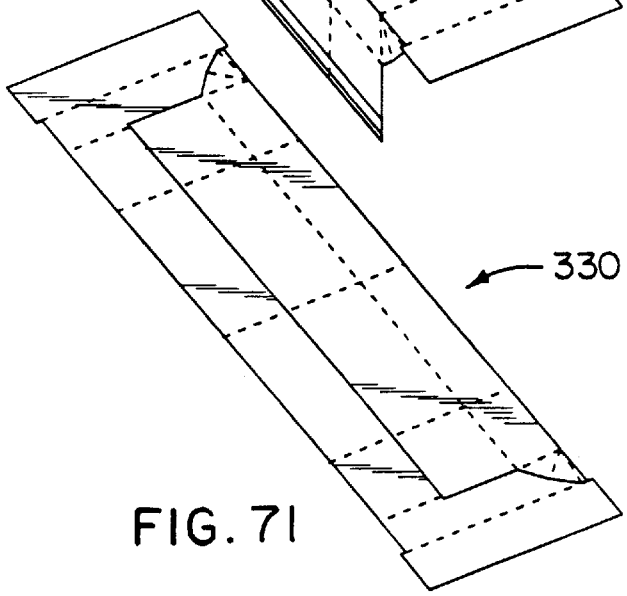
Figure 72:
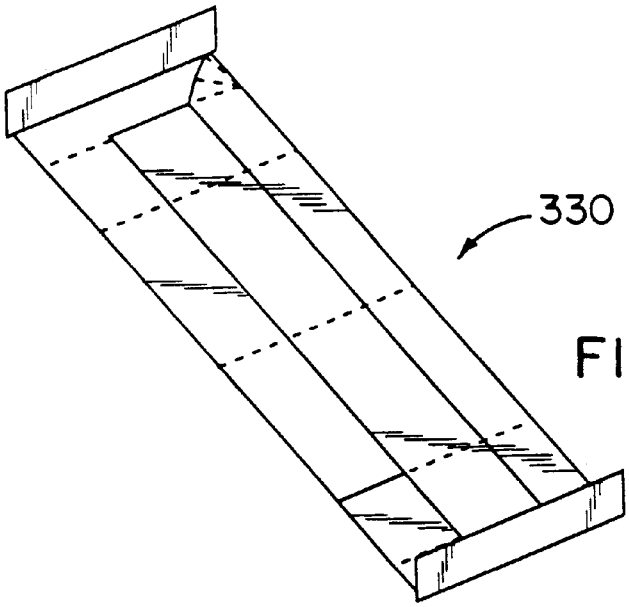
Figure 73:
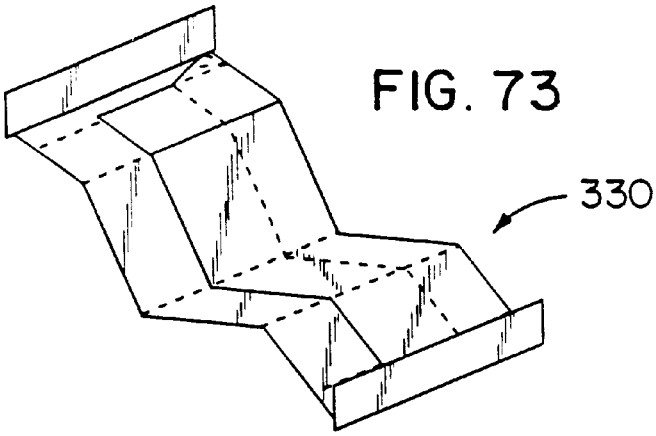
Figure 74:
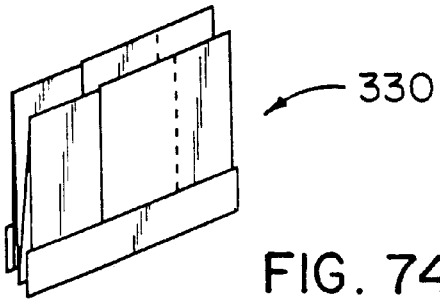

With the reinforcing base fiberboard 390 collapsed, portions of the bottom sheet 428 on the end sections 390*c* including the transverse adhesive strips 413 and covering release tape or strips 414 thereover will be exposed for attaching the base fiberboard 390 to the outer body portion base 336. Peeling the release strips 414 off the bottom sheet portions of the fiberboard sections 390*c* exposes the transverse adhesive strips 413 thereunder so as to adhere the fiberboard sections 390*c* to outer body portion base sections 336*c* when the reinforcing fiberboard 390 is set in the outer body portion 322 in its transport orientation on the base sections 336*c* thereof. Accordingly, with the reinforcing end fiberboards 392 already assembled to the outer body portion end walls 342 and 344 and the reinforcing base fiberboard 390 substantially preassembled to the outer body portion base 336, when undertakers remove the outer body portion 322 from the transport container 320, all they need to do is to expand the outer body portion 322 back to its operative orientation by folding it open about its respective bend lines 368 with the reinforcing base fiberboard 390 folding open about its respective fold lines 422 and perf lines 424. All the undertaker needs to do to complete the assembly is to attach the remainder of the base fiberboard sections 390*a* and 390*b* to the outer body portion base sections 336*a* and 336*b*, attach the side fiberboards 394 in the outer body portion 322, assemble the fluid containment portion 324 and attach it into the outer body portion 322, and assemble the large lid section 316. Once the outer body portion 322 is bent or collapsed to its predetermined transport orientation and placed in the transport container 320 with the end fiberboards 392 and the base fiberboard 390 preassembled thereto, the remainder of the various parts of the container assembly 300 can be packed into the compact transport container 320. Specifically, the side fiberboards 394 similar to the base fiberboard 390 are provided with transverse fold lines 430 and perf lines 432 for being folded up into a compact fashion to be placed in the transport container 320, as shown in FIGS. 66–68. The fluid containment panel 330 can also be folded up into a small compact form about its fold lines 334, as depicted in FIGS. 69–74, to be placed in the transport container 320.

Figure 117:
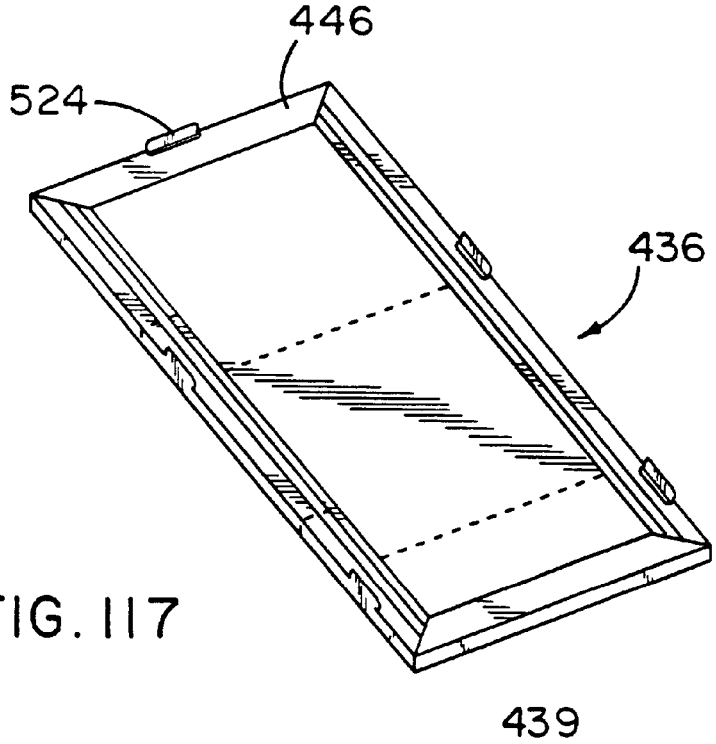
Figure 118:
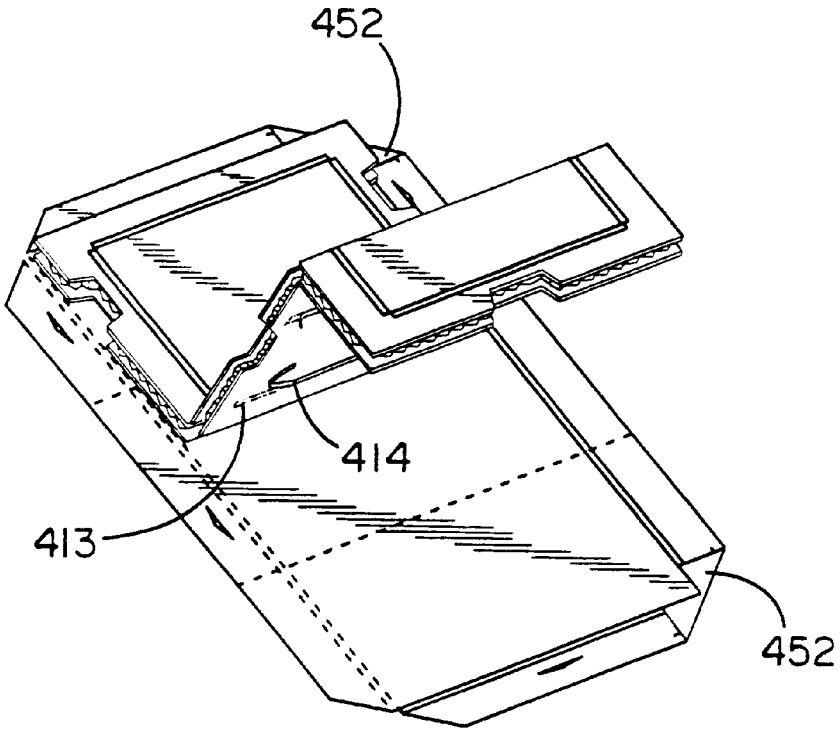
FIGS. 118–120 are perspective views of the assembly of the outer lid portion of the large lid section.
Figure 119:
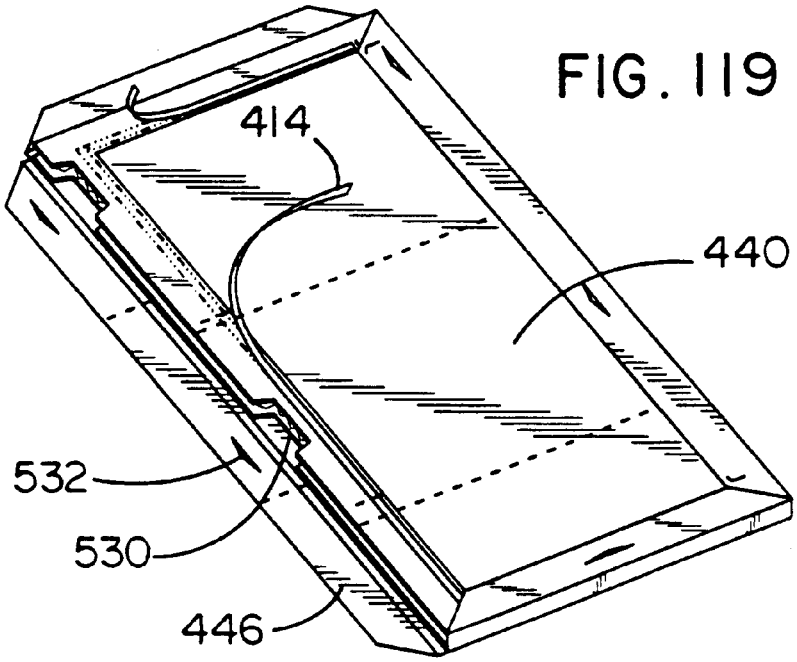
Figure 120:
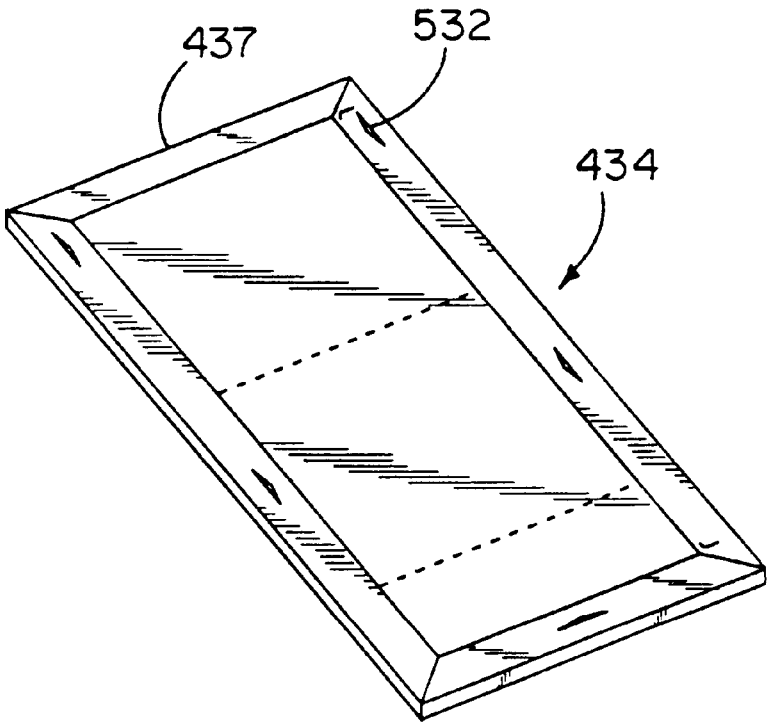
Figure 121:
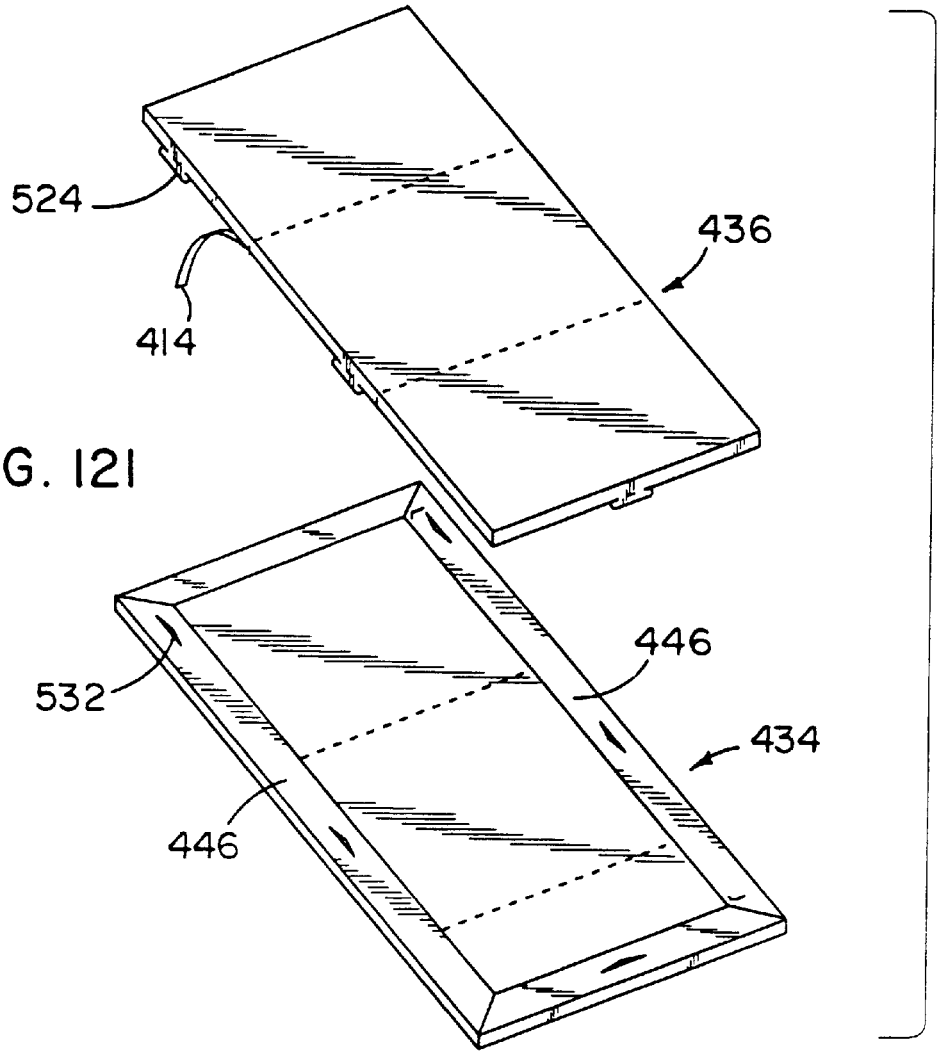
FIGS. 121 and 122 are perspective views of the assembly of the large lid section's inner and outer lid portions to form the large lid section.
Figure 122:
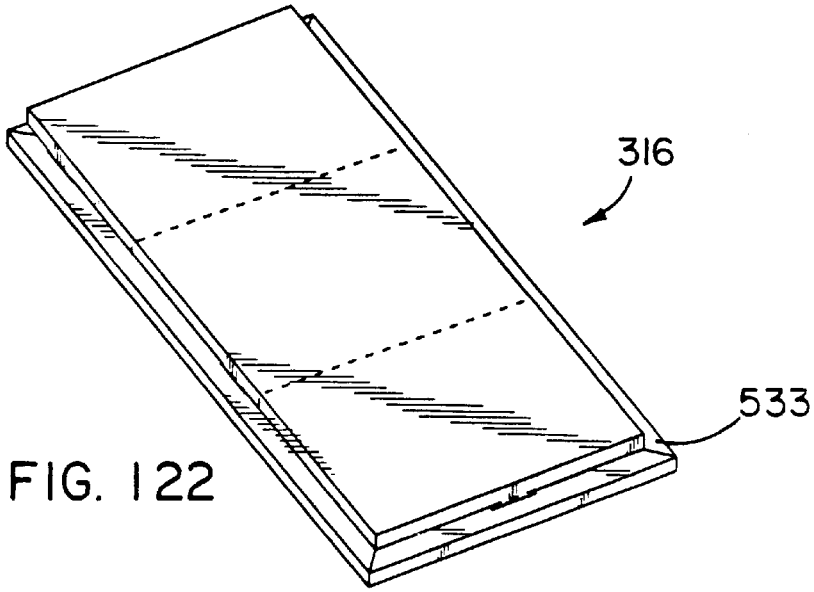

The components used for assembly of the large lid section 316 are also folded up and placed in the transport container 320. For the large lid section 316, a large lid section outer portion 434 (FIG. 120) is attached to a large lid section inner portion 436 (FIG. 117), as will be described more fully hereinafter. The large lid section outer portion 434 is formed from an outer portion panel 438 of fiberboard material and a reinforcing fiberboard 440 which is to be attached thereto (FIGS. 75–77). The outer portion panel 438 includes transverse folding or bending lines 442 and transverse and longitudinal pairs of flap fold lines 444 which extend around the periphery of the outer portion panel 438 to define side flap sections 446 and end flap sections 448 on the panel 438. Along one side of the panel, bevelled corners 450 are provided between the end flaps 448 and one of the side flaps 446. At the corners between the other side flap 446 and end flaps 448, locating corner tabs 452 are formed by oblique perf lines 454 for detachment of the corner tabs 452 once the reinforcing fiberboard 490 is properly located and attached to the outer portion panel 438.

Figure 85:
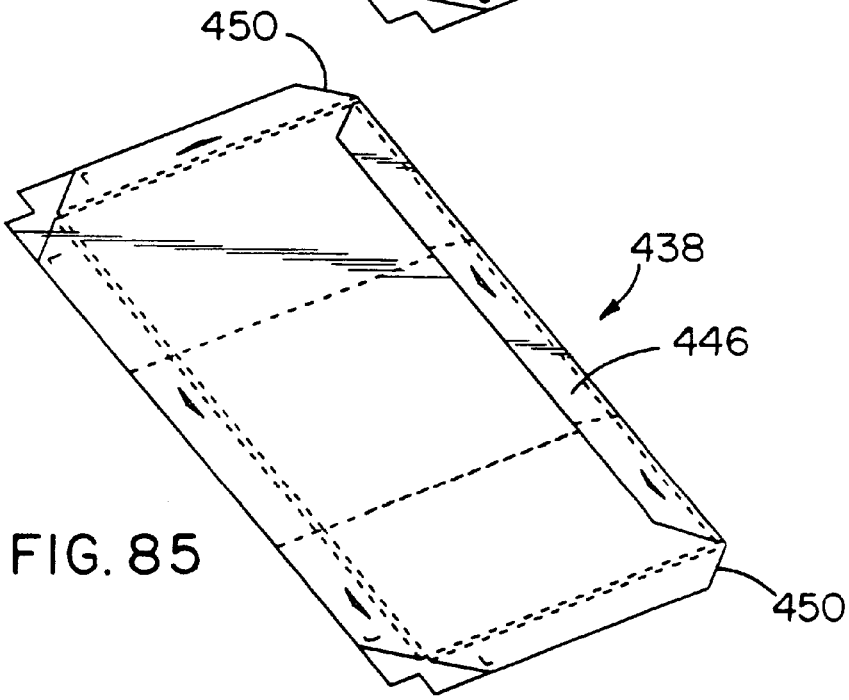
Figure 86:
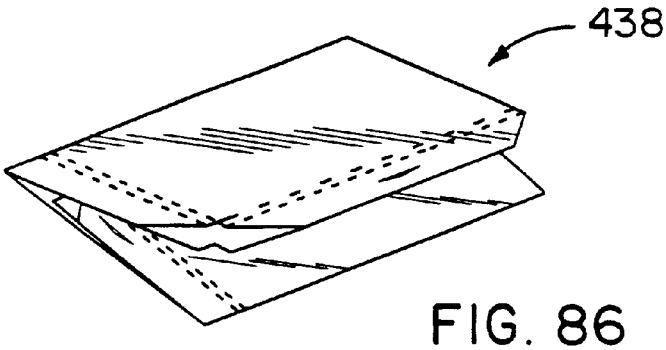

To fold the outer portion panel 438 for transport in transport container 320, the side flap 446 extending between the bevelled corners 450 can be folded over the outermost longitudinal flap fold line 444 in the pair adjacent thereto, as shown in FIG. 85. Thereafter, the panel 438 can be folded up about the transverse bend lines 442 so that it is in a compact form, as shown in FIG. 86, for placement into the transport container 320.

Figure 81:
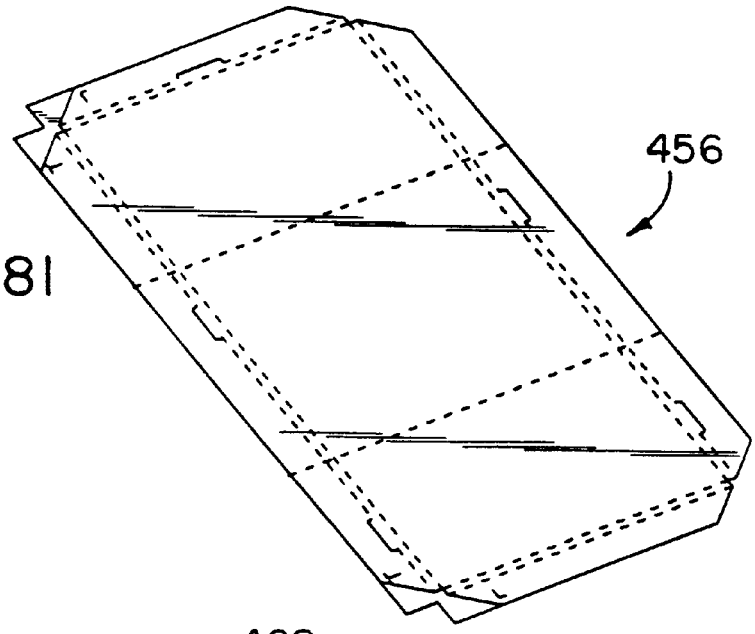
FIGS. 81–86 are plan views of the lid inner and outer portion panels for the large lid section being folded for transport in the transport container.
Figure 82:
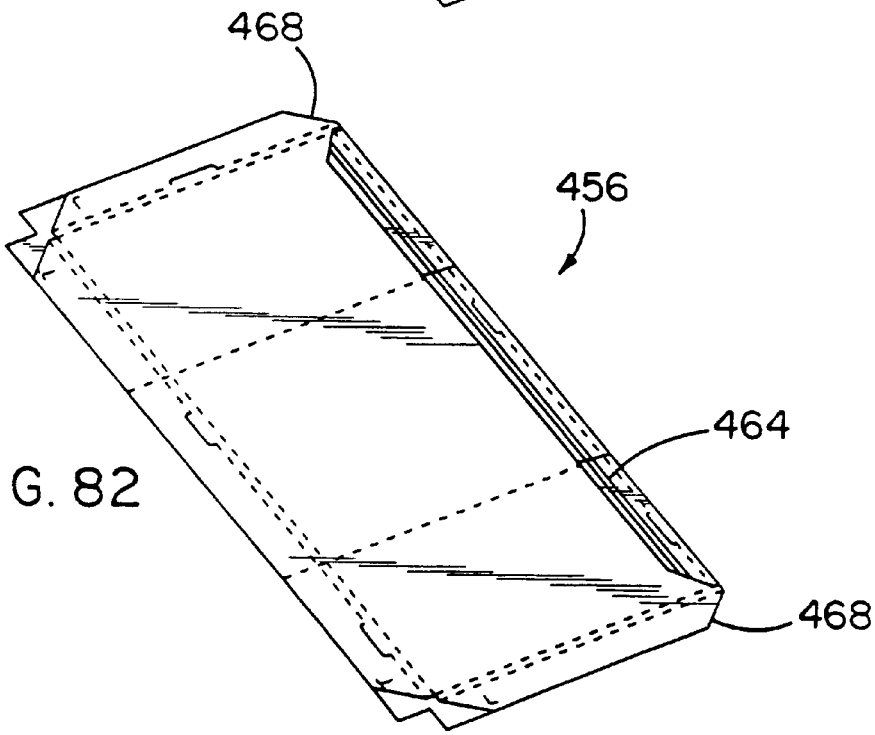
Figure 83:
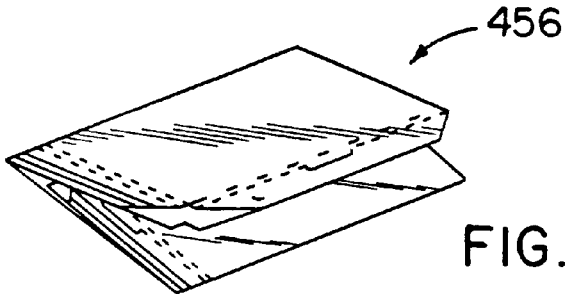
Figure 84:
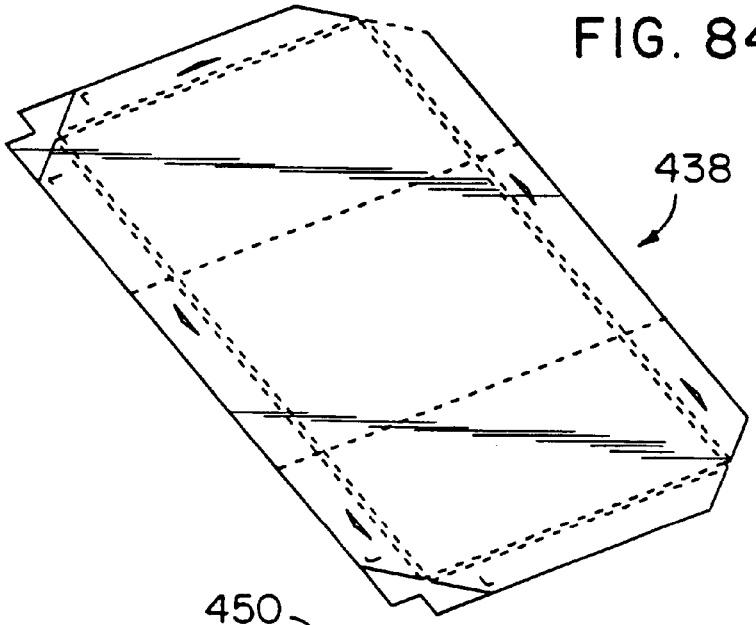

The large lid section inner portion 436 is constructed similar to the large lid section outer portion 434 from an inner portion panel 456 and a inner portion reinforcing fiberboard 458 for being attached to the panel 456, as will be more fully described hereinafter. The inner portion panel 456 includes a pair of transverse bend lines 460 and transverse and longitudinal pairs of flap fold lines 462 extending around the panel periphery to define opposite side flaps 464 and end flaps 466. The corners 468 along one side of the inner portion panel 456 are bevelled while the corners along the opposite side include locating corner tabs 470 defined by oblique perf lines 472. The inner portion panel 456 is folded in a similar manner to the outer portion panel 438 for transport in transport container 320, as can be seen by reference to FIGS. 81–83.

Figure 87:
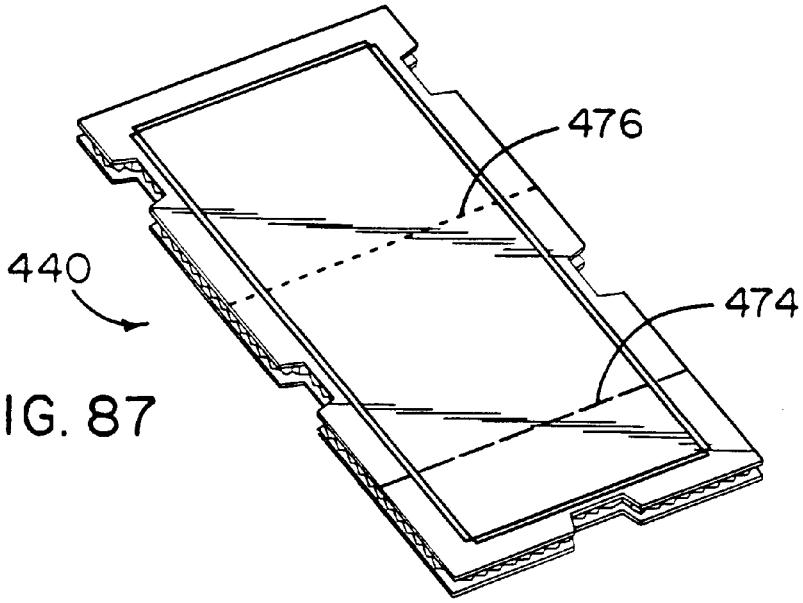
FIGS. 87–92 are plan views of the reinforcing fiberboards for the outer and inner lid panels for the large lid section being folded for transport in the transport container.
Figure 88:
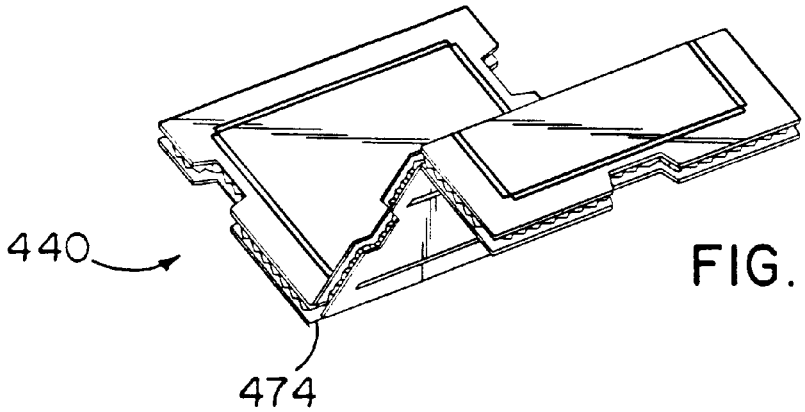
Figure 89:
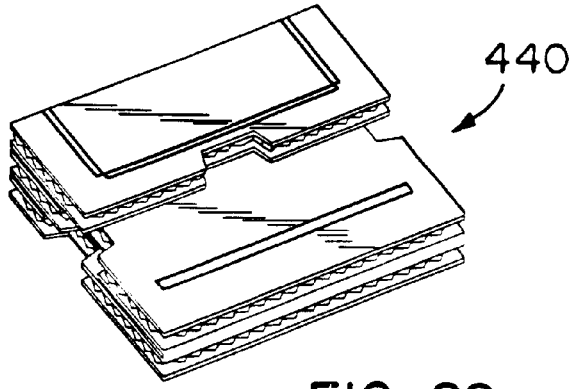
Figure 90:
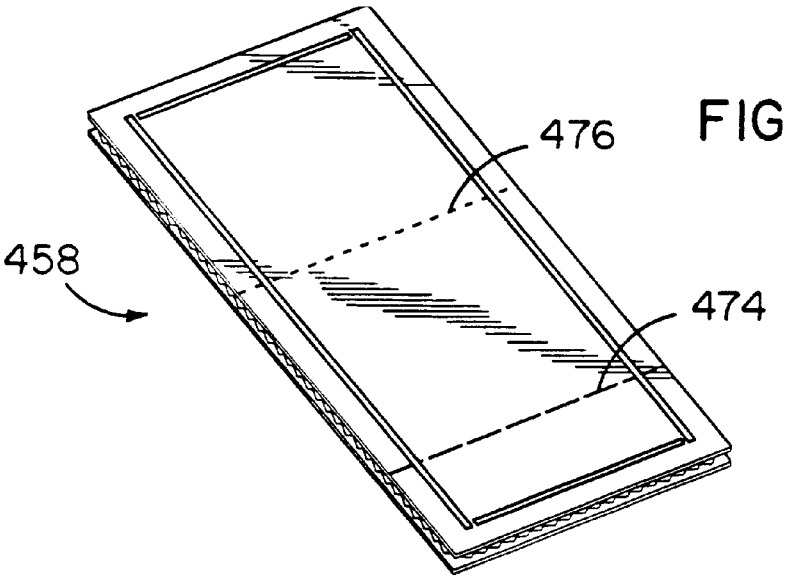
Figure 91:
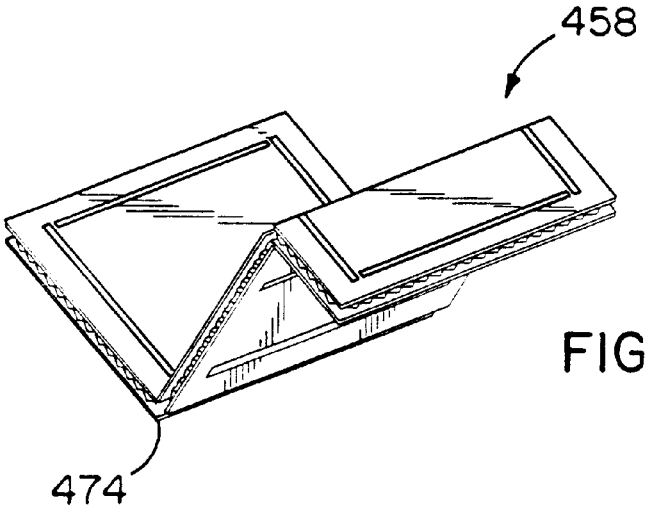
Figure 92:
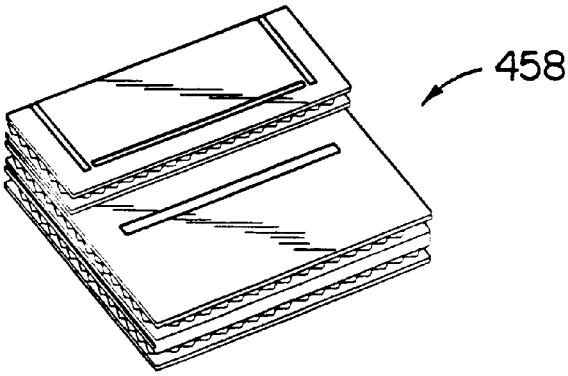
Figure 93:
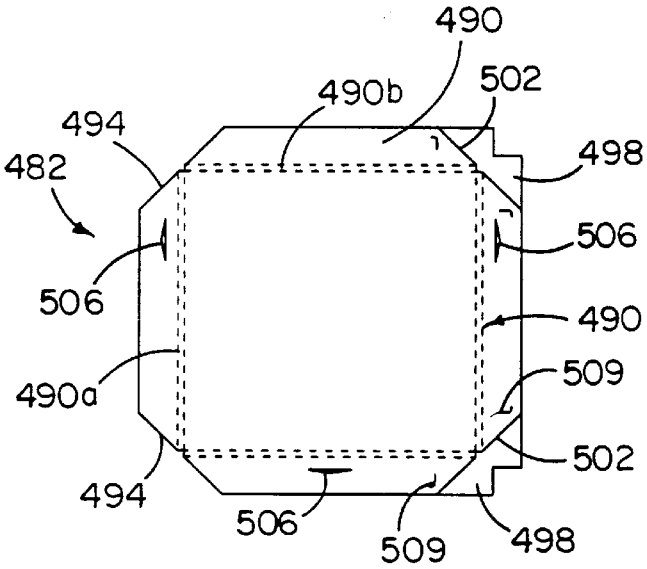
FIGS. 93 and 94 are plan views of a lid outer portion panel and a reinforcing fiberboard for being attached to the panel to form an outer lid portion for the small lid section.
Figure 94:
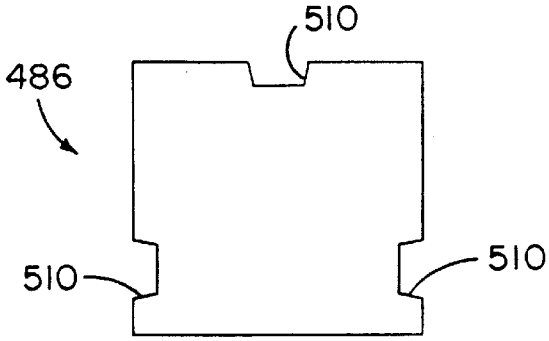
Figure 96:
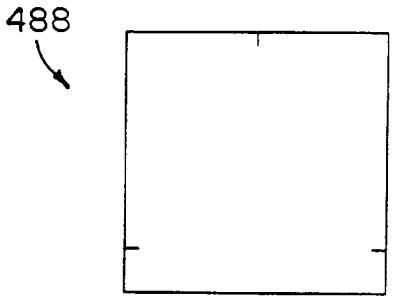
FIGS. 95 and 96 are plan views of a lid inner portion panel and a reinforcing fiberboard for being attached thereto to form an inner lid portion for the small lid section.
Figure 95:
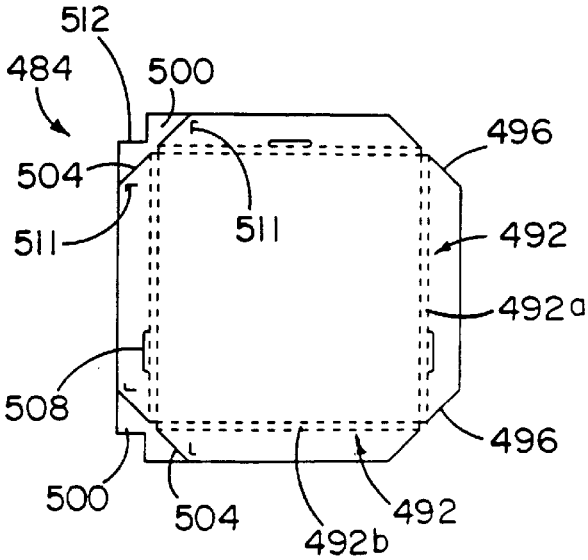

Turning next to the folding of the reinforcing fiberboard panels 440 and 458 utilized in the assembly of the large lid section 316, the reinforcing fiberboard 440 has a transverse perf line 474 and a transverse fold line 476 on its top sheet and a transverse fold line 476 and a transverse perf line 474 on the bottom sheet aligned with the perf line 474 and fold line 476, respectively, on the top sheet, as seen in FIGS. 76 and 77. The reinforcing fiberboard 458 has perf lines 474 and fold lines 476 on its respective top and bottom sheets oriented in a similar fashion to that of the fiberboard panel 440, as seen in FIGS. 79 and 80. The fiberboard 440 is folded for transport, as depicted in FIGS. 87–89, with folding occurring about its fold lines 476 and rupturing of the sheets occurring about the perf lines 474. The fiberboard 458 is folded in a similar manner to the fiberboard 440 for transport, as can be seen in FIGS. 90–92.

To complete the packing of transport container 320, the small lid section 318 is assembled with such assembly being similar to that of the large lid section 316 in that there is a small lid section outer portion 478 which is attached to a small lid section inner portion 480. The inner portion 480 is smaller than the outer portion 478 to form a lip 479 around three sides of the smaller inner portion 480 for resting on the top ends of the container body sides 306 and ends 308 with the inner portion 480 extending into the container interior 314.

The outer and inner portions 478 and 480 are formed from respective panels 482 and 484 and reinforcing fiberboards 486 and 488 attached thereto. The outer portion panel 482 includes respective pairs of flap fold lines 490 extending along each side of the panel 482. Similarly, the inner portion panel 484 includes pairs of flap fold lines 492 extending along the sides thereof. Both the outer portion and inner portion panels 482 and 484 each include a pair of bevelled corners 494 and 496, respectively, and have a pair of locating corner tabs 498 and 500 at their other corners formed by oblique perf lines 502 and 504, respectively. The outer portion panel 482 includes slots 506 in three of the four flaps formed around its periphery by the flap fold lines 490 with the slots 506 being spaced outwardly from the outermost flap fold line 490*a*. The inner portion panel 484 includes tab sections 524 formed in three of its four flaps defined by flap fold lines 492 to correspond with the three flaps of the outer portion panel 482 having slots 506 therein with the tab sections 524 being defined by perf lines extending from and back to the outermost fold line 492*a* of the pairs of flap fold lines 492. In addition, the outer portion and inner portion panels 482 and 484 include pairs of small right-angle die cuts 509 and 511, respectively, on the flaps adjacent to the locating corner tabs 498 and 500.

The reinforcing fiberboard 486 for the small lid section outer portion 478 has dimensions about its outer edges substantially the same as that circumscribed by the inner flap fold lines 490*b* of the pairs of flap fold lines pairs 490 formed on the outer portion panel 482. Similarly, the reinforcing fiberboard 488 for the small lid section inner portion 480 has dimensions similar to that circumscribed by the inner flap fold line 492*b* of the flap fold line pairs 492 formed around the inner portion panel 484. The reinforcing fiberboard 486 is also provided with notches 510 along three of its sides to correspond with the three flaps including the slots 506 on the outer portion panel 482.

To form the small lid section inner portion 480, the locating corner tabs 500 are folded over about their associated perf lines 504 and back onto the panel. The corner tabs 500 include small right-angle notches 512 so that when they are folded back down onto the panel 484, the edges of the notches 512 will be substantially aligned over the corner junction of the two adjacent innermost flap fold lines 492*b*, as best seen in FIG. 97. To hold the locating corner tabs 500 down, the material of the panel at the die cuts 511 can be resiliently lifted from the plane of the panel 484 and then released to rebound into engagement with the sides of the corner tabs 500 to hold them in place. Strips of adhesive 416 can be manually applied on the panel 489 between the inner flap fold lines 492*b*. Thereafter, the reinforcing fiberboard 488 can be placed on the panel 484 and located by placing corners thereof against the edges of the locating corner tab right-angle notches 512, as shown in FIG. 98. Adhesive strips 416 can then be applied to the flaps and the locating corner tabs 500 detached from the panel 484 with the flaps then being folded over about the flap fold lines 492 onto the exposed surface of the reinforcing fiberboard 488. As a consequence of folding the flaps about the fold lines 492, the tab sections 508 will break from the flap sections along their perf lines to project at right angles from the flaps folded over onto the reinforcing fiberboard 488.

Figure 100:
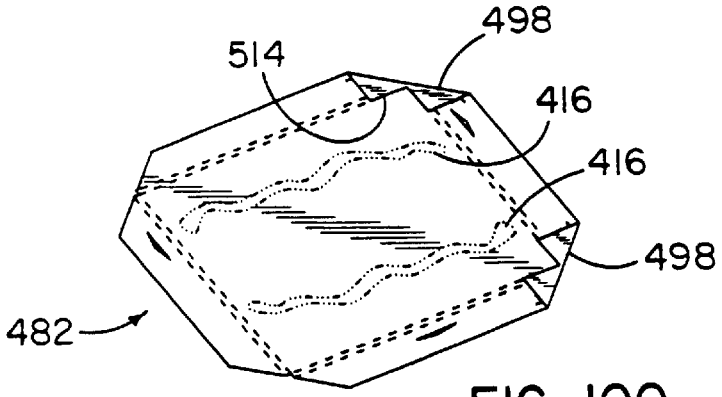
FIGS. 100–102 are perspective views of the assembly of the outer lid portion of the small lid section.
Figure 101:
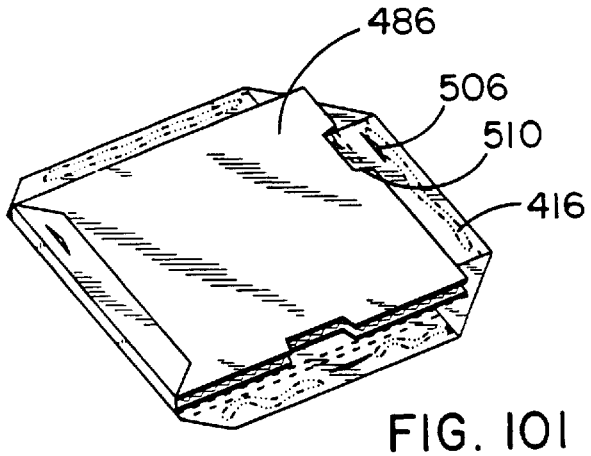
Figure 102:
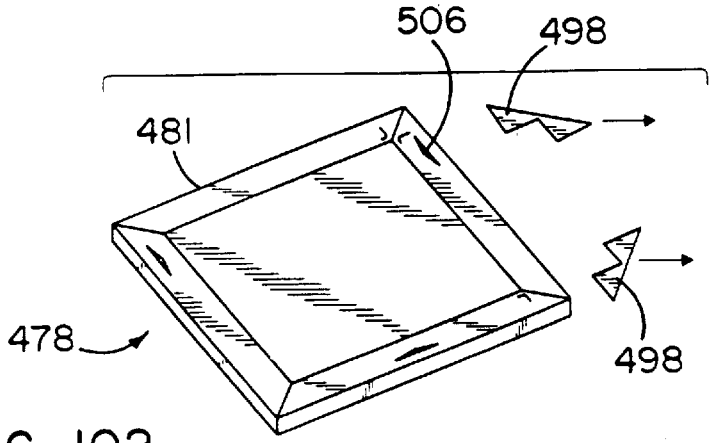
Figure 103:
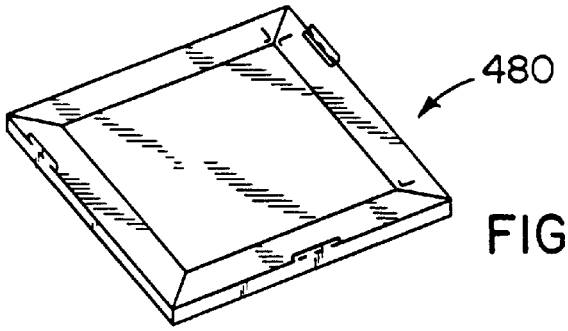
FIGS. 103–105 are perspective views of the assembly of the small lid section's inner and outer lid portions to form the small lid section.
Figure 104:
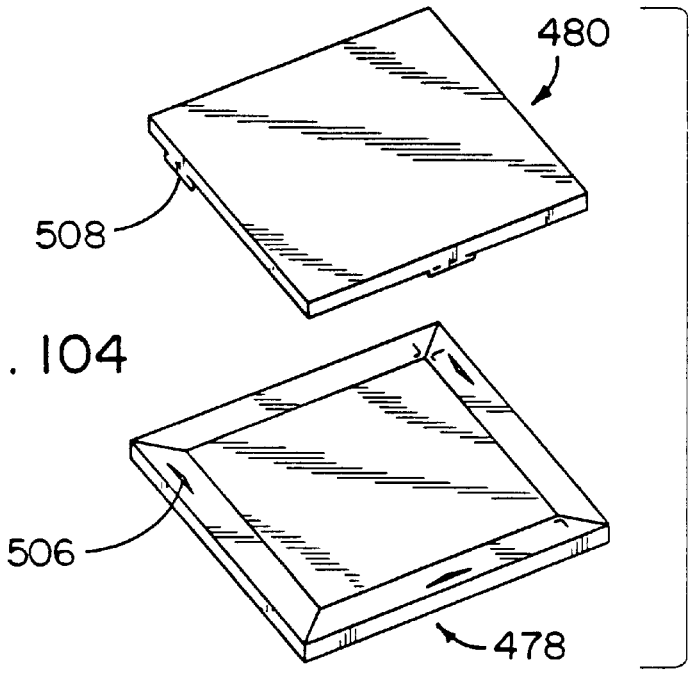
Figure 105:
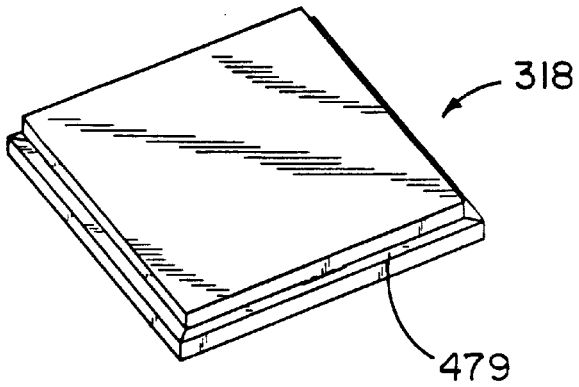
Figure 106A:
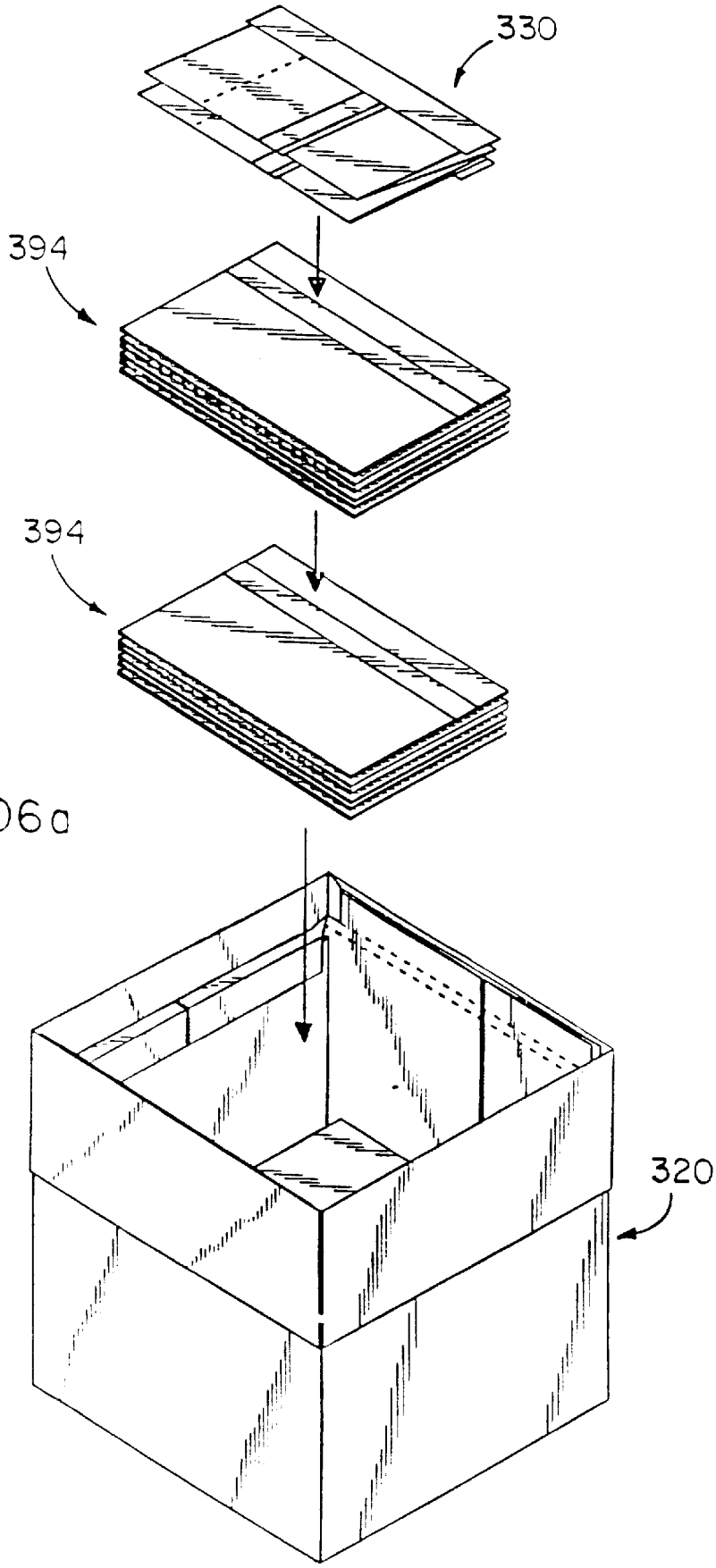
FIGS. 106A and 106B taken together is a perspective view showing the packing of the folded panels, fiberboards and the completed small lid section into the transport container having the partially preassembled outer body portion bent into its transport orientation therein.
Figure 106B:
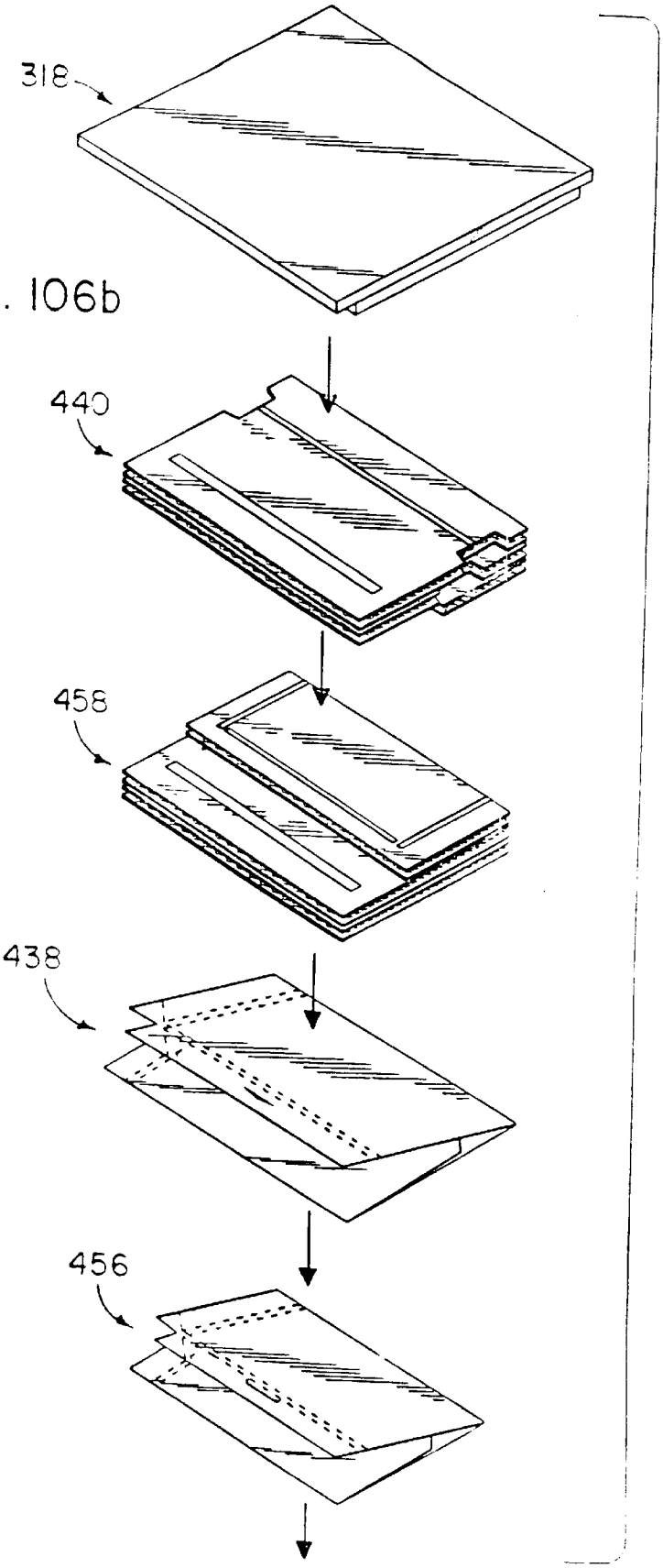

The small lid section outer portion 478 is formed in much the same manner as the above-described assembly of the inner portion 480. Referring to FIGS. 100–102, first the locating corner tabs 498 are folded over their respective perf lines 502 down onto the panel 482 such that the right-angle notches 514 are aligned over the innermost flap fold lines 490*b* with the die cuts 509 utilized to hold the folded over corner tabs 498 in place. Next, strips of adhesive 416 are manually applied to the panel 482 between the inner fold lines 490*b* and the reinforcing fiberboard 486 is placed on the panel 482 over the strips of adhesive 416 thereon with the notches 510 aligned across from the slots 506 in the flaps of the panel 482. Finally, adhesive 416 is applied to the flaps and the locating corner tabs 498 are detached from the panel 482 with the flaps then being folded over onto the exposed surface of the reinforcing fiberboard 486 to be adhered thereto. The spacing of the slots 506 from the outermost flap fold line 490*a* is such that when the flaps are folded over onto the exposed surface of the reinforcing fiberboard 486, the slots 506 will be aligned over the reinforcing fiberboard notches 510. In addition, the small lid section outer and inner portions 478 and 480 are sized such that when the inner portion 480 is centered over the outer portion 478, as shown in FIG. 104, the tab sections 508 will be aligned with the slots 506 so that the tabs 508 can be inserted into the slots with clearance being provided thereunder by the fiberboard notches 510 so as to frictionally retain the outer and inner lid portions 478 and 480 attached together to form the small lid section 318, as shown in FIG. 105. The flaps of the small lid section outer and inner portions 478 and 480 which do not include respective slots 506 and tabs 508 when folded over form abutment edges 481 and 483 which are aligned with each other when the lid portions 478 and 480 are attached so that the lip or shoulder 479 extends only around three of the sides of the small lid section 318. The small lid section 318 is sized sufficiently small so that it can be fit into the transport container 320 along with the folded-up reinforcement fiberboards 394, 440 and 458, the folded-up fluid containment panel 330 and the folded-up large lid section outer and inner portion panels 438 and 456, as can be seen in FIGS. 106*a* and 106*b*. Accordingly, the container assembly 300 can be fit in a relatively compact transport container 320 thus saving space and costs in shipping and transport of the container assembly 300 herein.

Figure 107:
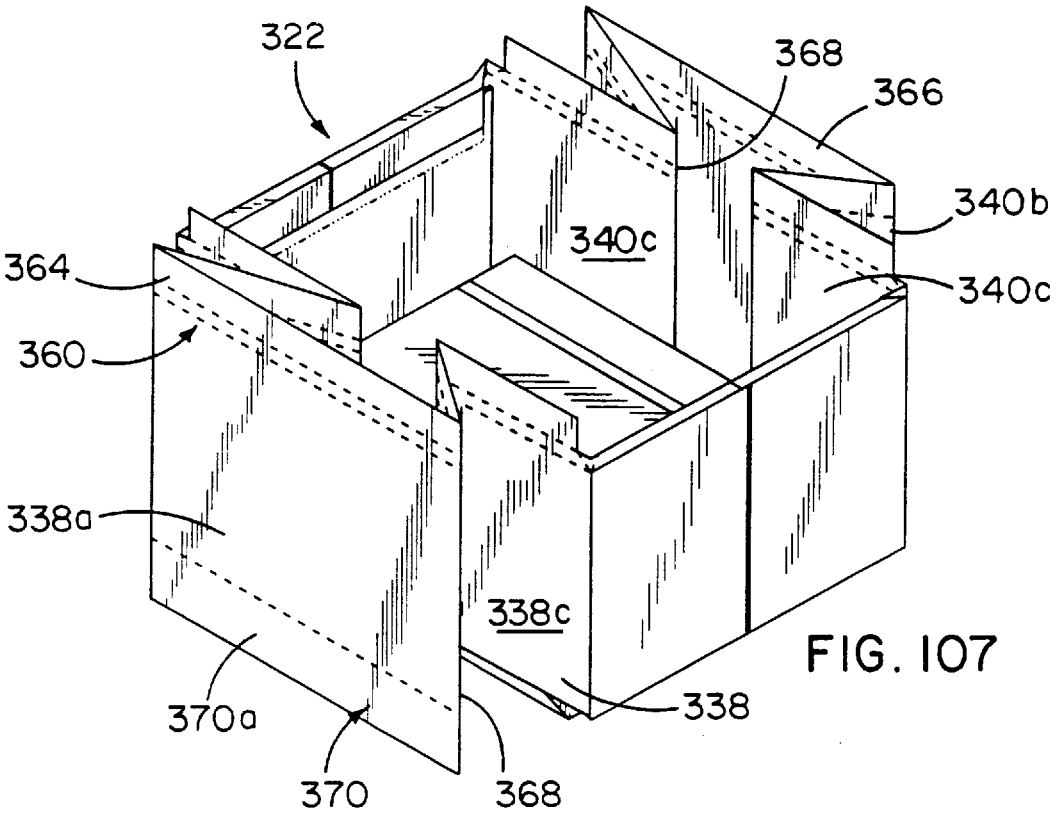
FIGS. 107 and 108 are perspective views of the container outer body portion being bent open from its predetermined transport orientation and having the reinforcing end boards and base board substantially preassembled therein.
Figure 108:
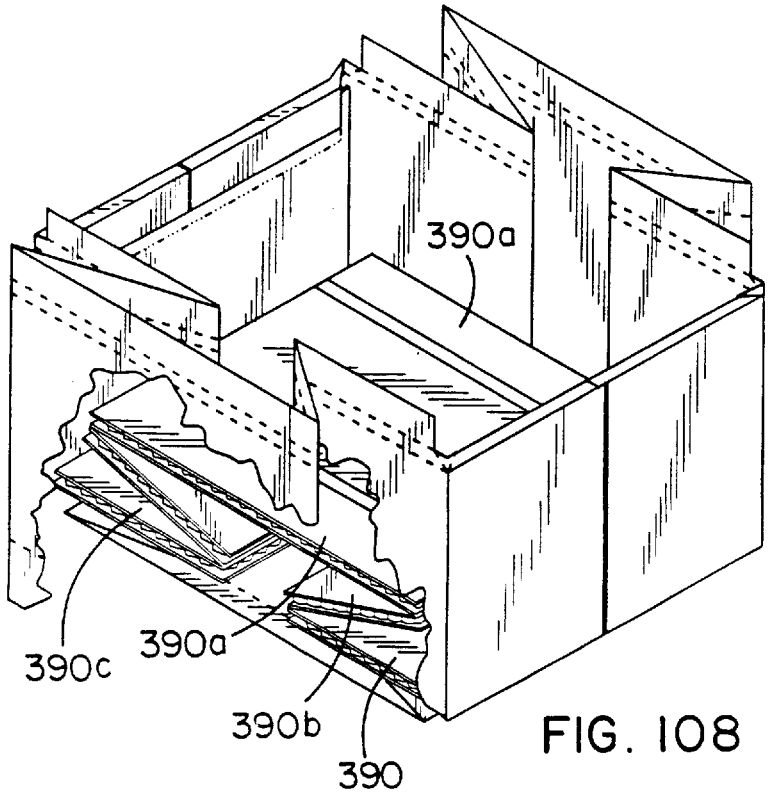
Figure 109:
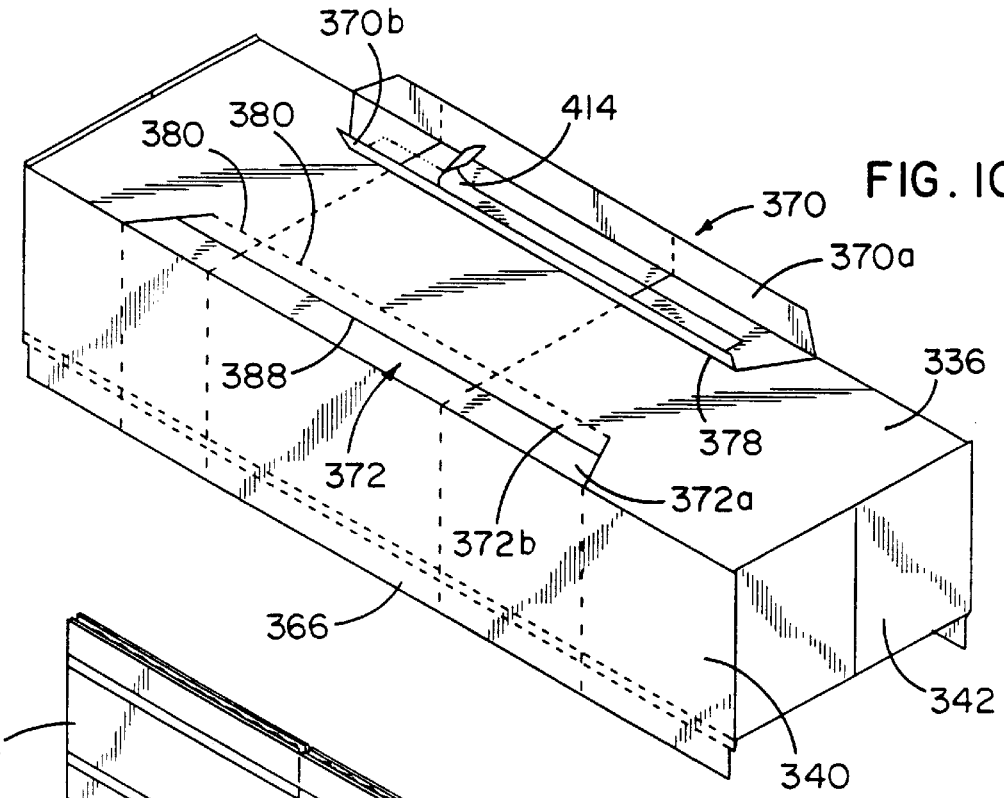
FIG. 109 is a perspective view of the container outer body portion folded out to its predetermined operative orientation and showing the base thereof including access flaps for completing the attachment of the base reinforcing fiberboard to the base of the outer body portion.

In addition, the partial preassembly of the main container body 302 in the transport container 320 also simplifies and saves time in the assembly process. With the outer body portion 322 including the reinforcing base fiberboard 390 and end fiberboard 392 attached thereto, the outer body portion 322 can be expanded back to its operative orientation from its smaller transport orientation, as shown in FIGS. 107–109. As the ends 308 of the outer body portion 322 including the reinforcing end fiberboards 392 attached thereto are moved away from each other, the sidewalls 338 and 340 of the outer body portion 322 will open about the transverse bend lines 368 between the sidewall sections 338*a–c* and 340*a–c* and the base 336 of the outer body portion 322 will similarly open about the transverse fold lines 368 between the base sections 336*a–c*. As previously discussed, the reinforcement base fiberboard 390 has the portions of its bottom sheet 428 on the end sections 390*c* attached to the upper surface of the end sections 336*c* of the outer body portion base 336. Accordingly, as the outer body portion base 336 is opened and expanded by movement of the outer sections 336*c* thereof away from each other, the folded-up reinforcement base fiberboard 390 will likewise expand about its fold and perf lines 422 and 424 due to the attachment between the base fiberboard sections 390*c* and the moving outer body portion base sections 336*c*, so that the remainder of the bottom sheet 428 on the center and intermediate sections 390*a* and 390*b* of the base fiberboard 390 will be substantially over central and intermediate sections 336*a* and 336*b* of the outer body portion base 336.

To attach the bottom sheet 428 on the central and intermediate sections 390*a* and 390*b* of the reinforcing base fiberboard 390 to the top of the central and intermediate portions 336*a* and 336*b* of the outer body portion base 336, the expanded outer body portion 322 is turned over, as shown in FIG. 109. The portions 370*a* and 372*a* of the access flaps 370 and 372 will be opened relative to the reinforcement base fiberboard 390 and the portions 370*b* and 372*b* can be bent back about their fold lines 378 and 380, respectively, so as to fully expose the release tape 414 which extends along the reinforcement base fiberboard central and intermediate sections 390*a* and 390*b*. The release tape 414 can be peeled from the base fiberboard 390 and the access flaps 370 and 372 can be folded back down onto the exposed adhesive strips 413 under the peeled off release tape 414 to adhere the flaps 370 and 372 back onto the base fiberboard 390 to complete the assembly of the reinforcing base fiberboard 390 to the outer body portion base 336.

Figure 110:
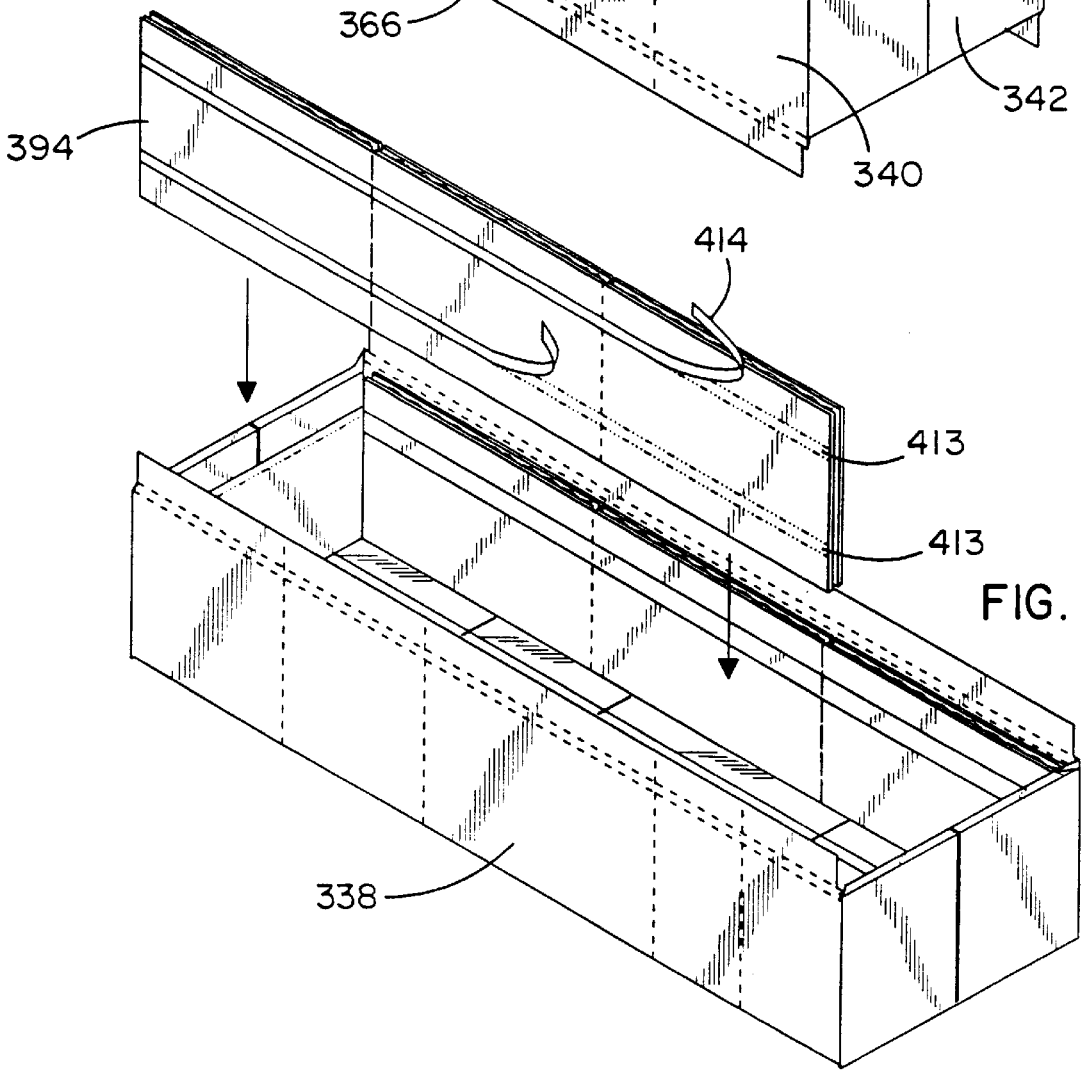
FIG. 110 is a perspective view of the assembly of the side reinforcing fiberboards into the outer body portion.

After the base fiberboard 390 is completely attached in the outer body portion 322, the reinforcing side fiberboards 394 can be attached to the outer body portion sidewalls 338, as shown in FIG. 110. To attach the reinforcing side fiberboards 394, the side of the boards 394 having the two parallel adhesive strips 413 are arranged to face towards the outer body portion sidewalls 338 and 340 and the opposite side of the reinforcing side fiberboards 394 having the single adhesive strip 413 are arranged to face towards the interior 314 of the container with the adhesive strip 413 arranged towards the upper end of the side fiberboard 394 as attached to the sidewalls 338 and 340. With the reinforcing side fiberboards 394 attached in the outer body portion 322, the release tape 414 on the top sheet 424 of the reinforcing base fiberboard 390 can be peeled to expose the adhesive strips 413 thereunder for attaching the fluid containment portion 324 folded to its operative orientation in the outer body portion 322 having the reinforcing fiberboards 326 attached therein.

Figure 112:
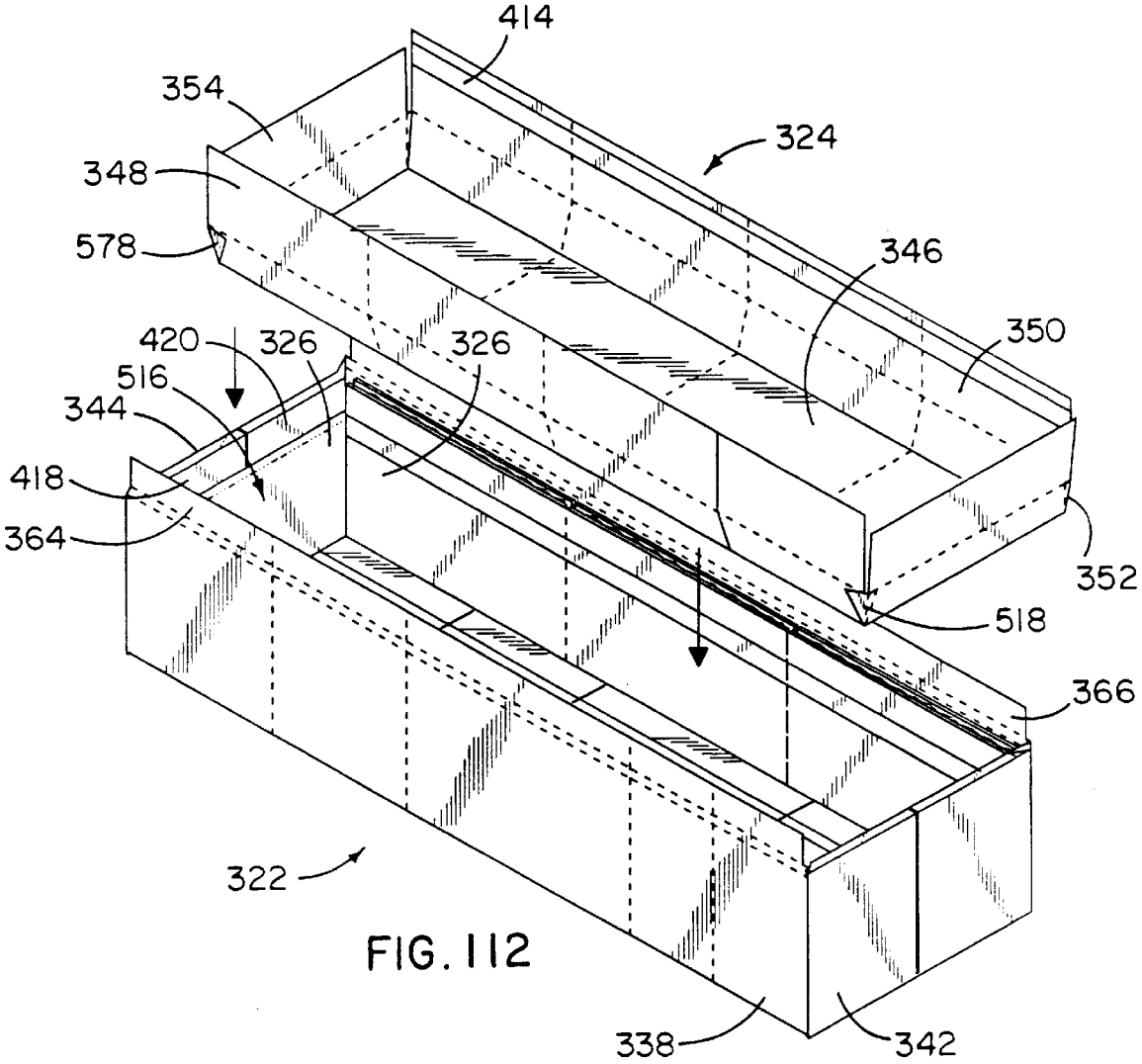

As can be seen in FIG. 112, the fluid containment portion end walls 352 and 354 are shorter than the sidewalls 348 and 350 which are approximately the same height as the corresponding reinforcing side fiberboards 394 attached thereto with both the side fiberboards 394 and fluid containment portion sidewalls 348 and 350 extending up to approximately the innermost flap fold line 360*a* and 362*a* of the flap fold line pairs 360 and 362 on the container outer body portion 322. By contrast, the fluid containment portion end walls 352 and 354 have a height shorter than the sidewalls 348 and 350 by approximately the width of the end flap sections 418 and 420 of the outer body portion 322. As previously described, the end flap sections 418 and 420 are folded down over the reinforcing end fiberboards 392 and attached thereto so that there is a shallow recessed pocket 516 formed between the bottom of the flap sections 418 and 420 and the top of the reinforcing base fiberboard 390 against the end fiberboards 392 for receiving the end walls 352 and 354 of the fluid containment portion 324 therein.

Similar to the previously described fluid containment portion 22, the fluid containment portion 324 includes sealing gussets 518 formed at the juncture of the sidewalls 348 and 350 and the end walls 352 and 354 at the bottom portions thereof. The bottom or lower portions of the fluid containment portion walls 348–354 are tapered inwardly from vertical so as to provide the sealing gussets 518 with sufficient clearance between the fluid containment portion 324 and the fiberboards 326 attached in the outer body portion 322. The taper of the walls 348–354 obviates the need to provide the end fiberboards with the previously described compressed areas or wells 148 that are provided in the reinforcing end fiberboards 144 and 146 of the container assembly 10.

Figure 114:
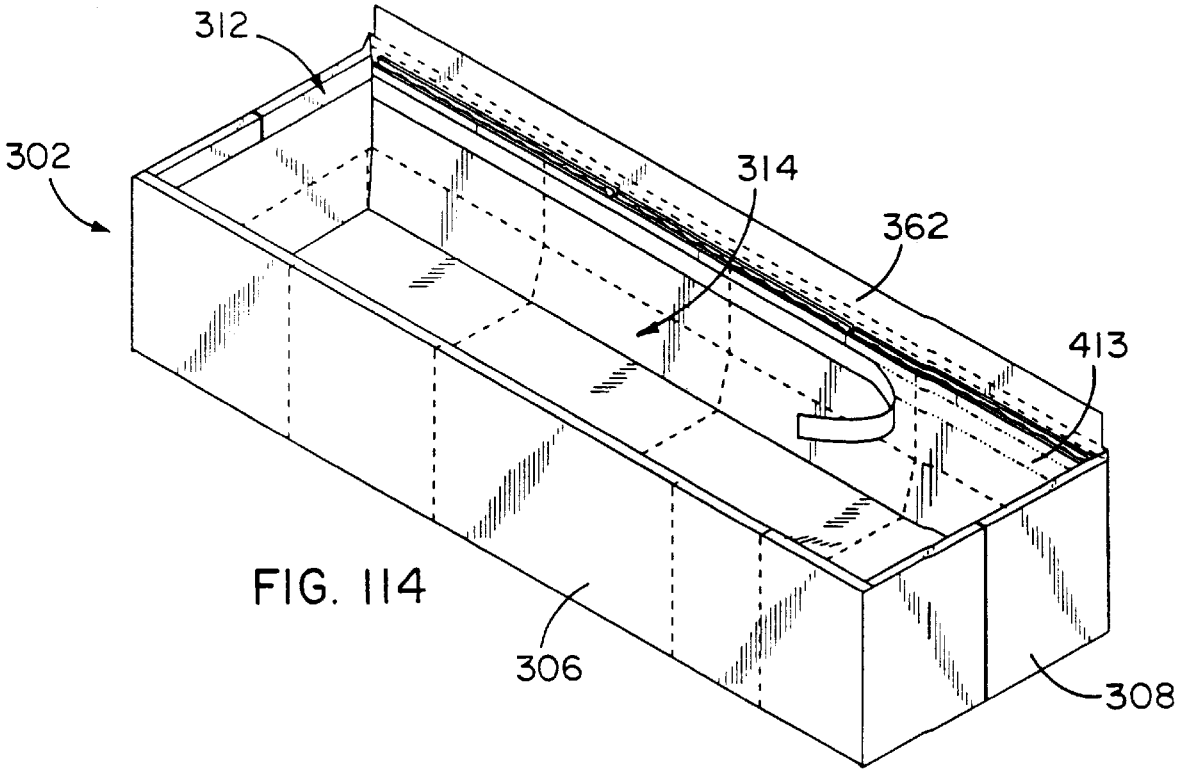
Figure 115:
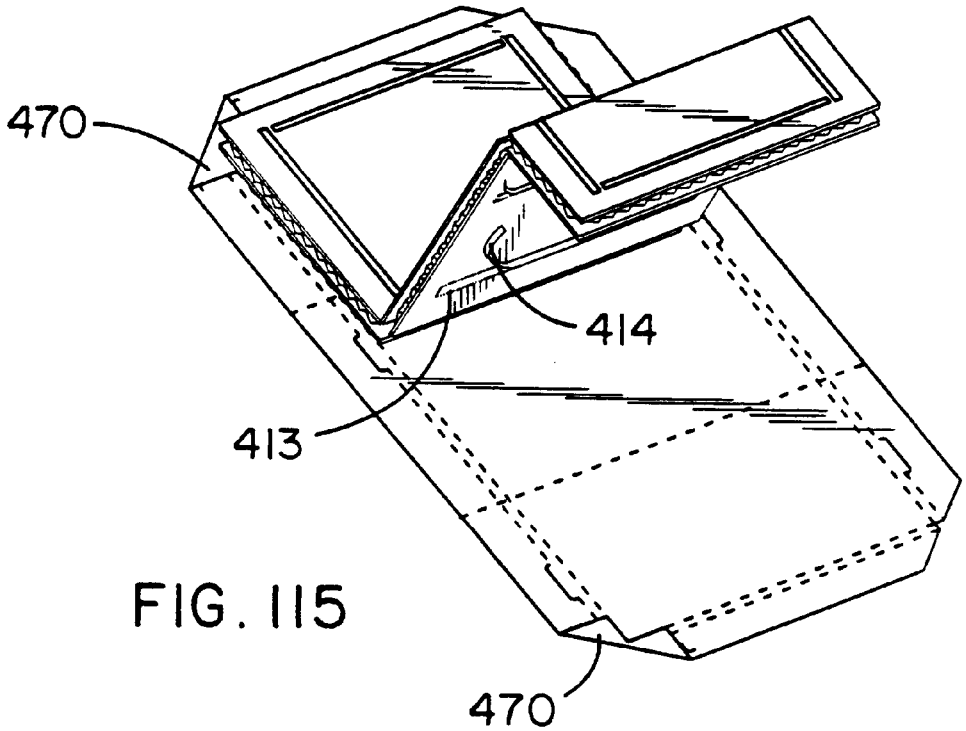
FIGS. 115–117 are perspective views of the assembly of the inner lid portion of the large lid section.

With the fluid containment portion base 346 adhered to the adhesive 413 on the reinforcing base fiberboard 390 and the fluid containment portion end walls 352 and 354 disposed in the recessed pockets 516, the fluid containment portion sidewalls 348 and 350 can be attached to the reinforcing side fiberboards 394 by pivoting of the fluid containment portion sidewalls 348 and 350 inwardly to access the side fiberboards 394 for peeling the release tape 414 therefrom, as shown in FIG. 113. Thereafter, the sidewalls 348 and 350 are pressed against the side fiberboards 394 to attach them thereto. To complete the main container body 302, the release tape 414 covering the adhesive strips 413 formed at the upper end of the fluid containment sidewalls 348 and 350 is peeled to expose the adhesive 413 thereunder, and the flaps 360 and 362 of the outer body portion 322 are folded over the side fiberboards 394 and the fluid containment portion sidewalls 348 and 350 and down onto the exposed adhesive 413 thereon to attach the flaps 360 and 362 down onto the upper portion of the fluid container portion sidewalls 348 and 350, as best seen in FIG. 114. With the main container body 302 completely assembled, the sides 306, ends 308 and base 310 thereof will have a layered construction consisting of the panels 328 and 330 and the reinforcing fiberboards 326 to provide the container body 302 with good strength and rigidity. To further improve the strength and rigidity of the foldable container assembly 300, none of the transverse fold and/or perf lines on the panels 328 and 330 and fiberboards 326, specifically with respect to the outer body portion sidewalls 338 and 340 and the side fiberboards 394, are aligned when the container body 302 is completely assembled in its operative form. Referring to FIGS. 52–57, it can be seen that the spacing of the transverse fold lines across the panels is unequal whereas the spacing of these lines on the side fiberboards 394 are equal so that there will be no alignment when the container body 302 is assembled to thereby improve the strength and rigidity of the sides 306 of the contaier 300.

Figure 116:
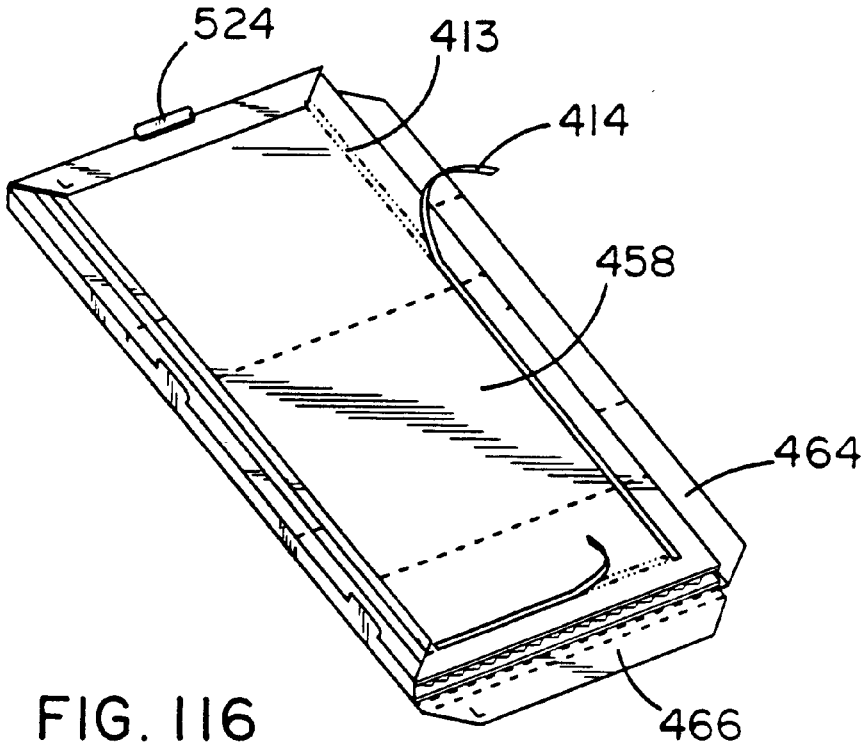

After the main container body 302 has been fully assembled, to complete the container assembly 300, the undertaker next assembles the large lid section 316 (FIG. 122) from its component parts packed in the transport container 320. The assembly of large lid section 316 is depicted in FIGS. 115–122 and is similar in many respects to the assembly of the small lid section 318. First, the large lid section inner portion 436 can be assembled by unfolding the inner portion panel 456 and inner portion reinforcing fiberboard 458 from their folded transport orientations. In addition, the locating corner tabs 470 are folded over their respective perf lines 472 and held in place by raising that material from the panel 456 from the die cuts 520 on either side of the right-angle notches 522 formed in the locating corner tabs 470. To attach the fiberboard 458 to the panel 456, the side of the panel having transverse adhesive strips 413 thereon is arranged to face the panel 456 with the release tape 414 then being removed from the strips 413 and the reinforcing fiberboard 458 aligned on the panel 456 by the locating tabs 470 and pressed into place thereon to adhere the reinforcing fiberboard 458 to the panel 456, as shown in FIG. 116. Thereafter, the longitudinal side and transverse end strips of adhesive 413 on the other side of the reinforcing fiberboard 458 are exposed by peeling the release tape 414 therefrom and the side flaps 464 and end flaps 466 are folded about their pairs of flap fold lines back down onto the exposed adhesive 413 to attach the flaps 464 and 466 to the reinforcing fiberboard 458 to complete the assembly of the large lid section inner portion 436. As the flaps 464 and 466 are folded, tab sections 524 extending from the outermost flap fold line of the pairs of fold lines 462 will break along the perf lines to extend substantially at right angles to the folded over flaps 464 and 466 similar to the small lid section inner portion 480, the large lid inner portion has tabs 524 on the side flaps 464 and one of the end flaps 466.

The assembly of the large lid section outer portion 434 follows in substantially the same fashion as the above-described assembly of the large lid section inner portion 436 utilizing the corner tabs 452 on the panel 438 folded over and held in place by material from die cuts 526 to locate the reinforcing fiberboard 440 by abutting corners thereof with right-angle notches 528 formed in the locating tabs 452 with notches 530 formed around the periphery of the reinforcing fiberboard 440 in alignment with slots 532 formed in side flap sections 446 and one of the end flap sections 448 of the panel 438. When the flap sections 446 and 448 are folded over the fold lines 444 and onto the reinforcing fiberboard 440, the slots 532 will be in alignment of the notches 530. In this manner, when the large lid section outer portion and inner portion 434 and 436 are attached by inserting tab sections 524 into slots 532, there will be clearance below the slots 532 as provided by the notches 530 in the fiberboard 440 for the inserted tab sections 524. To enhance the frictional attachment provided by the cooperating tabs 524 and slots 532, the small lid section inner portion can include longitudinal preapplied adhesive strips 413 on each of the side flaps 464 which can be exposed by peeling the release tape 414 therefrom so as to adhere the flaps 464 of the inner portion 436 onto the side flaps 446 of the outer portion 434.

The flaps of the large lid section outer and inner portions 434 and 436 which do not include respective slots 532 and tabs 524 when folded over form abutment edges 437 and 439 which are aligned with each other. Accordingly, with the large lid section 316 assembled, there will be a lip 533 formed around the smaller inner portion 436 except along the aligned abutment edges 437 and 439 for resting on the top of the main container sides 306 and 308 with the inner portion 436 extending into the interior space 314. The large lid section 316 and small lid section 318 are sized so that when placed on the container body 302, they close the opening 312 to the interior space 314 therein with their respective lips 533 and 479 resting on the top ends of the body side and end walls 306 and 308 and their respective abutment edges 437, 439 and 481, 483 being closely adjacent or engaged with each other in close, tight fitting orientation.

Figure 123:
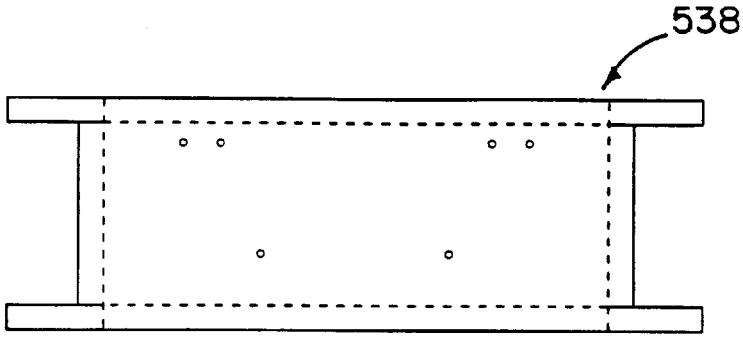
FIGS. 123–126 are views of the assembly of one-half of a hinged cover for the window unit of the alternative small lid section.
Figure 124:
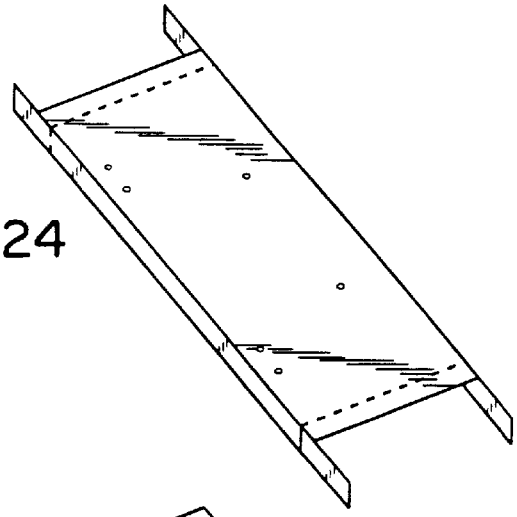
Figure 125:
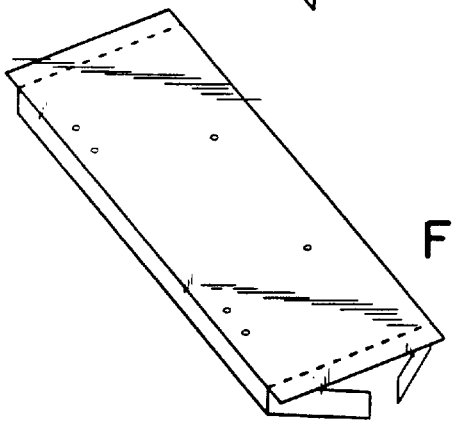
Figure 126:
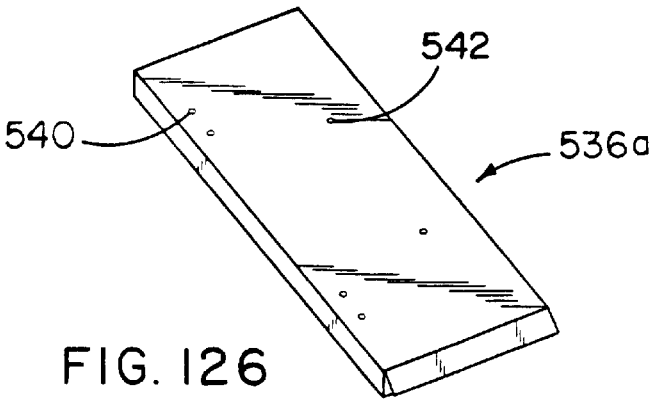
Figure 127:
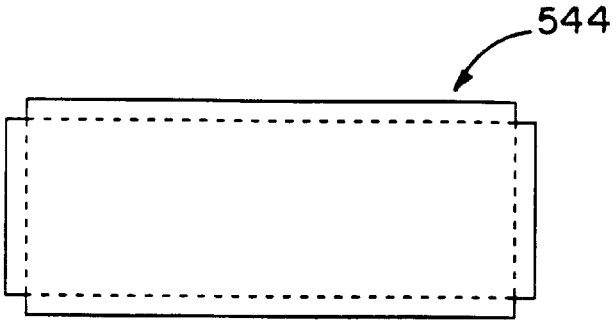
FIGS. 127–130 are views of the assembly of the other half of the hinged cover for the window unit.
Figure 128:
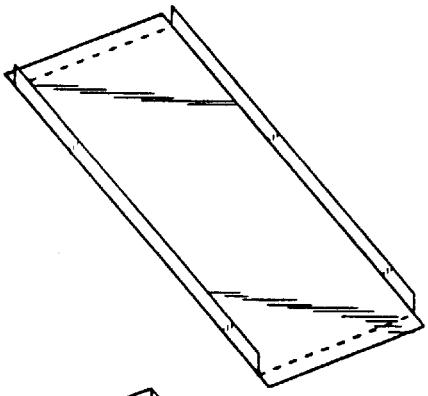
Figure 129:
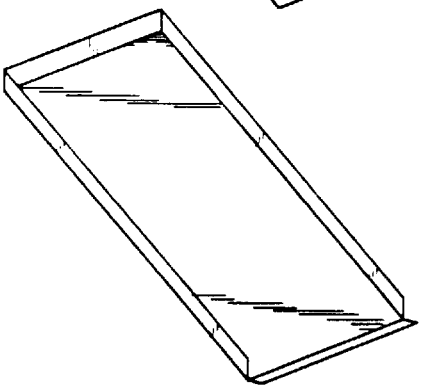
Figure 130:
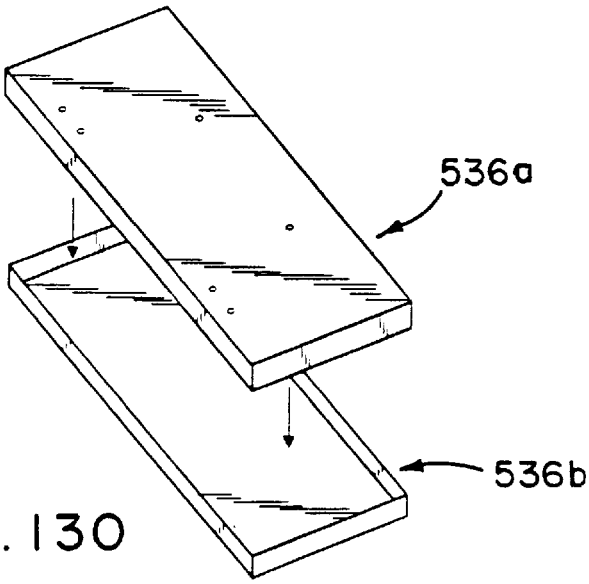

As previously mentioned, the small lid section 318 can be provided with a window unit 320 having a window frame 534 with covers 536 hinged thereto. Construction of one of the covers 536 is illustrated in FIGS. 123–130. FIG. 123 shows a thin cardboard panel 538 for forming one-half 536*a* of one of the covers 536 with the one–half 536*a* including apertures 540 for hinges and apertures 542 for attaching tassels to the covers 536 for pivoting them open about their hinges. FIG. 127 illustrates a thin cardboard panel 544 from which the other half 536*b* of the covers 536 is formed. Accordingly, the window unit 320, similar to the remainder of the container assembly 300, can be formed for a relatively low cost from inexpensive raw materials.

Figure 131:
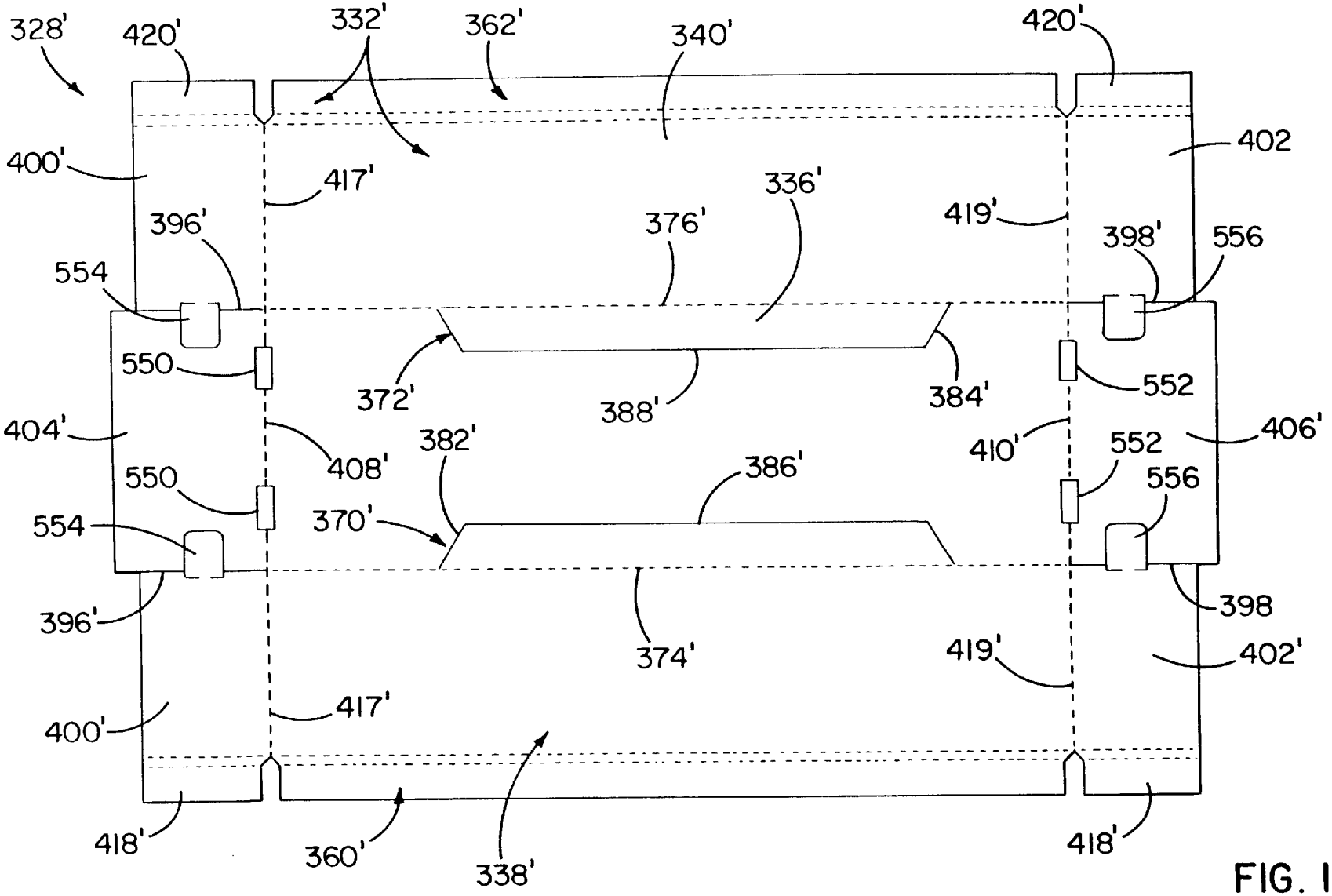
FIGS. 131 and 132 are plan views of panels of corrugated fiberboard material for an outer body portion and a fluid containment portion of another alternative container assembly in accordance with the present invention.

FIGS. 131–151 are directed to components of an alternative container assembly similar to that of container assembly 300. Accordingly, like parts in the modified container assembly (not shown in completely assembled form) will be provided with the same reference numeral as in container assembly 300 with the addition of a prime thereafter. FIG. 131 shows a plan view of the outer body portion panel 328' which includes fold lines 332' substantially the same as on the body panel 328 for the main container body 302 of the container assembly 300. The main difference between the panels 328' and 328 is at either end of the panel where instead of pairs of end panel sections 404 and 406 which include sections in a pair that are laterally spaced from each other, the panel 328' includes solid end panel sections 404' and 406'. Accordingly, the transverse flaps 415 at the end of the corner sections 400 and 402 are eliminated on the corner sections 400' and 402' of the panel 328'. Also, in contrast to the panel 328, the panel 328' includes pairs of tab receiving slots 550 formed in the panel 328' along sections 408' and 410' of transverse fold lines 417' and 419' which divide end panel sections 404' and 406' from the base 336' on the panel 328'. The corner sections 400' and 402' are each provided with central tabs 554 and 556, respsectively, projecting from the pairs of longitudinal perf lines 396' and 398' for being inserted in corresponding slots 550 and 552, respectively, as will be more fully described hereinafter.

Thus, when the solid end panel sections 404' and 406' are folded up about transverse fold lines 408' and 410', respectively, to be perpendicular with the base 336', the pairs of corner sections 400' and 402', folded up about longitudinal fold lines 374' and 376' for forming the side walls 338' and 340', the corner sections 400' and 402' can be bent at right angles to the side walls 338' and 340' about the transverse fold lines 417' and 419', respectively, so as to extend behind the solid end panel sections 404' and 406'. To keep the panel 328' folded up in its operative orientation for forming the outer body portion, the tabs 554 and 556 projecting from the bottom of the upstanding corner sections 400' and 402' can be bent so as to be inserted into tab receiving slots 550 and 552 located at the bottom of the folded up end panel sections 404' and 406'. Similar to the panel 328, after the panel 328' is folded into its operative orientation including the base reinforcing fiberboard 390' and reinforcing fiberboards 392' preassembled thereto, it can be collapsed in an accordion style fashion to a predetermined transport orientation by bringing the ends closer together. As such bending or collapsing is done in substantially the same fashion as with the previously described panel 328, it will not be described further herein.

Another difference between the panels 328 and 328' is in the construction of access flaps 370' and 372'. With the panel 328', the short longitudinal fold lines 378 and 380 are eliminated so that the obligue perf lines 382' and 384' stop at the intermediate longitudinal perf lines 386' and 388'. Accordingly, the panel access flap sections 370*b* and 372*b* are no longer provided on panel 328'.

Figure 132:
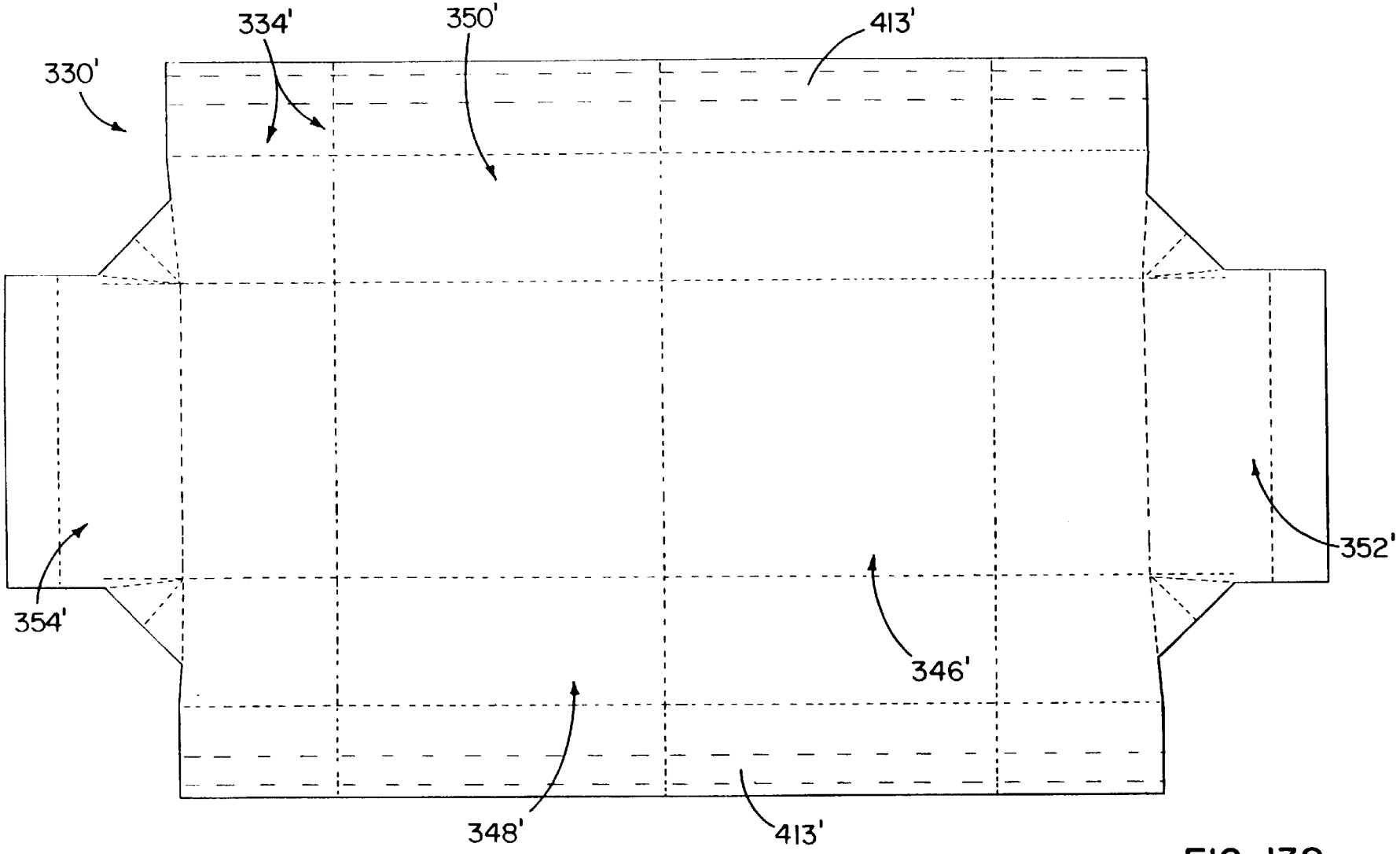

FIG. 132 shows the fluid containment panel 330' which is substantially identical to the fluid containment panel 330 and includes a plurality of perf lines 334' and adhesive strips 412' extending longitudinally on either side thereof. As the folding of the fluid containment panel 330' will be readily apparent from the fold lines 334' on the panel 330', it will not be described in detail hereinafter.

Figure 133:
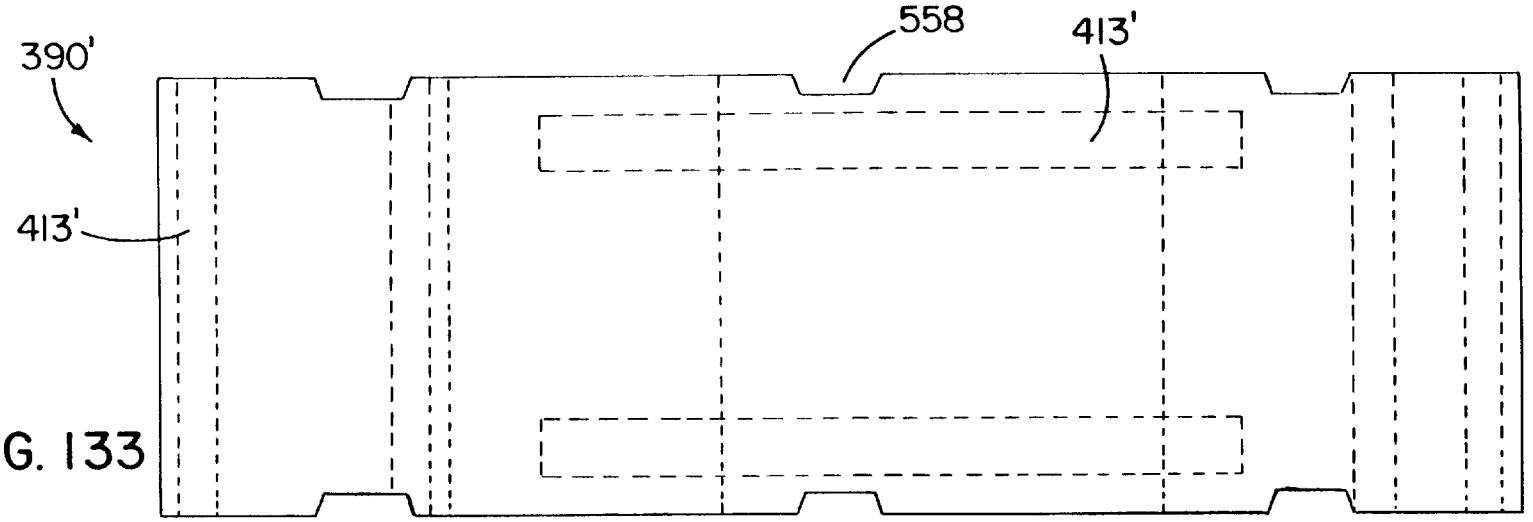
FIGS. 133–137 are plan views of reinforcing fiberboards for being attached between the outer body portion and the fluid container portion in the main container body.
Figure 134:
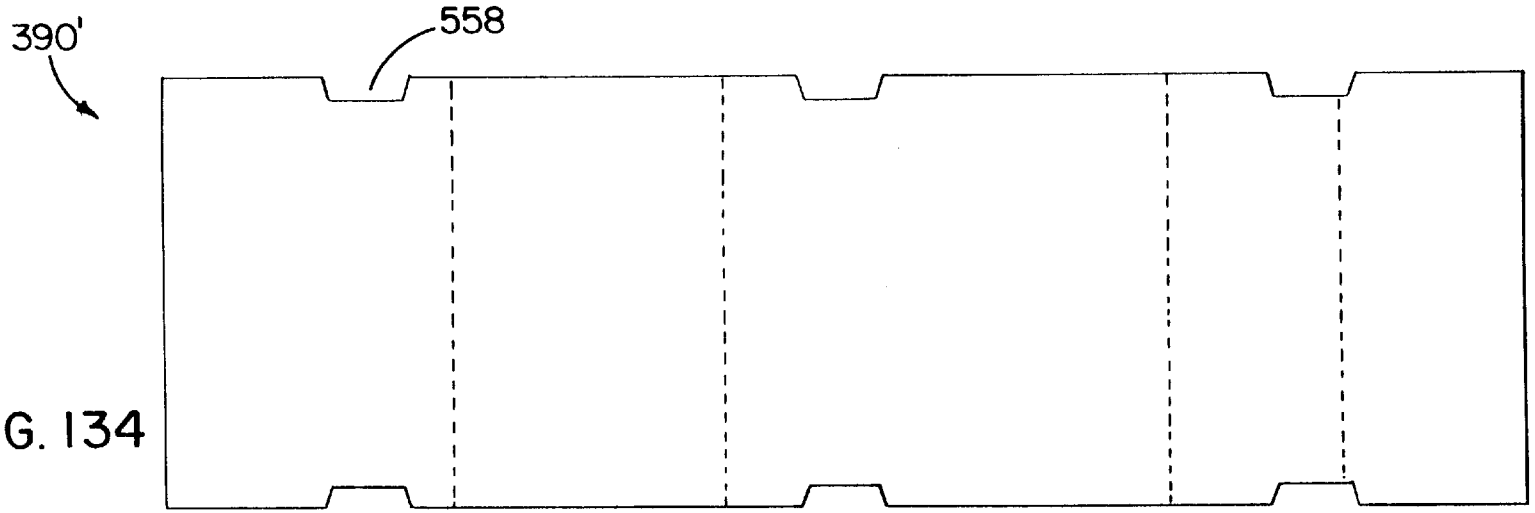

Once the outer body panel 328' and the fluid containment panel 330' have been folded up about their respective fold lines 332' and 334' into their operative positions, the reinforcing fiberboards can be attached therebetween. FIGS. 133 and 134 are directed to the base fiberboard 390' for being placed between the top of the outer body portion base 336' and the bottom of the fluid container portion base 346'. The base fiberboard 390' differs from base fiberboard 390 by the provision of pairs of notches 558 formed at the longitudinal edges of the fiberboard 390'. FIG. 133 is a bottom plan view of the fiberboard 390' and indicates adhesive placement 413' at substantially the same locations as on the bottom of fiberboard 390. By contrast, the top plan view of FIG. 134 illustrates that the base fiberboard 390' lack any adhesive thereon unlike the top of fiberboard 390 for reasons to be described hereafter.

It has been found that during assembly, the use of adhesive 413 on the top of the base fiberboard made it difficult to accurately position the fluid containment portion once it was dropped into the outer body portion and pressed onto the adhesive 413 on the top of the base fiberboard 390. This was because once the fluid containment portion 324 was put into the outer body portion 322, it was adhered in place and could not be moved to more accurately align the fluid containmnet portion 324 in the outer body portion 322, if necessary or desired. As the fluid containment portion on side walls 348' and 350' are to be adhered to reinforcing side fiberboards 394' with the flaps 360' and 362' provided on the panel 328' which, when the panel 328' is folded to its operative position, are folded down onto the adhesive strips 413' on the inner sides of the fluid containment portion side walls 348' and 350', adhering the base 346' of the fluid containment portion to the base fiberboard 390' is not necessarily required to keep the fluid containment portion in place in the outer body portion.

Figure 135:
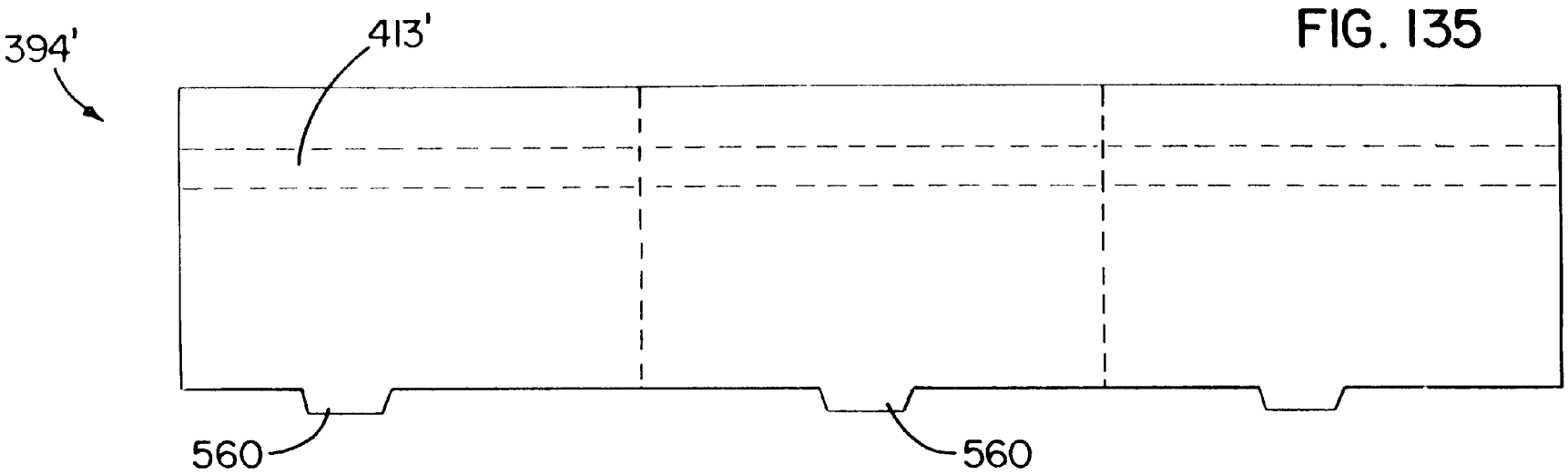
Figure 136:
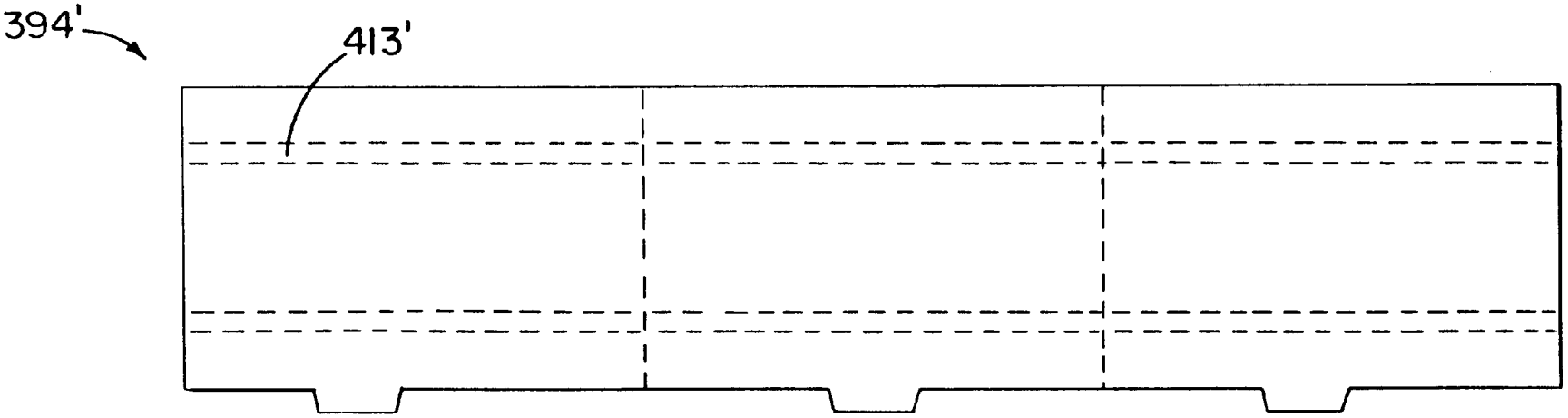

FIGS. 135 and 136 show the side fiberboards 394' which are substantially the same as the side fiberboards 394 including the location of the adhesive strips 413' thereon. The only difference lies in the provision of tabs 560 along the bottom edge of the side fiberboards 394 which are received tightly in the notches 558 provided in the base fiberboard 390' when the side fiberboards 394' are assembled into the outer body portion.

Figure 137:
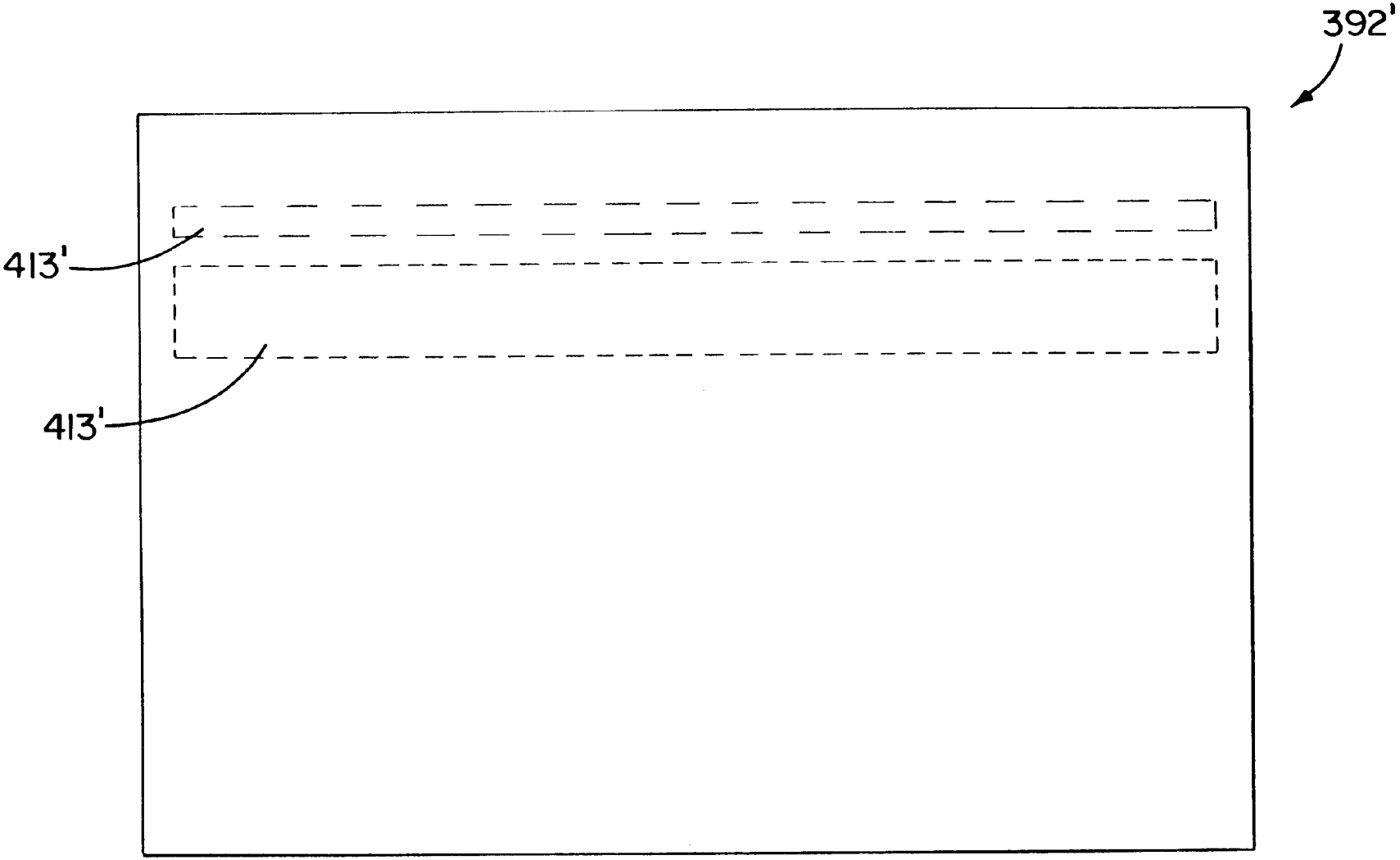

FIG. 137 is a view of one of the end fiberboards 392' which is substantially the same as end fiberboards 392 except with the provision of a second lower stip of adhesive 413' below that of the strip for adhering the folded over end flap sections 418' and 420' when the outer body portion is partially preassembled. With the flap sections 418' and 420' adhered to the upper adhesive strip 413' on the reinforcing end fiberboard 392', the lower adhesive strip 413' will be positioned below the folded over flaps 418' and 420'. Peeling the release tape off from the lower adhesive strip 413' allows the fluid containment portion end walls 352' and 354' to be adhered to the end fiberboards 392' by way of the lower exposed adhesive strip 413' thereon.

FIGS. 138–142 illustrate the construction of the large lid section 434' which differs from the large lid section 434 in that it is in a partially preassembled form when placed in the transport container for shipping purposes. As seen best in FIG. 142, the large lid section 316' can be partially preassembled and folded back on to itself so as to place it in a more compact form for shipping in the transport container 320. With the lid section 316' in its compact transport orientation, an undertaker can readily remove it from the transport container 320 and fold it back to its operative condition by pivoting the folded back portions as indicated by arrows 562 in FIG. 142 for completing the assembly of the large lid section 316'.

Figure 138:
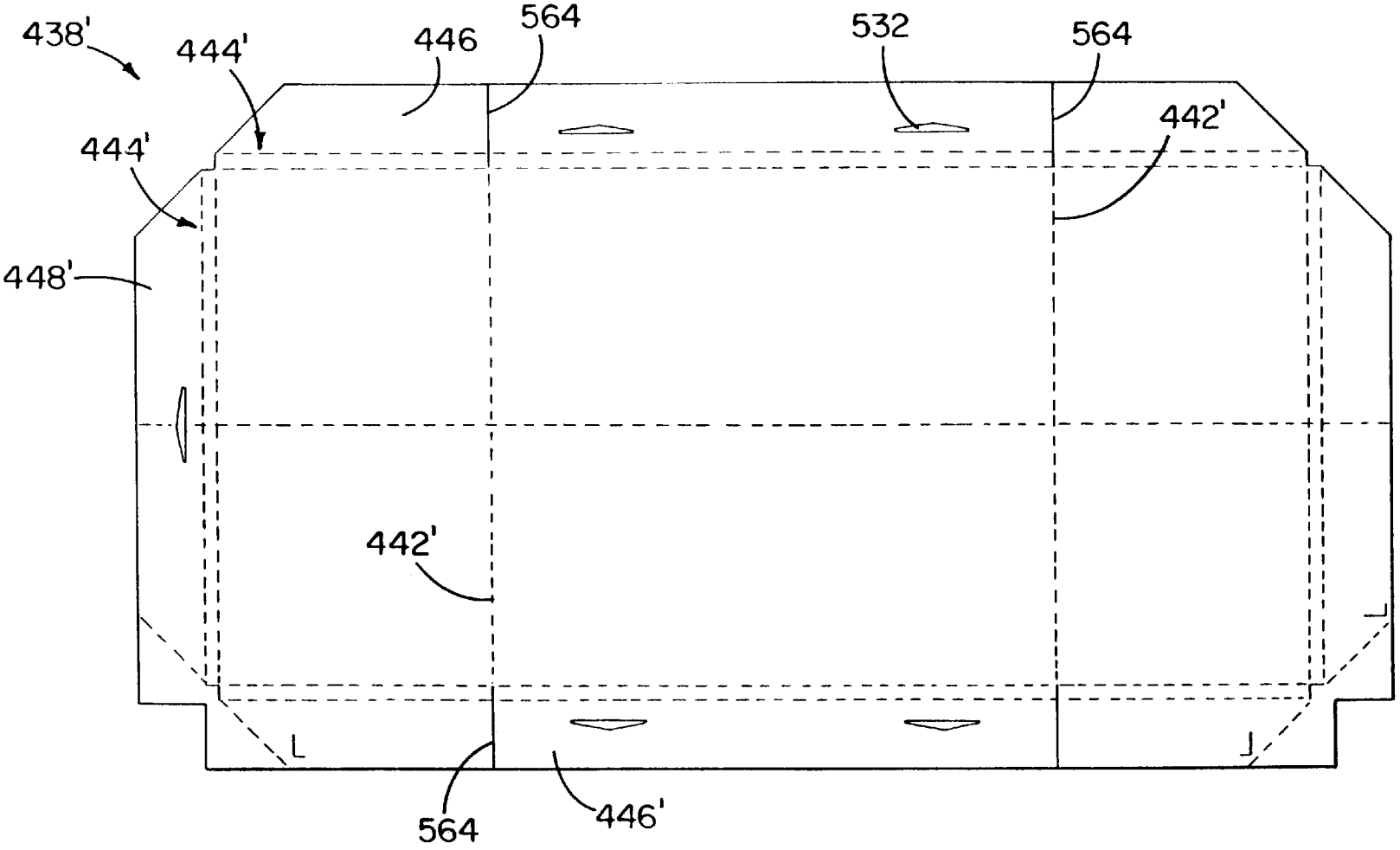
FIGS. 138 and 139 are plan views of a lid outer portion panel and a segmented reinforcing fiberboard for being attached to the panel to form an outer lid portion for the large section of the lid.
Figure 140:
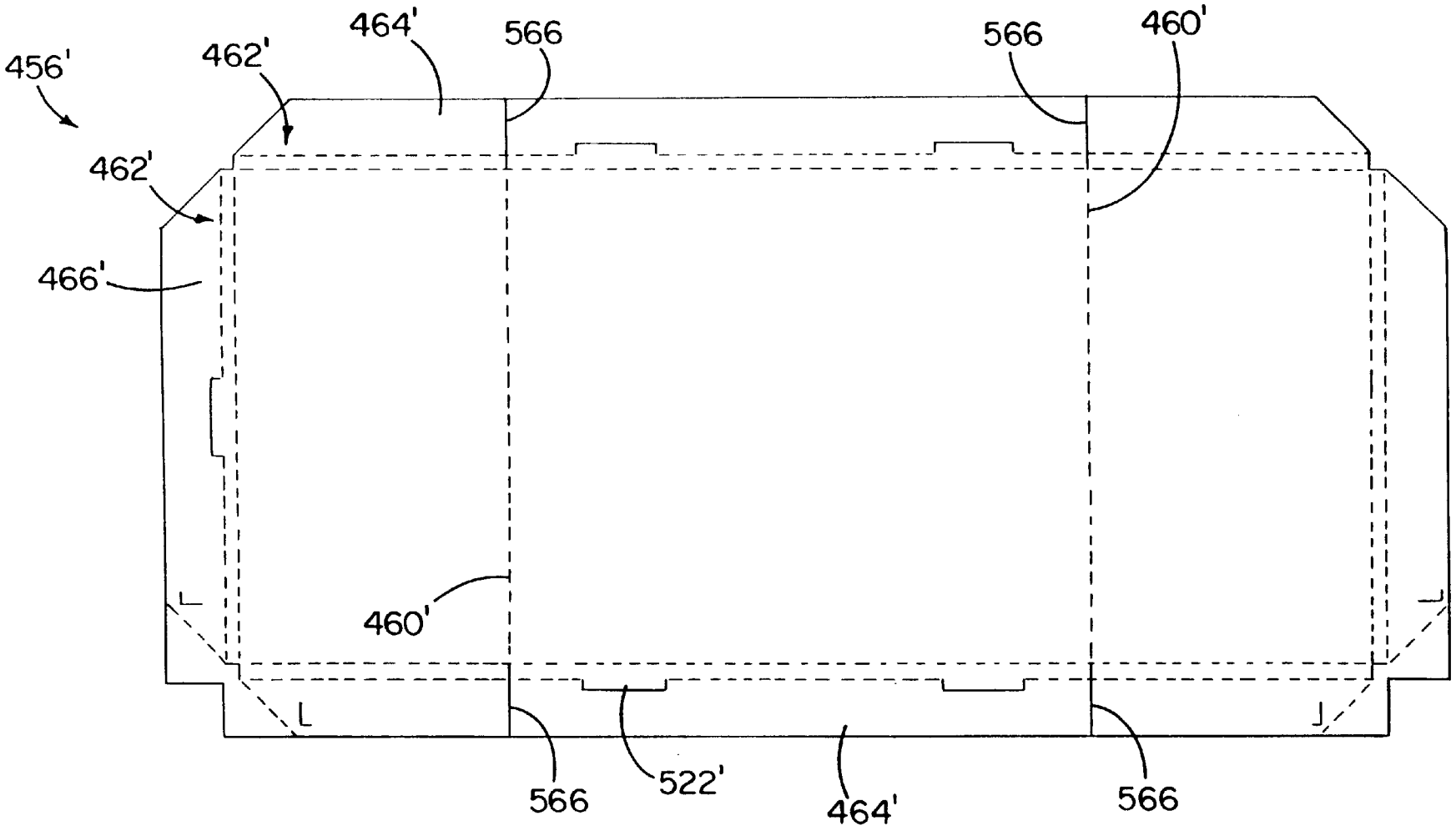
FIGS. 140 and 141 are plan views of a lid inner portion panel and a segmented reinforcing fiberboard for being attached to the panel to form an inner lid portion for the large section of the lid.

The large lid section outer portion panel 438' is shown in FIG. 138 and corresponds substantially to large lid section outer portion panel 438 except that transverse bend or fold lines 442' do not extend into the side flap sections 446' and stop at the innermost one of the longitudinal pair of flap fold lines 444'. Where the transverse fold lines 442' stop at the longitudinal flap fold lines 444', score or perf lines 564 begin and extend to the outer edge of the side flap sections 446' to allow the large lid section outer portion 434' to be folded back over onto itself, as will be more fully described hereinafter. In a similar manner, the large lid section inner portion panel 456' illustrated in FIG. 140 is substantially the same as the panel 456 with the exception that the transverse fold lines 460' stop short at the innermost one of the pairs of longitudinal flap fold lines 462' with score or perf lines 556 extending therefrom to the outer edge of the side flap section 464'.

Figure 139:
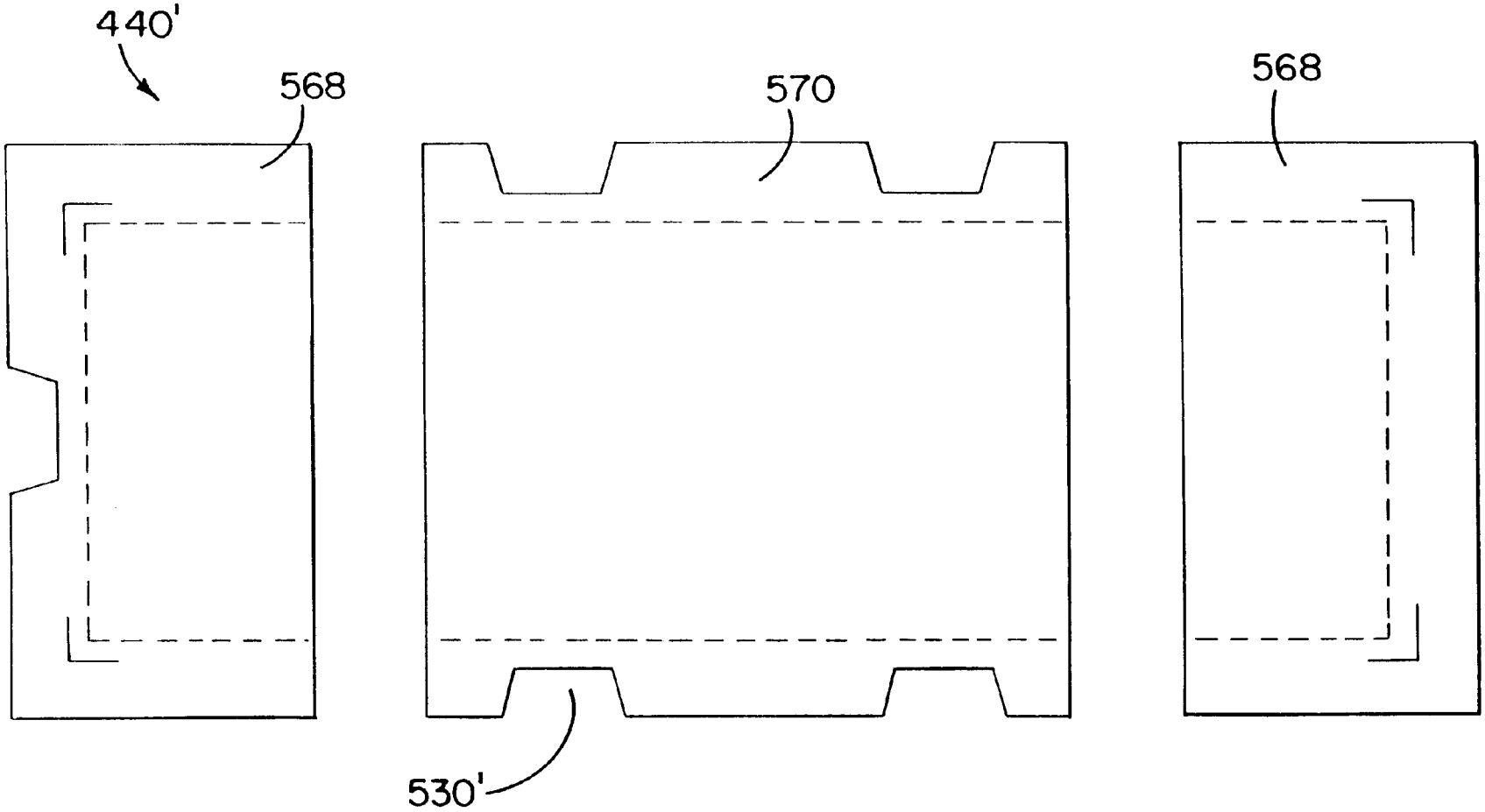
Figure 141:
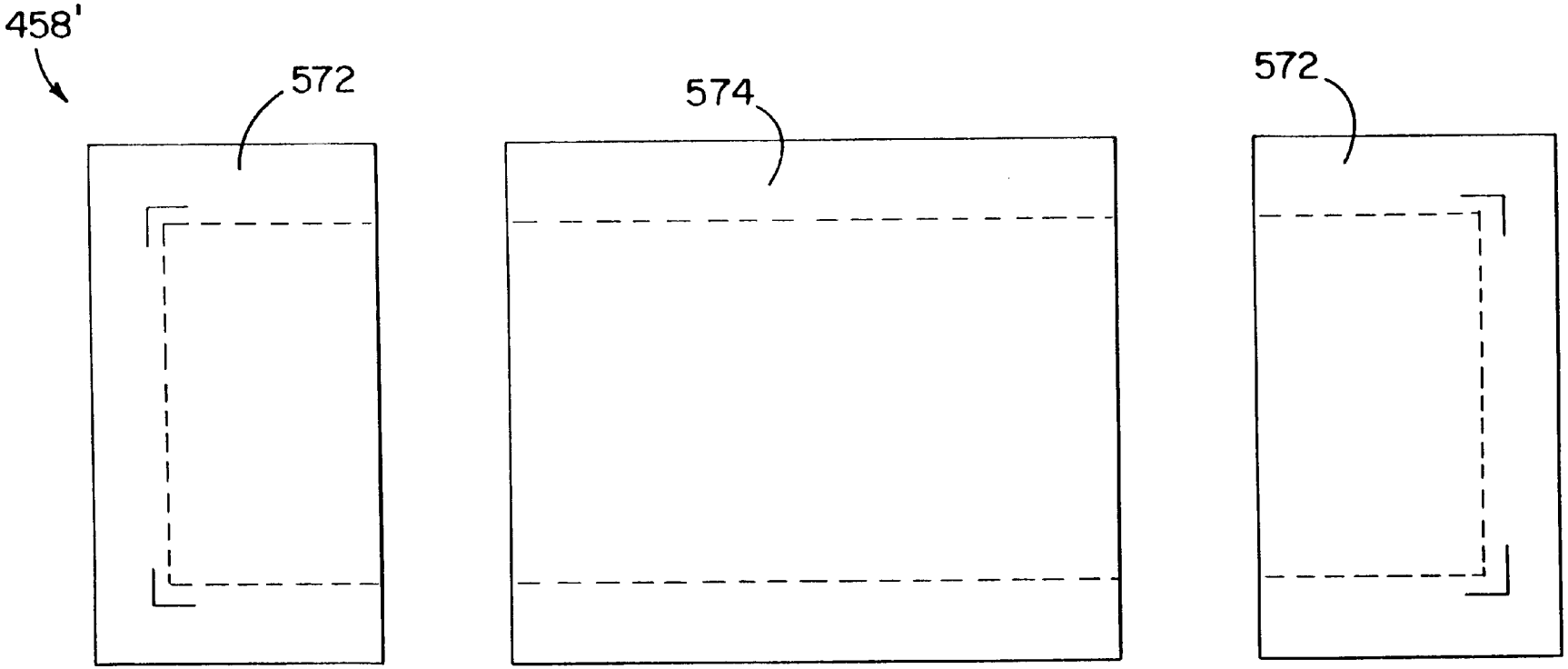

The reinforcing fiberboards 440' and 458' are similar to boards 440 and 458 except that they can be provided in segments, as shown in FIGS. 139 and 141, respectively. Accordingly, the board 440' can have a pair of end segments 568 and a central segment 570 which are adapted to be attached to the outer portion panel 438' at corresponding locations thereon with the end segments 568 attached on either side of the transverse fold lines 442' and the central segment attached on the portion of the panel 438' between the fold lines 442'. Similarly, the board 458' is segmented with end segments 572 and central segment 574 with the end segments 572 attached on panel 456' on either side of the transverse fold lines 460' and the central segment 574 attached on the portion of the panel 456' between the transverse fold lines 460'. The reinforcing fiberboards 440' and 458' can have their respective segments 568, 570; and 572, 574 nicked together as by providing score or perf lines therebetween (not shown) for ease and assembly of the boards 440' and 458' to their respective panels 438' and 456'.

In addition to the above, the panels 438' and 456' are slightly different in the positioning of the slots 532' and tabs 522', respectively, along either side thereof. In this regard, the pairs of slots 532' and pairs of tabs 522' on each side of the panels 438' and 456' are located between the respective score lines 544 and 566. Similarly, the notches 530 on either side of the reinforcing fiberboard 440' are located on the edges of the central segment 570 thereof so that when the panel flap 446' is folded over onto the board 440', the slots 532' will be aligned over the notches 530' so as to provide clearance for the tabs 522' of the large lid section inner portion 436'.

Figure 142:
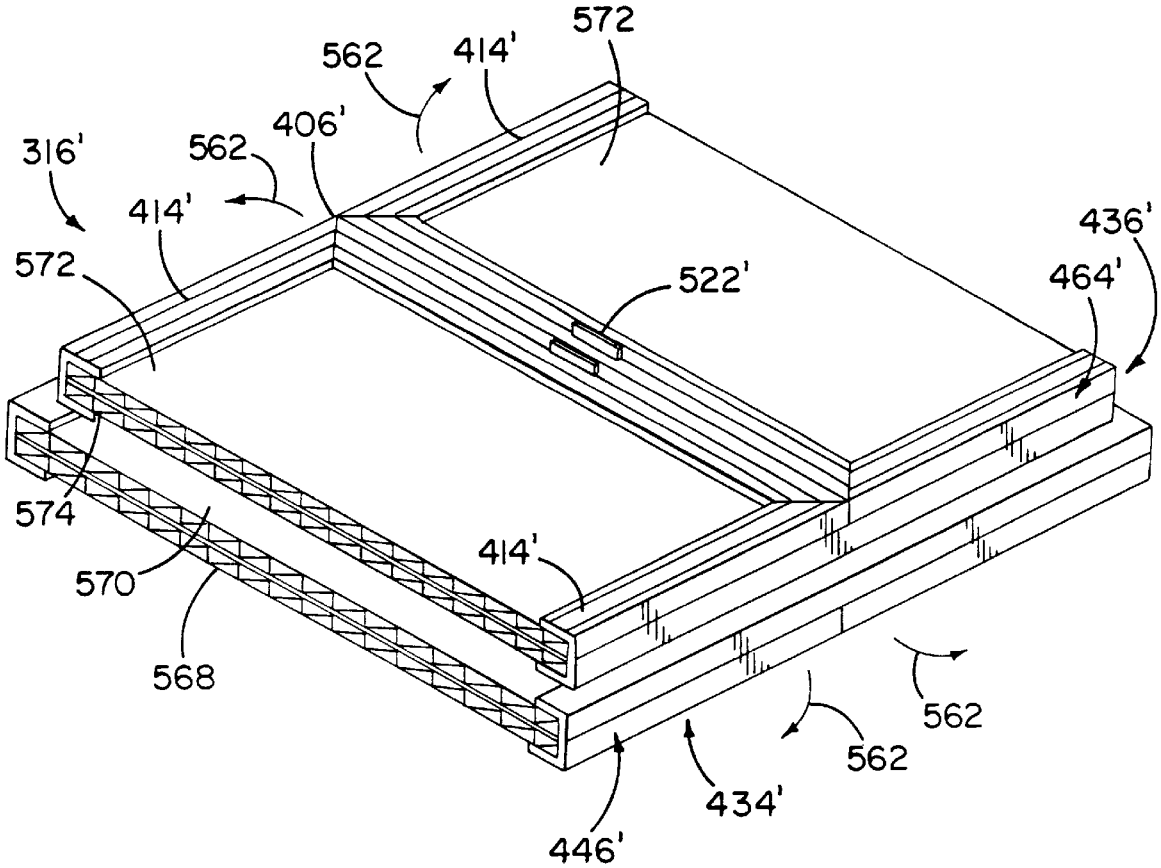
FIG. 142 is a perspective view of the large section of the lid partially assembled and back folded into a compact transport orientation for placement into the transport container.

Once the large lid section's outer and inner portions 434' and 436' are assembled, they can be attached together by first exposing the adhesive 413' on the flaps 464' only on either side of the central segment 574, and then inserting the tabs 522' into the slots 532' and pressing the portions 434' and 436' together so that the large lid section 316' is adhered primarily only along the sides of the central segments 570 and 574 of the reinforcing fiberboards 440' and 458'. This allows the large lid section 316' to be folded into a smaller transport orientation for fitting into the transport container 320, as depicted in FIG. 142.

More specifically, the large lid section outer portion 434' can be bent about transverse fold lines 442' away from the large lid section inner portion 436' to bring the board end segments 568 back onto the board central segment 570 of the outer portion 434'. Such back folding is permitted by the segmentation of the board 438' and also by the pert lines 564 which allows the folded over flaps 446' to break thereat. The large lid section inner portion 436' is folded back in a similar fashion about transverse fold lines 460' and pert lines 566 to bring the board end segments 572 back towards and against the central segment 574 and breaking the panels 464' at the perf lines 566 as an incident of such back folding. To complete the assembly of the partially assembled large lid section 316', the undertaker simply removes the large lid section 316' from the transport container in its backfolded transport form, peels the release tape 414' from the folded over side flaps 464' to expose the adhesive 413' thereunder, and then pivots the large lid section outer portion 434' and inner portion 436' about their respective fold lines and perf lines, 442', 564, and 460', 566 as indicated by arrows 562 to bring the corresponding end segments 568 and end segments 572 back together while inserting the upstanding tabs 522' along the end flaps 466' into corresponding slots 532' formed in end flaps 448'. Accordingly, the partial preassembly of the large lid section 316' eliminates the folding up of the various components as with the large lid section 316 and requiring that they individualy be packed into the transport container 320, and then requiring the undertaker to remove these components and completely assembly the large lid section 316, thus providing substantial savings in time and effort for assembly of the container assembly by the undertaker.

Figure 144:
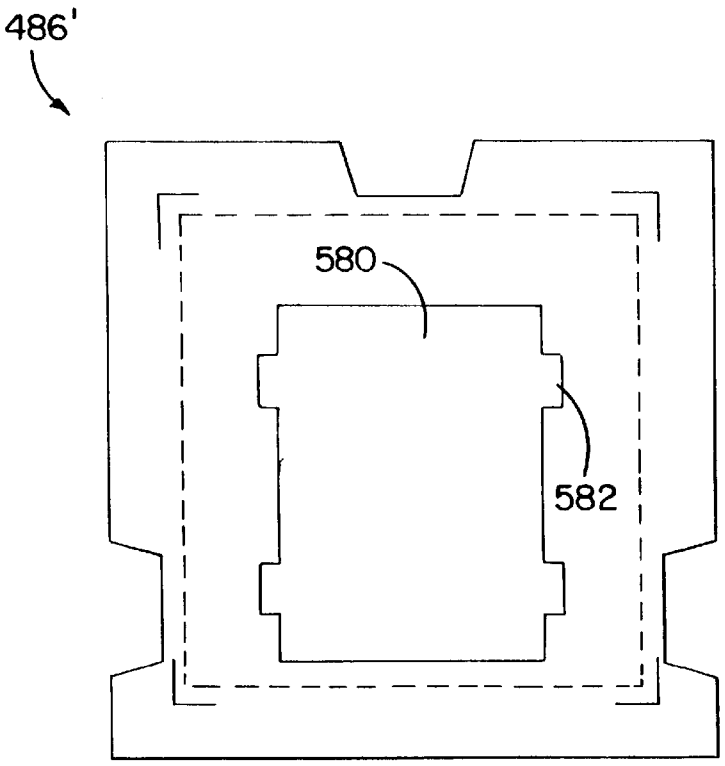
FIGS. 143 and 144 are plan views of a lid outer portion panel and a reinforcing fiberboard for being attached to the panel to form an outer lid portion for the small lid section.
Figure 143:
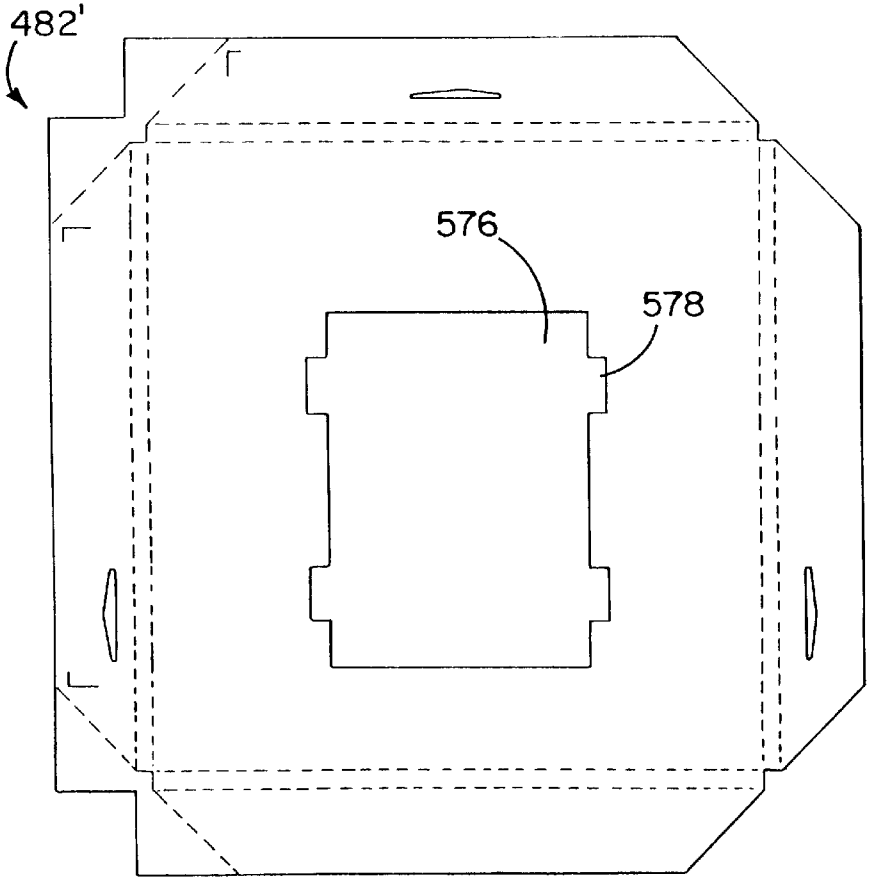
Figure 146:
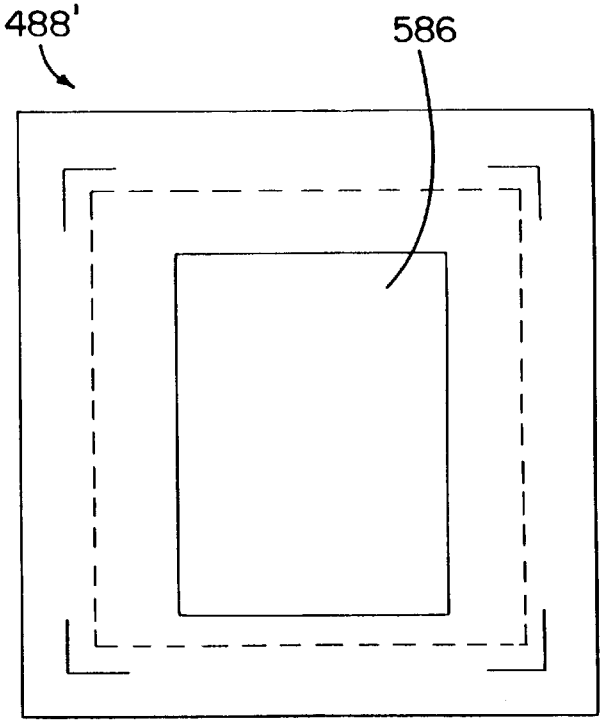
FIGS. 145 and 146 are plan views of a lid inner portion panel and a reinforcing fiberboard for being attached thereto to form an inner lid portion for the small lid section.
Figure 145:
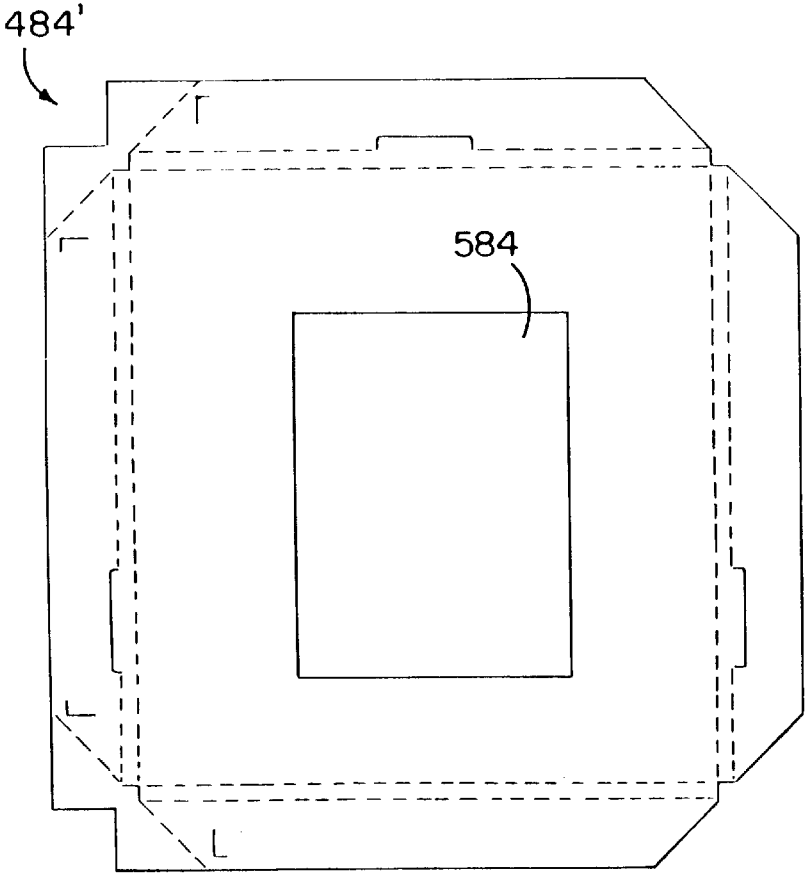

FIGS. 143–148 are directed to the various components of the small lid section 318 which are all substantially the same as the corresponding components in small lid section 318 except for the provision of a central window opening therethrough. Accordingly, FIG. 143 and FIG. 144 illustrate the small lid section outer portion panel 482' having a central window opening 576 therein with notches 578 provided thereround for mounting of window framing along the edges of the window opening 576. A reinforcing fiberboard 486' for being attached to the panel 482' is shown in FIG. 144, and similarly includes a corresponding window opening 580 including frame mounting notches 582 formed thereround. The small lid section inner portion is similarly modified so that the panel 484' thereof includes a central window opening 584 and the board 488' to be attached to the panel 484' includes a corresponding window opening 586. When the small lid section 318 is assembled, the window openings 576, 580 and 584, 586 will all be aligned.

Figure 147:
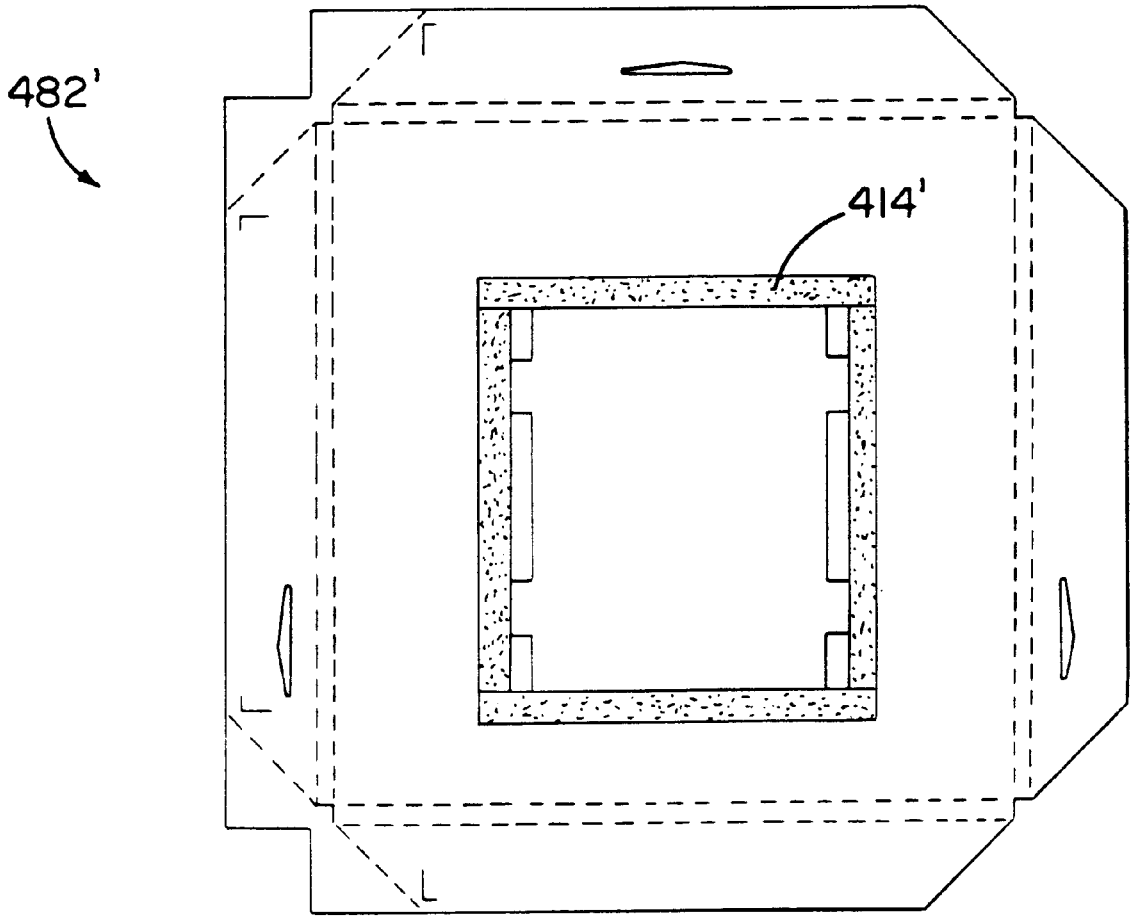
FIGS. 147 and 148 are plan views of the panels for the outer and inner portions of the small lid section, respectively, showing release tape covering adhesive around the window openings in the panels for adherence of a decorative fiber cover thereto.
Figure 148:
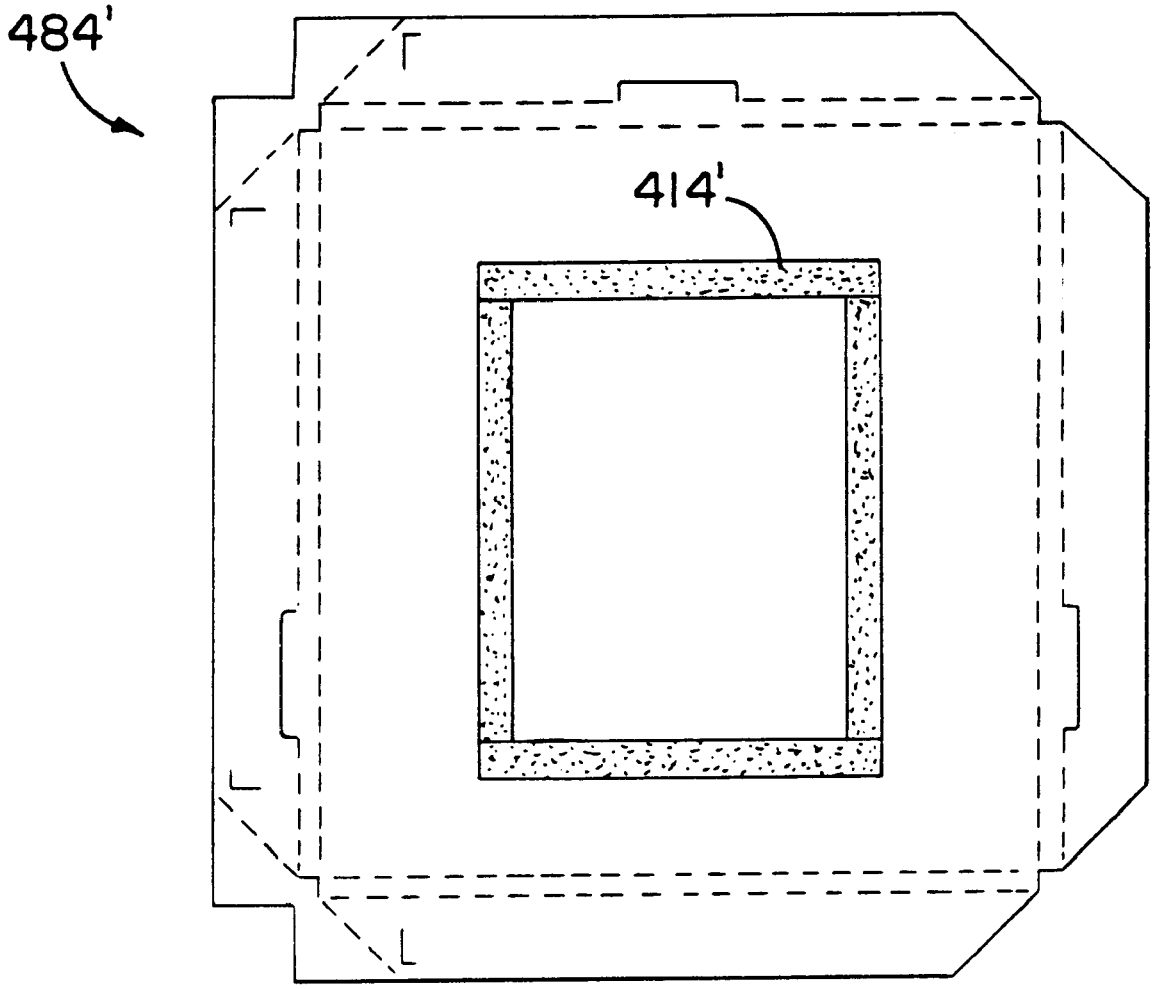

FIGS. 147 and 148 show the option of providing adhesive covered with release tape 414' around the window openings of the panels 482' and 484' to allow a fabric cover to be attached to extend around and cover the exterior of the small lid section.

Figure 150:
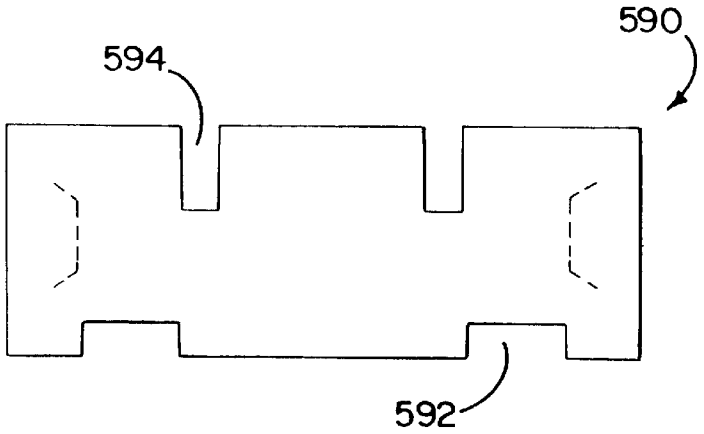
FIGS. 149 and 150 are plan views of a door panel and reinforcing fiberboard for being attached to the panel to form a door for covering the window in the small lid section.
Figure 149:
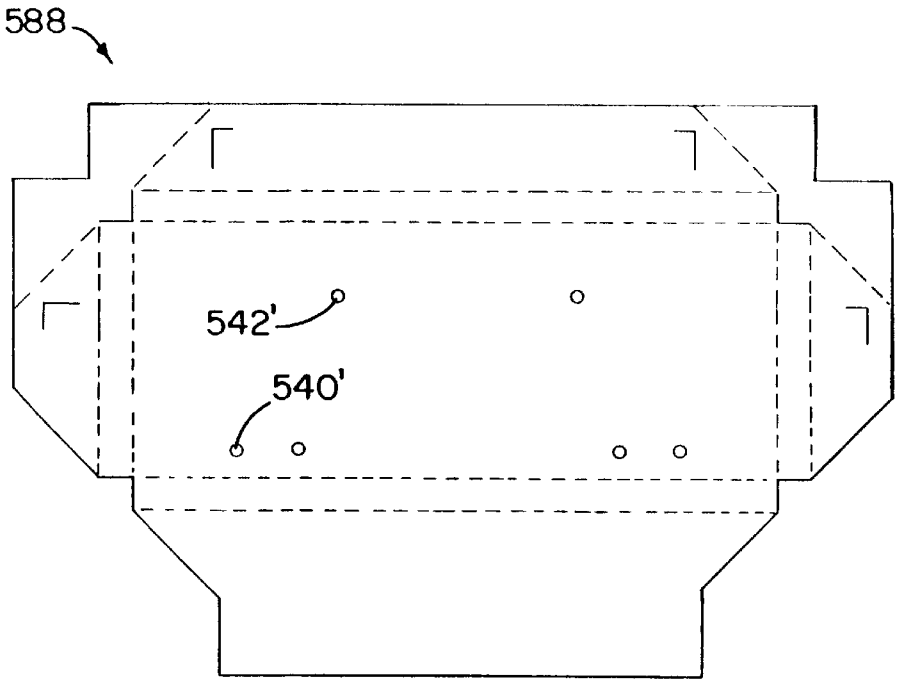

FIGS. 149 and 150 show components for constructing a door to be hinged to the window frame around the window opening of the small lid section. In contrast to the window covers 536 previously described, the window cover panel 588 has a reinforcing fiberboard 590 attached thereto. The panel has pairs of hinge apertures 540' along one side thereof and tassle apertures 542' along the other side with the fiberboard 590 being provided with hinge notches 592 and tassle notches 594 on opposite sides thereof. When the reinforcing fiberboard 590 is attached on the panel 588, the tassle apertures 542' will be aligned with the tassle notches 594 and the hinge apertures 540' will be aligned with the hinge notches 592. In this manner, fasteners for the hinges and tassles will have clearance when inserted in their respective apertures 540' and 542'.

Figure 151:
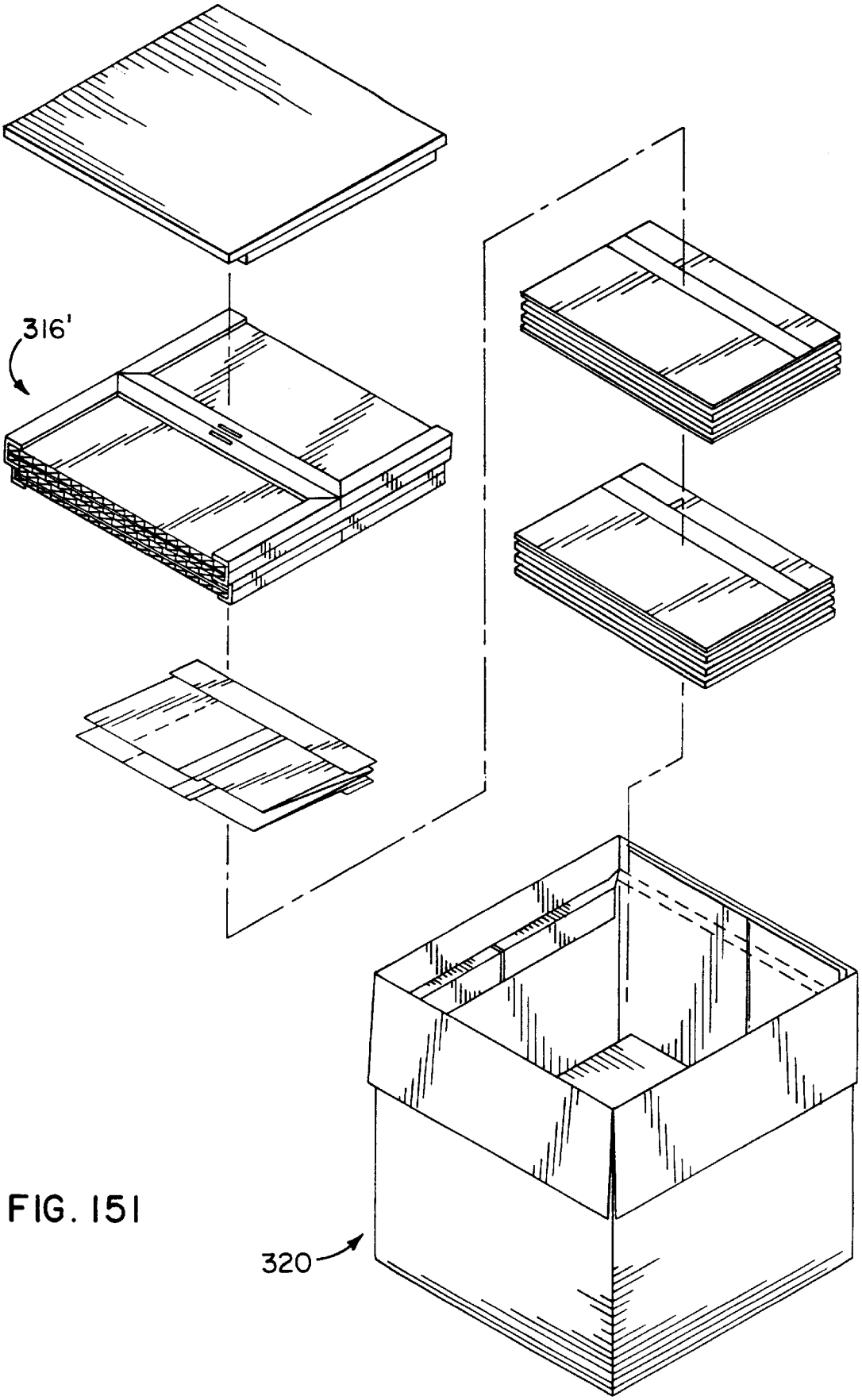
FIG. 151 is a perspective view of the transport container including the main body portion partially preassembled therein and the large lid section partially assembled and folded into its transport orientation for being placed in the container along with the side fiberboards, fluid containment portion, and the small lid section.

FIG. 151 depicts packing of the transport container 320 and shows the reduced number of components that need be packed therein with the partially preassembled large lid section 316'. With the previously described container assembly 300 where the large lid section 316 was not preassembled, the large lid section outer portion and inner portion panels 438 and 456, and the large lid section outer and inner portion reinforcing fiberboards 440 and 458 all had to be separately folded for transport and packed in the container 320, as depicted in FIG. 106*b*. Accordingly, an undertaker had to remove and unfold all these components and then proceed to assemble the large lid section completely from its constituent components, whereas the large lid section 316' can be folded into its compact form and placed in the container 320 so as to only require the undertaker to remove one part and then unfold the backfolded compact form of the large lid section 316' out to its operative orientation in a relatively simple and quick manner thereby significantly reducing the effort and assembly time required of the undertaker.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. In a container assembly, a main container body of fiberboard material for supporting and containing a corpse, the main container body comprising:

an outer body portion formed from a body panel of corrugated fiberboard material having a plurality of fold lines to allow the body panel to be folded into a predetermined operative orientation with a base and upstanding walls therefrom; and bending lines of the body panel fold lines which allow the outer body portion to be bent from its predetermined operative orientation to a predetermined smaller transport orientation with the walls still being in upstanding relation relative to the base for being placed in a transport container smaller than the container assembly, wherein the upstanding walls have an upper periphery bounding an opening and the outer body portion opening is smaller with the outer body portion bent to its predetermined transport orientation than with the outer body portion folded into its predetermined operative orientation.

2. The main container body of claim 1 wherein the outer body portion predetermined operative orientation is a substantially rectangular box shape with the upstanding walls including opposite side walls and end walls, and reinforcing fiberboards for being attached to the base and side and end walls of the outer body portion to add strength thereto, the reinforcing fiberboards for the outer body portion base and end walls being substantially preassembled thereto with the outer body portion in its predetermined transport orientation.

3. The main container body of claim 1 in combination with a lid for closing the main container body, the lid having a first section and second section with the sections each including first and second lid portions with one of the first and second lid portions having dimensions smaller than the other of the first and second lid portions to form a lip extending substantially around the one smaller lid portion which rests on top of the main container body with the one smaller lid portion extending into the main container body.

4. The combination of claim 3 wherein the first lid portion includes a first abutment edge and the second lid portion includes a second abutment edge that is in substantially aligned relation with the first abutment edge so that the lip does not extend around the one smaller lid portion at the aligned abutment edges and with the first and second sections resting on top of the main container body their abutment edges are in close fitting orientation with each other to close off the main container body with the lid sections.

5. The main container body of claim 1 in combination with a lid for closing the main container with the lid including first and second lid portions with one of the first and second lid portions being smaller than the other of the first and second lid portions to form a lip for resting on top of the main container body, each of the lid portions being formed from a lid panel and a segmented reinforcing fiberboard attached thereto which allows the lid portions to be connected and bent back to a smaller transport form to be placed in a transport container in a partially preassembled state.

6. In a container assembly, a main container body of fiberboard material for supporting and containing a corpse, the main container body comprising:

an outer body portion formed from a body panel of corrugated fiberboard material having a plurality of fold lines to allow the body panel to be folded into a predetermined operative orientation with a base and upstanding walls therefrom; and bending lines of the body panel fold lines which allow the outer body portion to be bent from its predetermined operative orientation to a predetermined smaller transport orientation for being placed in a transport container smaller than the container assembly, wherein the outer body portion predetermined operative orientation is a substantially rectangular box shape with the upstanding walls including opposite side walls and end walls, and the bending lines are on the base and the side walls with the outer body portion being bent to its predetermined transport orientation from the rectangular box predetermined operative orientation by bending the side walls and base along the bend lines thereon to bring the end walls closer towards each other with the predetermined transport orientation being substantially a square box shape.

7. In a container assembly, a main container body of fiberboard material for supporting and containing a corpse, the main container body comprising:

an outer body portion formed from a body panel of corrugated fiberboard material having a plurality of fold lines to allow the body panel to be folded into a predetermined operative orientation with a base and upstanding walls therefrom; and bending lines of the body panel fold lines which allow the outer body portion to be bent from its predetermined operative orientation to a predetermined smaller transport orientation for being placed in a transport container smaller than the container assembly, wherein the outer body portion predetermined operative orientation is a substantially rectangular box shape with the upstanding walls including opposite side walls and end walls, and reinforcing fiberboards for being attached to the base and side and end walls of the outer body portion to add strength thereto, the reinforcing fiberboards for the outer body portion base and end walls being substantially preassembled thereto with the outer body portion in its predetermined transport orientation, wherein the reinforcing fiberboard attached to the outer body portion base includes fold lines about which the reinforcing fiberboard is folded for being preassembled and attached to the outer body portion base with the outer body portion in its predetermined transport orientation so that when the body portion is removed from the transport container and expanded to its predetermined operative orientation the reinforcing fiberboard will unfold to lie on top of the outer body portion base.

8. The main container body of claim 7 wherein the outer body portion includes access flaps on the base which provide access to the unfolded reinforcing fiberboard overlying the outer body portion base for attaching the reinforcing fiberboard to the flaps when folded down thereon.

9. In a container assembly, a main container body of fiberboard material for supporting and containing a corpse, the main container body comprising:

an outer body portion formed from a body panel of corrugated fiberboard material having a plurality of fold lines to allow the body panel to be folded into a predetermined operative orientation with a base and upstanding walls therefrom;

bending lines of the body panel fold lines which allow the outer body portion to be bent from its predetermined operative orientation to a predetermined smaller transport orientation for being placed in a transport container smaller than the container assembly; and an inner fluid containment portion formed from a fluid containment panel of corrugated fiberboard material having a plurality of fold lines to allow the containment panel to be folded into a predetermined operative orientation with a base and upstanding walls therefrom for being attached in the outer body portion to minimize fluid leakage from the main container body, and reinforcing fiberboards attached between the bases and walls of the outer body portion and the fluid containment portion with the fiberboards including fold lines for being folded for transport, wherein with the outer body portion and the fluid containment portion in their operative orientations and the reinforcing fiberboards attached therebetween, the respective fold lines of the outer body portion walls, the fluid containment portion walls and the fiberboards therebetween will be in non-aligned relation with each to enhance the strength of the main container body.

10. In a container assembly, a main container body of fiberboard material for supporting and containing a corpse, the main container body comprising:

an outer body portion formed from a body panel of corrugated fiberboard material having a plurality of fold lines to allow the body panel to be folded into a predetermined operative orientation with a base and upstanding walls therefrom; and bending lines of the body panel fold lines which allow the outer body portion to be bent from its predetermined operative orientation to a predetermined smaller transport orientation for being placed in a transport container smaller than the container assembly, the main container body further being in combination with a lid for closing the main container body, the lid having a first section and second section with the sections each including first and second lid portions with one of the first and second lid portions having dimensions smaller than the other of the first and second lid portions to form a lip extending substantially around the one smaller lid portion which rests on top of the main container body with the one smaller lid portion extending into the main container body, wherein the portions of the lid sections are each formed from a lid panel of corrugated fiberboard material having a plurality of fold lines, reinforcing fiberboards attached to the lid panels with the panels including flap sections for being folded about the lid panel fold lines and onto the reinforcing fiberboards for being attached thereto;

cooperating tabs and slots around the lid portions in the panel flap sections with the tabs and slots being aligned for inserting the tabs in the slots to attach the lid portions together; and cut-outs around the reinforcing fiberboards aligned with the tabs and slots of the lid portions to provide clearance for the tabs inserted in the slots.

* * * * *